US009938050B2

(12) United States Patent
Berge

(10) Patent No.: US 9,938,050 B2
(45) Date of Patent: Apr. 10, 2018

(54) CLOSURE WITH HINGED TAMPER BAND

(71) Applicant: Silgan White Cap LLC, Downers Grove, IL (US)

(72) Inventor: Gary L. Berge, Crystal Lake, IL (US)

(73) Assignee: Silgan White Cap LLC, Downers Grove, IL (US)

( * ) Notice: Subject to any disclaimer, the term of this patent is extended or adjusted under 35 U.S.C. 154(b) by 29 days.

(21) Appl. No.: 15/154,680

(22) Filed: May 13, 2016

(65) Prior Publication Data

US 2017/0327278 A1 Nov. 16, 2017

(51) Int. Cl.
*B65D 41/34* (2006.01)
*B65D 47/12* (2006.01)
(Continued)

(52) U.S. Cl.
CPC ..... *B65D 41/3428* (2013.01); *B65D 47/122* (2013.01); *B65D 75/5883* (2013.01); *B65D 41/34* (2013.01); *B65D 41/3409* (2013.01); *B65D 41/3438* (2013.01); *B65D 47/06* (2013.01); *B65D 47/12* (2013.01);
(Continued)

(58) Field of Classification Search
CPC ..... B65D 41/3428; B65D 47/122; B65D 75/5883; B65D 2101/003; B65D 2101/0046; B65D 47/12; B65D 41/3409; B65D 41/3438; B65D 55/022; B65D 75/008; B65D 41/34; B65D 47/06
See application file for complete search history.

(56) References Cited

U.S. PATENT DOCUMENTS 2,148,864 A 2/1939 Kistner
3,463,341 A 8/1969 Fileds
(Continued)

FOREIGN PATENT DOCUMENTS

CA 157967 7/2015
DE 29609596 U1 10/1996
(Continued)

OTHER PUBLICATIONS

U.S. Appl. No. 29/507,935, filed Oct. 31, 2014, Berge.
(Continued)

*Primary Examiner* — Frederick C Nicolas
(74) *Attorney, Agent, or Firm* — Reinhart Boerner Van Deuren s.c.

(57) ABSTRACT

A container assembly including a pouch, spout and closure is provided. The closure includes a tamper-evident band having two or more wall sections. Adjacent wall sections of the tamper band may be connected to one another with frangible connectors configured to break upon twist-off of the closure from the spout. The closure also includes one or more support walls supported between an outer wall and central wall of the closure. The closure further includes one or more hinges attaching the ends of the wall sections of the tamper band to the lower ends of the support walls. The hinges are configured to increase the resistance required to break or otherwise distort the frangible connections of the tamper-evident band, so as to prevent or lower the risk of accidental or inadvertent breakage of the tamper-evident band prior to twist-off of the closure from the spout.

20 Claims, 44 Drawing Sheets

(51) Int. Cl.

| | |
|---|---|
| ***B65D 75/58*** | (2006.01) |
| *B65D 75/00* | (2006.01) |
| *B65D 55/02* | (2006.01) |
| *B65D 47/06* | (2006.01) |

(52) U.S. Cl.

CPC ..... *B65D 55/022* (2013.01); *B65D 75/008* (2013.01); *B65D 2101/003* (2013.01); *B65D 2101/0046* (2013.01)

(56) References Cited

U.S. PATENT DOCUMENTS

| | | | |
|---|---|---|---|
| 4,305,516 | A | 12/1981 | Perne |
| D272,324 | S | 1/1984 | Mumford et al. |
| D273,368 | S | 4/1984 | Hayes |
| 4,503,986 | A | 3/1985 | Nixdorff et al. |
| 4,505,401 | A | 3/1985 | Berglund |
| D278,311 | S | 4/1985 | Brown et al. |
| 4,573,601 | A | 3/1986 | Berglund |
| 4,653,657 | A | 3/1987 | Papavasilopoulos |
| 4,805,791 | A | 2/1989 | Begley |
| 4,852,751 | A | 8/1989 | Halfacre |
| 5,040,692 | A | 8/1991 | Julian |
| D361,265 | S | 10/1993 | Doxey |
| 5,295,600 | A | 3/1994 | Kowal |
| D359,683 | S | 6/1995 | Beach et al. |
| 5,823,383 | A | 10/1998 | Hins |
| 5,853,095 | A | 12/1998 | Marshall et al. |
| 5,927,549 | A | 7/1999 | Wood |
| D445,678 | S | 7/2001 | Malmborg |
| 6,330,959 | B1 | 12/2001 | Dark |
| D454,066 | S | 3/2002 | Trabal |
| D460,357 | S | 7/2002 | Kras et al. |
| D467,501 | S | 12/2002 | Tacchella |
| 6,557,714 | B2 | 5/2003 | Babcock et al. |
| D476,565 | S | 7/2003 | Rosén |
| 6,612,466 | B1 | 9/2003 | Malin |
| D489,978 | S | 5/2004 | Brown |
| 6,783,014 | B2 | 8/2004 | Luker |
| 6,811,047 | B1 | 11/2004 | Hicks et al. |
| 6,860,406 | B2 | 3/2005 | Kobetsky et al. |
| 6,958,033 | B1 | 10/2005 | Malin |
| D542,654 | S | 5/2007 | Szczesniak |
| D542,655 | S | 5/2007 | Szczesniak |
| D542,656 | S | 5/2007 | Szczesniak |
| D544,348 | S | 6/2007 | Szczesniak |
| D547,657 | S | 7/2007 | Tacchella |
| D551,975 | S | 10/2007 | Gomoll et al. |
| D552,483 | S | 10/2007 | Rigardo |
| D564,884 | S | 3/2008 | Rittman |
| D574,241 | S | 8/2008 | Braukmann et al. |
| D579,332 | S | 10/2008 | Krivoshein |
| 7,677,422 | B2 | 3/2010 | Lee |
| 7,735,666 | B2 | 6/2010 | Niwa et al. |
| 7,753,233 | B2 | 7/2010 | Umenaka |
| D631,349 | S | 1/2011 | Arnell et al. |
| 7,882,977 | B2 | 2/2011 | Johnson |
| D633,386 | S | 3/2011 | Taber et al. |
| D634,199 | S | 3/2011 | Taber et al. |
| D634,200 | S | 3/2011 | Taber et al. |
| D646,263 | S | 10/2011 | Yuan et al. |
| 8,105,226 | B2 | 1/2012 | Wada |
| D661,185 | S | 6/2012 | Battat |
| 8,231,020 | B2 | 7/2012 | Taber et al. |
| 8,231,025 | B2 | 7/2012 | Johnson |
| D671,187 | S | 11/2012 | Saringer |
| D672,238 | S | 12/2012 | Aziz et al. |
| D672,241 | S | 12/2012 | Sawicki et al. |
| D679,597 | S | 4/2013 | Tamarindo |
| D682,688 | S | 5/2013 | Murray |
| 8,443,999 | B1 | 5/2013 | Reinders |
| D684,055 | S | 6/2013 | Kwon |
| D684,056 | S | 6/2013 | Kwon |
| D684,057 | S | 6/2013 | Kwon |
| D684,058 | S | 6/2013 | Kwon |
| D686,495 | S | 7/2013 | Murray |
| 8,528,757 | B2 | 9/2013 | Bisio |
| D693,220 | S | 11/2013 | Luo |
| 8,616,394 | B2 | 12/2013 | Kim |
| D705,061 | S | 5/2014 | Jo et al. |
| D710,772 | S | 8/2014 | Maiorana et al. |
| 8,807,361 | B2 | 8/2014 | Luo |
| D712,266 | S | 9/2014 | Römer et al. |
| D712,743 | S | 9/2014 | Neputy et al. |
| D712,744 | S | 9/2014 | Neputy et al. |
| 8,950,939 | B2 | 2/2015 | Last et al. |
| 9,309,032 | B2 * | 4/2016 | Berge ..... B65D 41/3438 |
| D756,777 | S | 5/2016 | Berge et al. |
| 9,533,802 | B2 * | 1/2017 | Berge ..... B65D 47/12 |
| 2004/0200797 | A1 | 10/2004 | Hicks et al. |
| 2004/0245286 | A1 | 12/2004 | Lee |
| 2005/0011911 | A1 | 1/2005 | Vaughan |
| 2005/0040181 | A1 | 2/2005 | Kurosawa et al. |
| 2005/0139607 | A1 | 6/2005 | Kobetsky et al. |
| 2005/0205438 | A1 | 9/2005 | Hierzer et al. |
| 2008/0124432 | A1 | 5/2008 | Ma |
| 2008/0135513 | A1 | 6/2008 | Umenaka |
| 2009/0223963 | A1 | 9/2009 | Bisio |
| 2010/0213213 | A1 | 8/2010 | Albers et al. |
| 2011/0210122 | A1 | 9/2011 | Benoit-Gonin et al. |
| 2012/0211460 | A1 | 8/2012 | Tamarindo |
| 2012/0325769 | A1 | 12/2012 | Essebaggers et al. |
| 2013/0270270 | A1 | 10/2013 | Reinders |
| 2014/0010481 | A1 | 1/2014 | Last et al. |
| 2014/0048536 | A1 | 2/2014 | Bisio |
| 2014/0263475 | A1 | 9/2014 | Totten |
| 2015/0129533 | A1 | 5/2015 | Taber et al. |
| 2015/0232237 | A1 | 8/2015 | Berge |
| 2016/0122095 | A1 | 5/2016 | Berge |

FOREIGN PATENT DOCUMENTS

| | | | |
|---|---|---|---|
| JP | 10-181758 | A | 7/1998 |
| JP | 10-258850 | | 9/1998 |
| JP | 2002-104447 | A | 4/2002 |
| JP | 2011/246128 | | 12/2011 |
| JP | 2014-019447 | | 2/2014 |
| KR | 2002-0024043 | | 3/2002 |
| WO | WO 2008/050361 | A1 | 6/2004 |
| WO | WO 2004/045977 | A1 | 5/2008 |
| WO | WO 2015/123209 | | 8/2015 |
| WO | WO 2016/069311 | | 5/2016 |

OTHER PUBLICATIONS

U.S. Appl. No. 29/564,416, filed May 12, 2016, Berge.

U.S. Appl. No. 29/528,127, filed May 26, 2015, Neputy.

U.S. Appl. No. 29/472,406, filed Nov. 12, 2013, Taber et al.

Images of Spouts and Closures, document believed to be publicly available at least by Aug. 2012, 1 page.

Gualapack System, Image of Spouts and Caps, dated Apr. 1, 2013, at http://www.gualapack.com/img/pagine/prodotti/tappi/1.jpg, believed to be publicly available from Gualapack System at least by Aug. 2012, 1 page.

Gualapack System, Image of first stacked caps, dated Apr. 1, 2013, at http://www.gualapack.com/img/pagine/prodotti/innovazione/1.jpg, believed to be publicly available from Gualapack System at least by Aug. 2012, 1 page.

Gualapack System, Image of second stack caps, dated Apr. 1, 2013, at http://www.gualapack.com/img/pagine/prodotti/innovazione/2.jpg, believed to be publicly available from Gualapack System at least by Aug. 2012, 1 page.

Gualapack System, Image of third stacked caps, dated Apr. 1, 2013, at http://www.gualapack.com/img/pagine/prodotti/innovazione/3.jpg, believed to be publicly available from Gualapack System at least by Aug. 2012, 1 page.

Silgan White Cap, Secure-Spout—9mm Spout with Fitment Brochure, believed to be publically available on Jun. 11, 2014 2014 and representative of closure and spout believed to be publically available on Jun. 11, 2014, 3 pages.

(56) References Cited

OTHER PUBLICATIONS

Flexible Packaging. Silgan White Cap to Introduce Secure-Spout Pouch Technology at Global Pouch Forum. Jun. 1, 2014 [online], [site visited Nov. 18, 2015]. Available from Internet, <URL:http://www.flexpackmag.com/keywords/4416-silgan-white-cap>.
International Search Report and Written Opinion for PCT/US2015/056238, dated Dec. 30, 2015, 11 pages.

* cited by examiner

CLOSURE WITH HINGED TAMPER BAND

BACKGROUND OF THE INVENTION

The present invention relates to a cap and spout assembly for closing a container such as a pouch which holds a material having a liquid or gel-like consistency. In particular, the present invention relates to a child-safe closure with a hinged tamper band. In particular embodiments, the tamper band includes one or more hinges that are configured to increase the resistance required to break the tamper band so as to prevent the tamper band from inadvertently distorting and/or breaking prior to twist-off of the closure from the spout during opening of the container.

SUMMARY OF THE INVENTION

In one embodiment, a tamper evident container closure assembly comprises an outer wall having an inner surface and an outer surface and a central wall supported from and surrounded by the outer wall. The central wall comprises an inner surface, an outer surface, and a spout engagement structure located on the central wall inner surface.

A tamper-indicating band extends downwardly from the central wall. The tamper-indicating band comprises first and second wall sections. Each of the first and second wall sections have a first end and a second end. A frangible connector having clockwise and counterclockwise ends connected to the first end of the first wall section at its clockwise end. The counterclockwise end of the frangible connector is connected to the second end of the second wall section.

At least one engagement element extends inwardly from an inner surface of at least one of the first and second wall sections. The at least one engagement element is configured to interact with a spout to break the tamper-indicating band.

First and second supports are supported between the outer and central walls and each terminate at respective first and second ends proximate an upper portion of the tamper-indicating band. A first hinge joins the first end of the first support to the first end of the first wall section. A second hinge joins the second end of the second support to one of the first end of the second wall section and the second end of the first wall section.

In one embodiment, a tamper evident container closure assembly comprises an outer wall having an inner surface and an outer surface and a central wall supported from and surrounded by the outer wall. The central wall has an inner surface, an outer surface, and a spout engagement structure located on the central wall inner surface.

A tamper-indicating band extends downwardly from the central wall. The tamper-indicating band comprises first and second wall sections. Each of the first and second wall sections has a first end and a second end. A frangible connector has a clockwise facing end attached to the first end of the first wall section. The counterclockwise facing end of the connector is attached to the second end of the second wall section. At least one engagement element extends inwardly from an inner surface of at least one of the first and second wall sections. The at least one engagement element is configured to interact with a spout to break the tamper-indicating band.

A support is supported between the outer and central walls. The support has a lower end terminating proximate an upper portion of the tamper-indicating band. A first hinge joins the support lower end to the first end of the first wall. A second hinge joins the support lower end to the second end of the second wall.

In one embodiment, a tamper evident container closure assembly comprises an outer wall having an inner surface and an outer surface. One or more radial walls extend inwardly from the inner surface of the outer wall. A central wall is supported by the one or more radial walls. The central wall is surrounded by the outer wall. The central wall has an inner surface, an outer surface, and a spout engagement structure located on the central wall inner surface. A passageway is defined between the inner surface of the outer wall and outer surface of the central wall.

A tamper-indicating band extends downwardly from the central wall. The tamper-indicating band comprises first, second, and third wall sections. A first breakable connector is located between the first and second wall sections. A second breakable connector is located between the second and third wall sections. A third breakable connector is located between the third and first wall sections.

First, second, and third supports are each supported between the outer and central walls and terminate proximate an upper portion of the tamper band. A first and second hinge are attached to the first support. The first hinge joins the first support to the first wall section. The second hinge joins the first support to the second wall section. A third and fourth hinge are attached to the second support. The third hinge joins the second support to the second wall section. The fourth hinge joins the second support to the third wall section. A fifth hinge is attached to the third support. The fifth hinge joins the third support to the third wall section.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Figure 1:
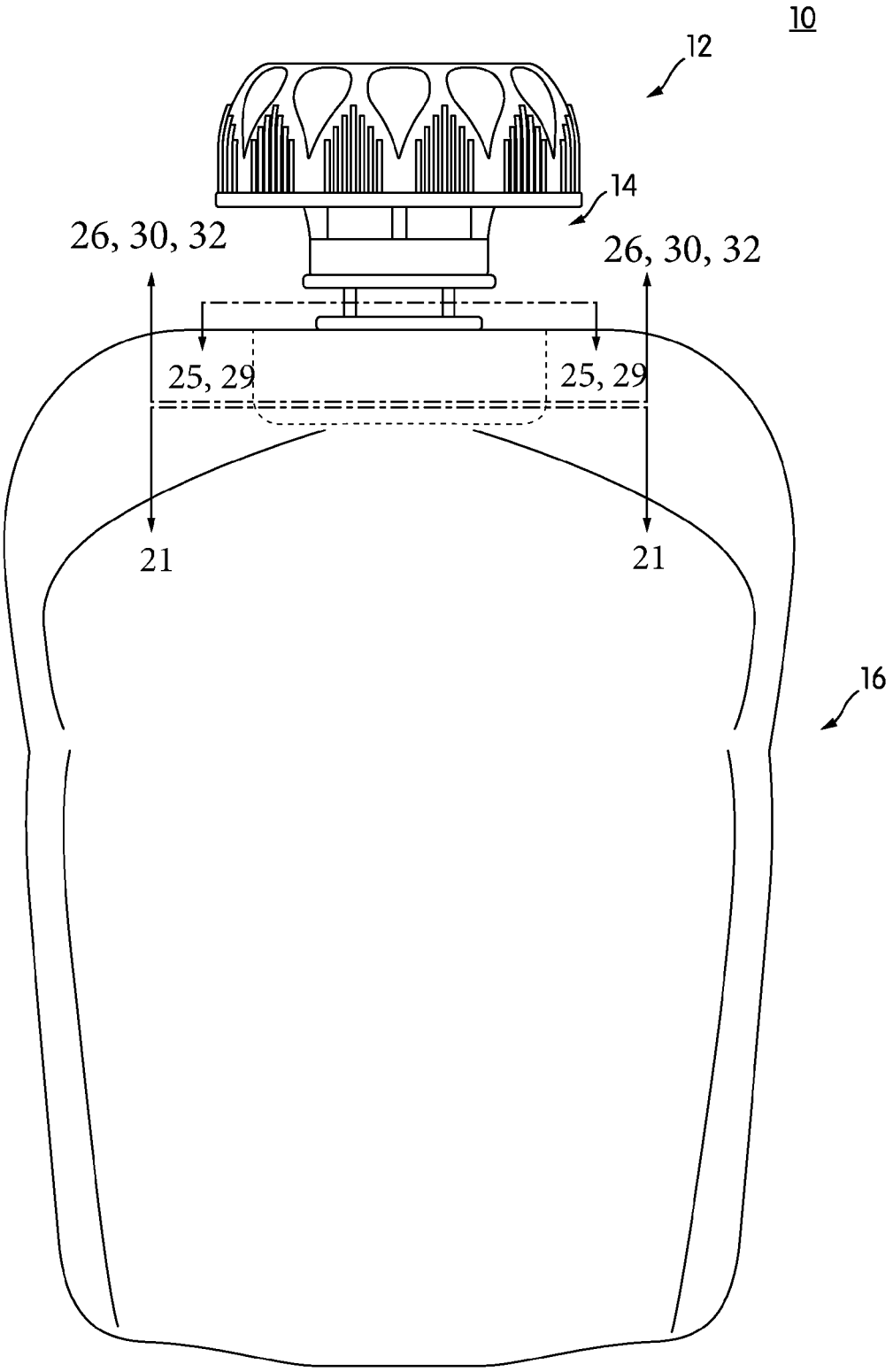
FIG. 1 shows a container assembly including a closure and spout assembly attached to a pouch-type container according to an exemplary embodiment.

Referring generally to the figures, various embodiments of a container assembly including a pouch, closure and related spout are described. In particular embodiments, the tamper band includes one or more hinges that are configured to increase the resistance required to break the tamper band so as to prevent the tamper band from inadvertently distorting and/or breaking prior to twist-off of the closure from the spout during opening of the container. In some embodiments, the spout and/or pouch may include one or more vents that provide for fluid communication between the ambient environment and internal spaces formed between the pouch and the spout to allow for pressure within the internal spaces to equalize with respect to the ambient environment.

In some embodiments, the closure has an inner wall enclosed by an end wall with an internal thread on the inner surface of the inner wall. The inner wall is radially surrounded by an outer sidewall, with a passage between the inner wall and the outer sidewall that allows airflow through the closure. The closure includes a tamper indicating band, also referred to as a tamper band or safety band. The tamper band or safety band is configured to provide a visual indication to the end user that the closure has not been opened since being sealed by the manufacturer.

The tamper band, which in one embodiment is a ring or loop of material located below the end of the inner wall, is attached to the upper portion of the closure with hinge connectors. The tamper band includes an internal surface having an internal rim or rib that interacts with the spout to permanently deform the tamper band upon removal of the closure by a user. Specifically, upon movement of the closure relative to the spout, the elements of the tamper band engage with the elements of the spout, and further movement of the closure causes frangible connectors that connect wall sections of tamper band to break. As a result, the tamper band is broken and displaced, providing visual indication to a user that the closure is opened. At the same time, the hinged connection between the tamper band and the upper portion keep the broken tamper band secured to the closure.

In addition, the closure and the tamper band discussed herein may be particularly suitable for containers, for example food or drink containers, intended for use by children. For example, because the tamper band remains attached to the closure after the container is opened, the likelihood that the tamper band is accidentally swallowed by a user may be reduced. For example, because the tamper band is removed along with the removal of the closure, it does not remain near the opening of the container where a user may place their mouth. In addition, in contrast to many single walled closures, the closure embodiments discussed herein include inner and outer walls separated by a space that allows passage of air through the closure. This configuration may allow a user to breathe and seek medical attention if the closure becomes lodged in the airway of a user. Furthermore, because in some embodiments the wall sections of the tamper band are attached at both ends to the upper portion of the closure by hinges located at each end of the wall section, the radially outward movement of the wall sections after the tamper band has been broken is relatively constrained. As such, in the event the closure is swallowed by a user, the broken, free ends of the tamper band are less likely to damage or pierce the airway of the user.

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

FIG. 1 shows a container assembly 10 according to one embodiment. Container assembly 10 includes a container, shown as pouch 16 and a closure assembly, including a closure 12 and a spout 14. Spout 14 is coupled to pouch 16. In general, pouch 16 includes container contents, such as liquid, semi-liquid, or powdered food or beverage, within pouch 16, and spout 14 provides a channel through which the contents of pouch 16 can be accessed. In the embodiment shown, pouch 16 is a flexible, squeezable type of container, which may be formed from a flexible material. In various embodiments, the flexible material may be a material such as a thermoplastic sheet or a foil pouch. In other embodiments, closure 12 and spout 14 may be used in conjunction with other types of containers, such as plastic bottles or composite (paper, cardboard, etc.) boxes, or pouches fabricated from suitable laminated materials. In specific embodiments, the contents of pouch 16 may be food or beverage intended for consumption by a child, such as baby food, yogurt, apple sauce, etc.

The spout 14 may be assembled with the closure 12 before attachment of the spout 14 and closure 12 assembly to a pouch 16 that has been prefilled with contents. Alternatively, the spout 14 may be inserted into an empty pouch 16 that is then filled with contents through the spout 14, after which the closure 12 is added to the spout 14.

As shown in FIG. 1, spout 14 is coupled to pouch 16 adjacent to the upper end of pouch 16. In this arrangement, spout 14 protrudes from the upper end of pouch 16, and closure 12 acts to seal spout 14. As will be generally understood, the lower end of pouch 16 may provide an end wall or rim providing a stable base for pouch 16 to sit in the upright position shown in FIG. 1.

Figure 2:
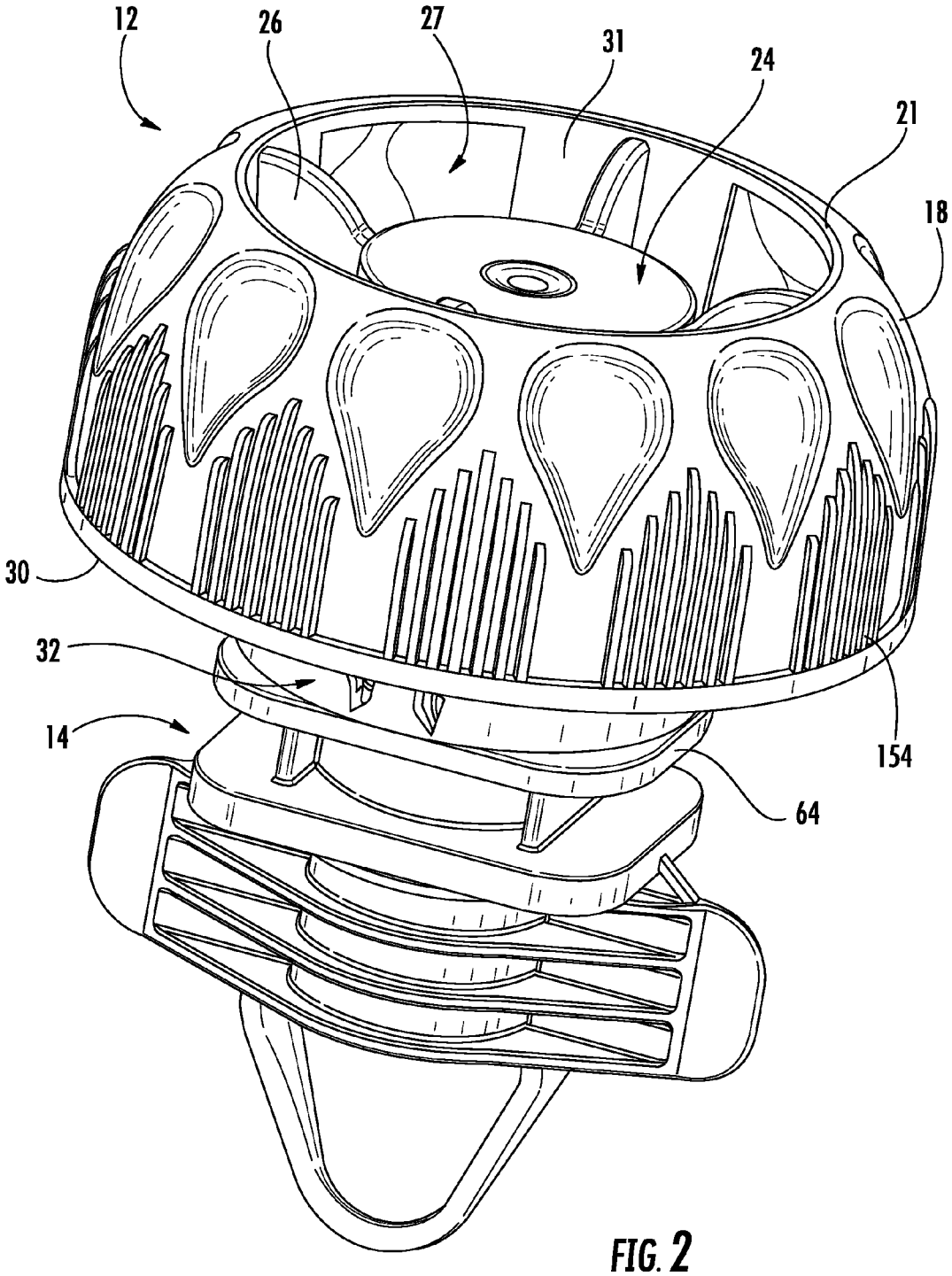
FIG. 2 is a perspective view of the closure assembly including a closure and a spout according to an exemplary embodiment.

FIG. 2 shows closure 12 coupled to an upper spout portion of spout 14. In various embodiments, closure 12 includes threads 58 that engage cooperating threads 59 on an outer surface of the upper spout 14 portion. Closure 12 includes an outer wall 18, with an interior upper edge 21 that defines a top opening. As shown in FIG. 2, outer wall 18 may include a textured design 154 molded into the exterior surface of the outer wall 18 that facilitates gripping by a user. In other embodiments, the textured design 154 may be etched, printed, or adhered to the outer wall 18. The pattern of the textured design 154 may vary in size, complexity, symmetry, or distribution. Alternatively, the outer wall 18 may be formed without a textured design 154.

Closure 12 includes a central wall portion, shown as central cylinder 24, that is coupled to an inner surface of outer wall 18 by radial walls 26 such that open spaces or channels 27 are defined within closure 12. Channels 27 extend vertically through closure 12 from interior upper edge 21 to lower edge 30 such that airflow is permitted through closure 12. As such, if the closure 12 is accidently swallowed by a user, air may flow through channels 27, allowing the user to breathe.

In one embodiment, radial walls 26 are monolithically and integrally formed with the inner surface of outer wall 18. In alternate embodiments, the radial wall 26 is formed independently and subsequently attached to the inner surface of outer wall 18. Although the embodiment shown include four radial walls 26, closure 12 may include a different number of radial walls 26 as may be appropriate based on the material of the closure, the dimensions of the closure, and the intended use of the container.

Figure 3A:
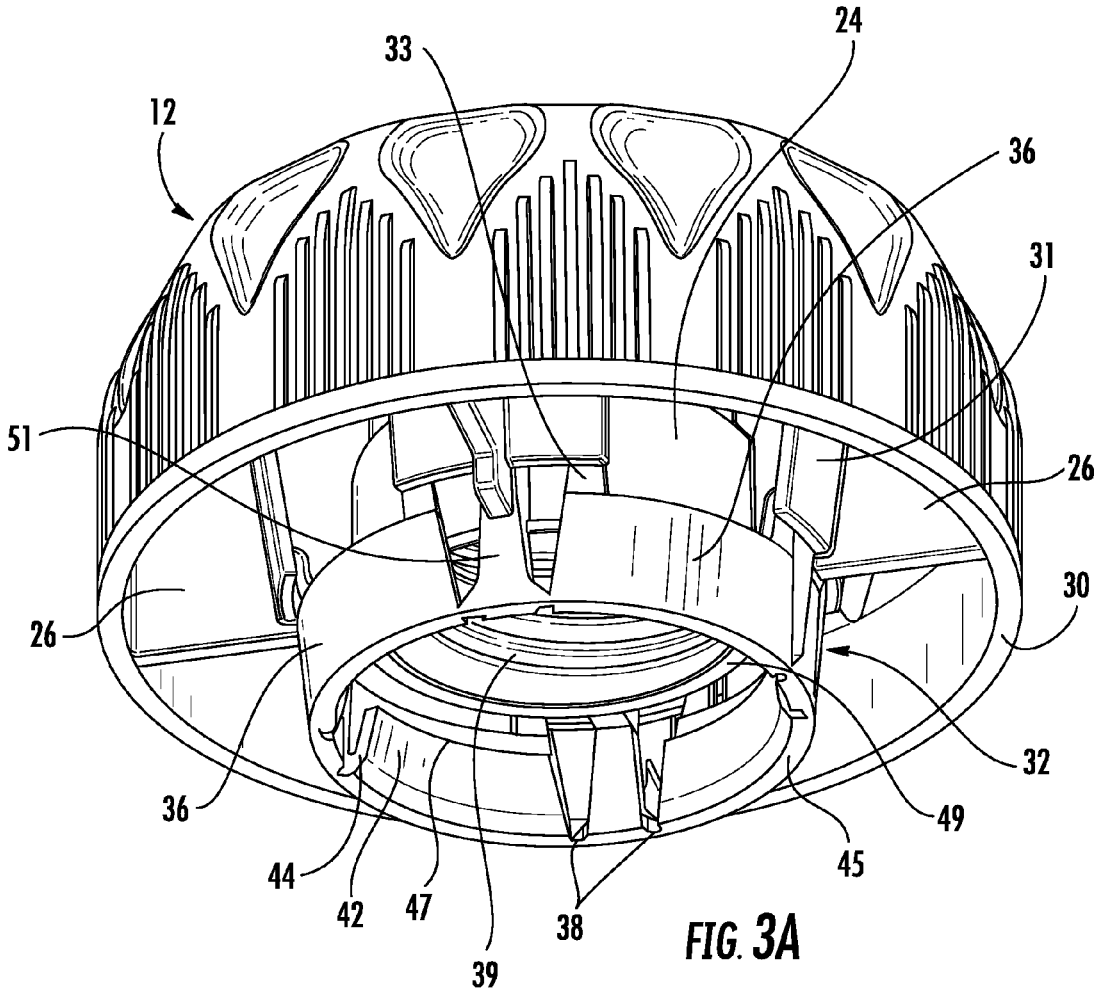
FIG. 3A is a perspective view of the closure according to an exemplary embodiment.
Figure 3B:
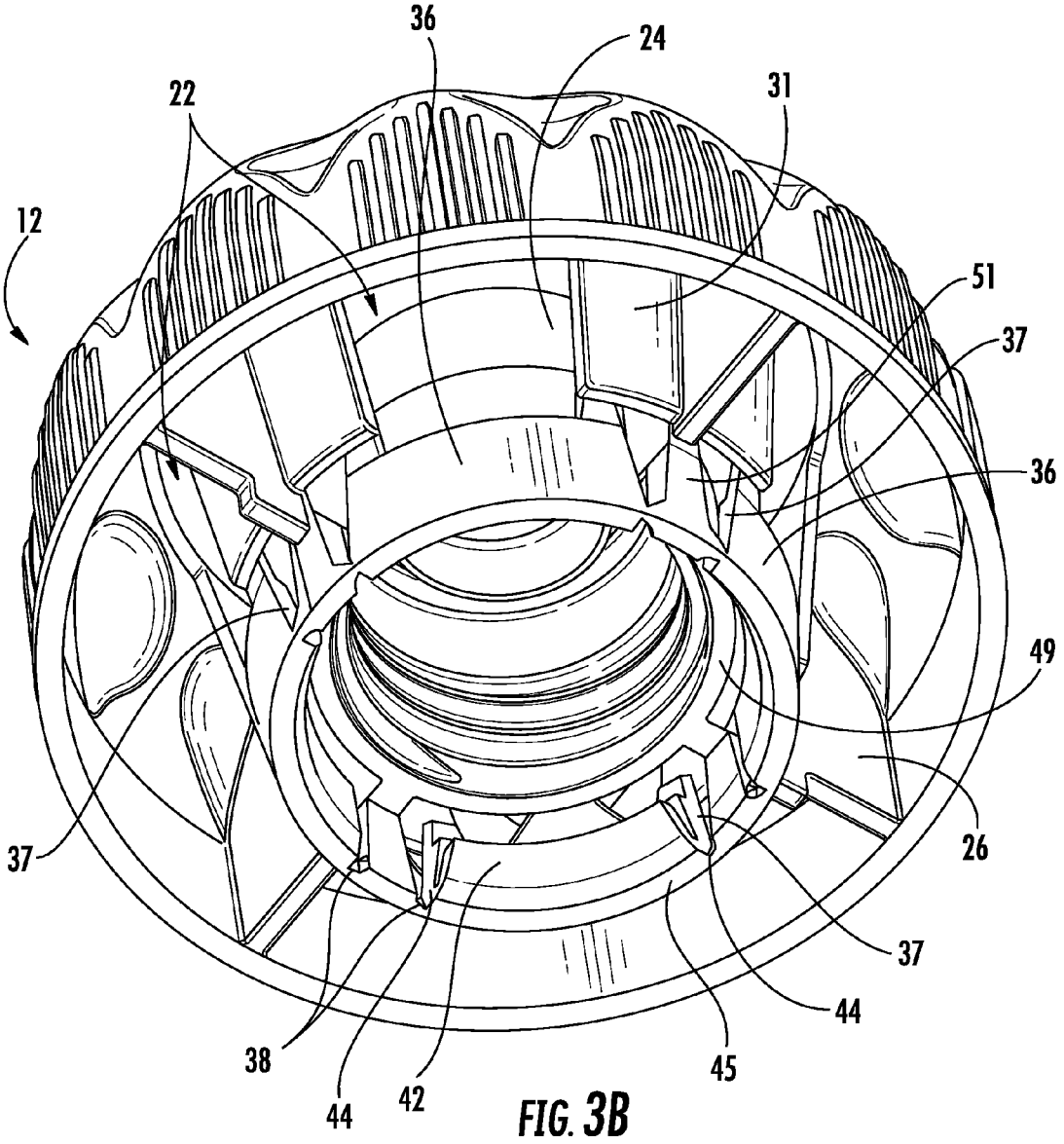
FIG. 3B is a bottom perspective view of the closure of FIG. 3A according to an exemplary embodiment.
Figure 3C:
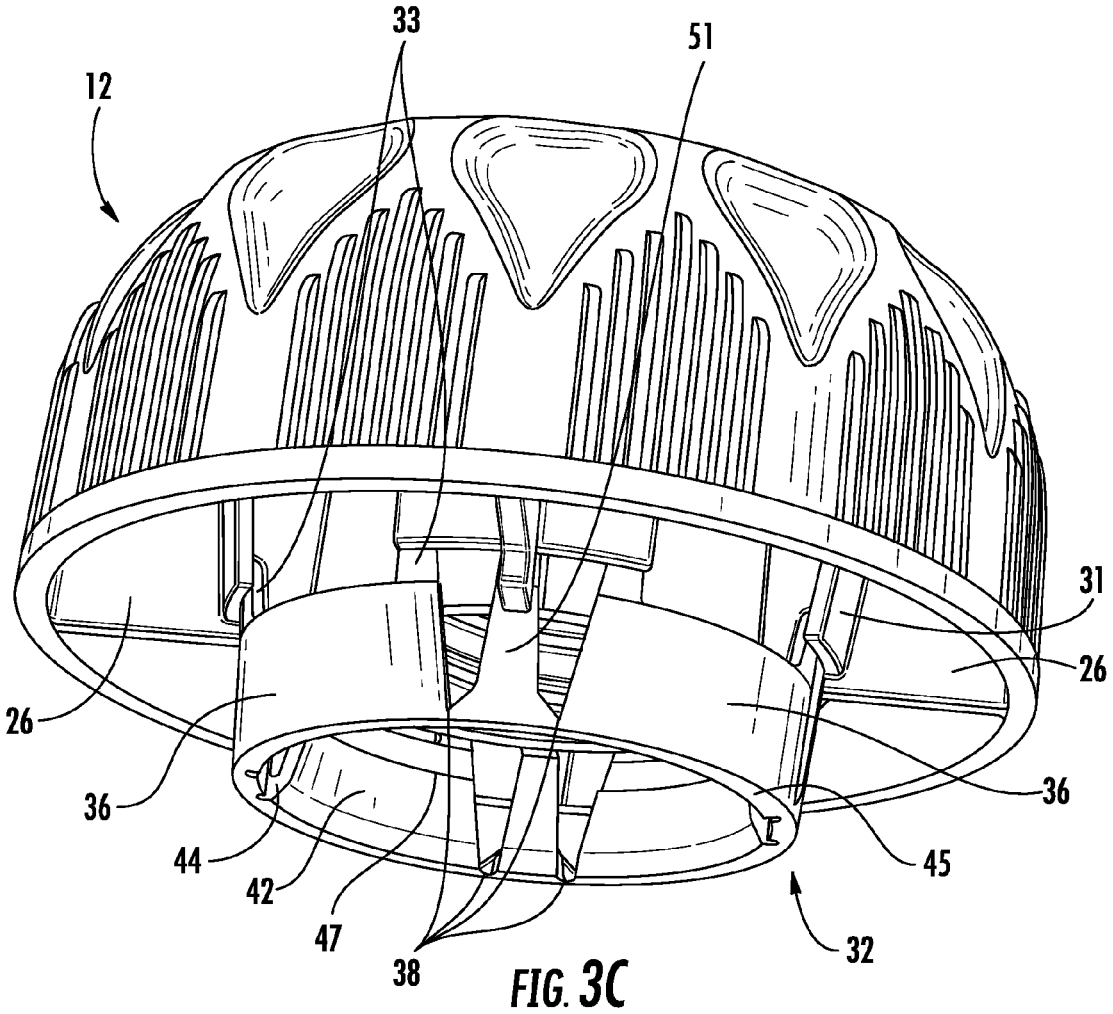
FIG. 3C is another perspective view of the closure of FIG. 3A according to an exemplary embodiment.

Referring to FIGS. 3A-3C, a closure 12 according to one embodiment includes a tamper band 32 including wall sections 36 extending from the lower end of central cylinder 24. A pair of frangible bridge sections 38 is located between ends 37 of adjacent tamper band wall sections 36. Located on the inner surface of wall sections 36 is an engagement structure or wall, shown as J-band sections 42, that extends radially inward away from inner surfaces of wall sections 36 and upward toward the upper end of closure 12.

In the embodiment shown, J-band sections 42 are sections that are integrally molded with the rest of tamper band 32 and are connected to the lower end 45 of tamper band 32. In one embodiment, J-band sections 42 are molded in the positioning shown in FIGS. 3A-3C with a connector, shown as u-shaped curved connector section 44, molded in the u-shape shown in FIGS. 3A-3C. In another embodiment, J-band sections 42 are molded extending downward from lower end 45, and following molding, J-band sections 42 are folded upward and inward relative to tamper band 32 forming u-shaped connector section 44. In either molding arrangement, connector section 44 provides the transition from the generally downwardly extending wall section 36 to the generally upwardly extending J-band sections 42.

J-band sections 42 are angled radially inwards relative to wall sections 36. Further, J-band sections 42 each have an upper edge or surface 47 that defines the uppermost surface of each J-band section 42. J-band sections 42 have a height (e.g., the dimension in the direction of the longitudinal axis of the closure) that is less than the heights of wall sections 36. In this arrangement, the upper surface 47 of each J-band section 42 is below both the upper portion 35 of wall section 36, and below the lower most edge 49 of central cylinder 24. Further, as shown in FIGS. 3A-3C, wall sections 36 have a length in the circumferential direction that is equal to or greater than the length of J-band sections 42 in the circumferential direction. In various embodiments, the angular length of wall sections 36 in the circumferential direction is greater than the angular length of J-band sections 42 in the circumferential direction.

As shown in FIGS. 3A-3C, tamper band 32 includes tamper band posts, shown as post sections 51. Post sections 51 are located in the circumferential direction between ends 37 of tamper band wall sections 36. Post sections 51 provide a structure that bridge sections 38 are coupled to. In this arrangement, the clockwise and counterclockwise facing surfaces of post sections 51 and the opposing, clockwise and counterclockwise facing ends 37 of the adjacent wall sections 36 define spaces or gaps as shown in FIGS. 3A-3C. To further provide structure to tamper band 32, post sections 51 are located below one of the radial walls 26. By providing a relatively robust, rigid and supported anchor point, this positioning of post sections 51 may facilitate consistent breakage of tamper band 32 at bridges 38 upon removal of closure 12 from spout 14 because of the relative low level of bend or distortion experienced by post sections 51 at twist off. In this arrangement, bridge sections 38 are coupled between opposing clockwise and counterclockwise surfaces of post sections 51 and of wall sections 36.

In addition to post sections 51, which initially couple the tamper band 32 to the upper portion of closure 12, tamper band 32 is also connected to the upper portion of closure 12 by hinges 33. As shown in FIGS. 3A-3C, closure 12 includes hinge support walls 31 that extend radially inwardly from the interior upper edge 21 of the closure 12 to a location proximate the upper end 43 of the tamper band 32. As shown in FIG. 3B, in one embodiment, the hinge support walls 31 are circumferentially spaced about the closure 12 such that hinge support walls 31 are bisected by, or bisect, the radial walls 26 which also extend radially inwardly from the interior upper edge 21 of the closure. In some embodiments hinge support walls 31 do not extend from and are not directly attached to upper edge 21. Instead, the support walls 31 may be supported entirely by and extending generally perpendicularly from radial walls 26.

Located at the lower edge of each hinge support wall 31 is a pair of hinges 33 that extend from the lower edge of hinge support wall 31 to the upper portion 35 of wall sections 36. As shown in FIGS. 3A-3C, hinges 33 are spaced at opposite sides of the lower edge of hinge support walls 31 and hinges 33 extend downwardly to tamper band 32 such that a first hinge 33*a* of a pair of hinges located on a hinge support wall 31 is positioned above end 37 of a first wall section 36, and the second hinge 33*b* of the pair of hinges is positioned above end 37 of an opposing adjacent wall section 36.

Along with post sections 51, the attachment of hinges 33 at opposing ends 37 of adjacent wall sections 36 along the tamper band 32 is configured to provide an additional structured and supported attachment of tamper band 32 to the upper portion closure 12. Specifically, this attachment of hinges 33 to tamper band 32 at locations generally situated above bridge pairs 38 and the positioning of each hinge 33*a*, 33*b* of a pair of hinges 33 on opposing sides of a post sections 51 is configured to increase the resistance required to break or otherwise distort the bridges 38, and thereby prevent inadvertent or accidental breakage of the tamper band 32. Additionally, by increasing this resistance, molding of the closure 12 is facilitated.

Figure 4:
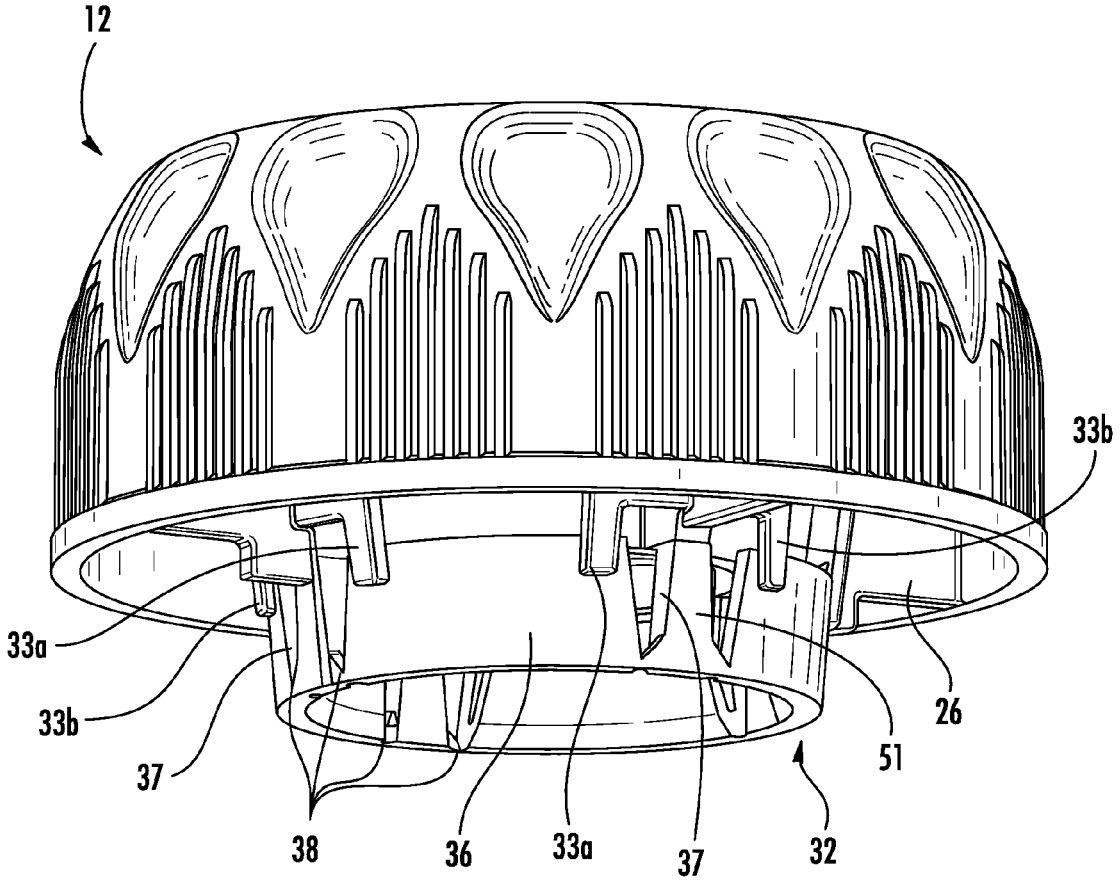
FIG. 4 a is perspective view of a closure according to an exemplary embodiment.
Figure 5:
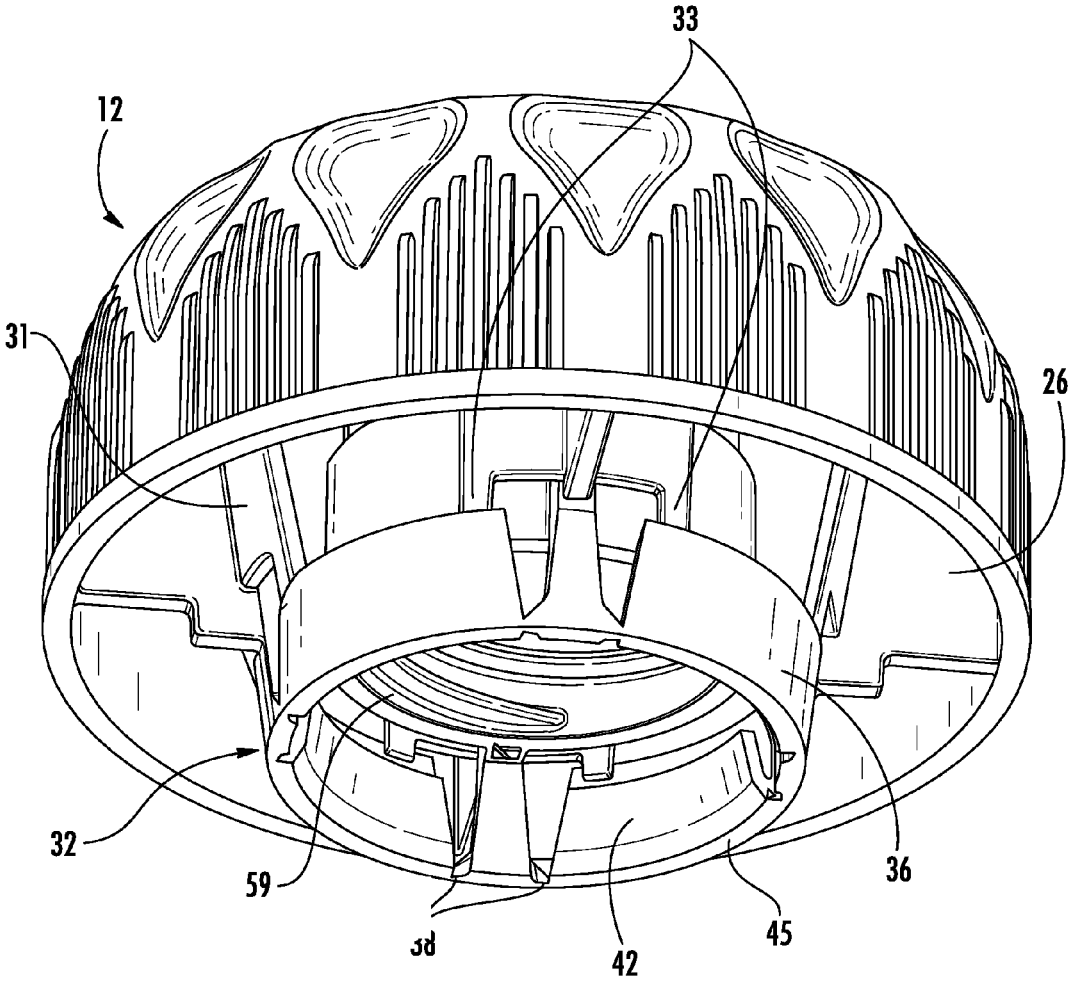
FIG. 5 is perspective view of a closure according to an exemplary embodiment.

As shown in FIGS. 3A-3C, hinges 33 may be attached to tamper band 32 along the upper edge of the upper portion 35 of wall sections 36. In other embodiments, such as shown in FIG. 4, hinges 33 may be joined to tamper band 32 at the outer surfaces of wall sections 36. In other embodiments, such as seen in FIG. 5, hinges may be connected to the tamper band 32 at the inner surfaces of wall sections 36. Hinges 33 may be attached at their upper ends to hinge support walls 31 by extending directly from the lower edge of hinge support walls 31. Alternatively in some embodiments the upper ends of hinges 33 may be attached to either the inner or outer surfaces of the hinge support walls 31.

In some embodiments, the entire closure 12 may be monolithically formed, (e.g. by injection molding) as a single, unitary structure. In other embodiments, various components of closure 12 may initially be formed separately and may be subsequently connected together. In one embodiment, hinges 33 may be monolithically formed with hinge support walls 31 and subsequently attached to tamper band 32. In one embodiment, hinges 33 may be monolithically formed with tamper band 32 and subsequently be attached to hinge support walls 31.

In various embodiments, wall sections 36 each extend at least 120 degrees around the perimeter of central cylinder 24, specifically at least 150 degrees around the perimeter of central cylinder 24, and more specifically at least 160 degrees around the perimeter of central cylinder 24.

Figure 6:
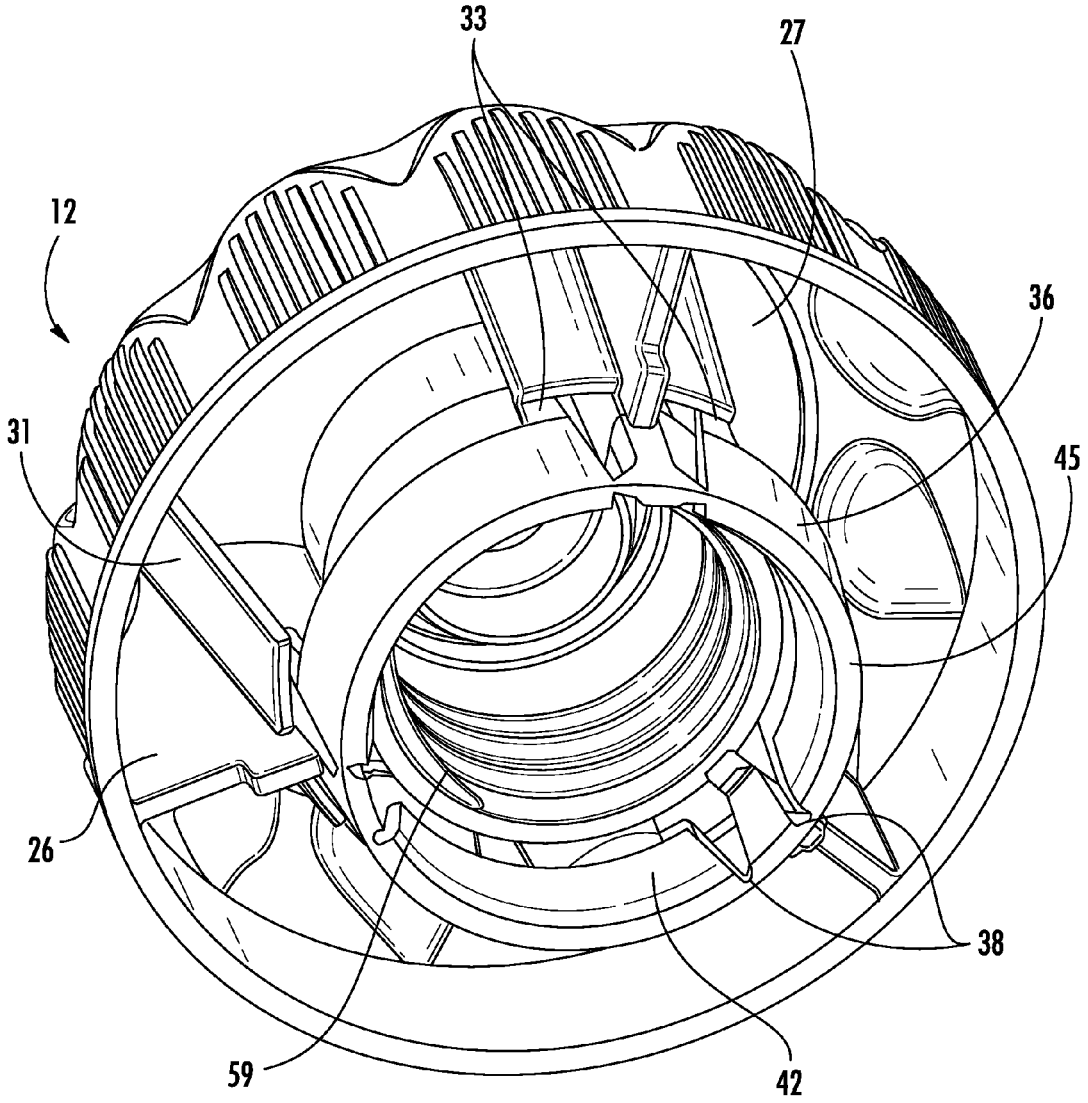
FIG. 6 is a bottom perspective view of a closure according to an exemplary embodiment.

In various embodiments, wall sections 36 are configured to provide a relatively compete band surrounding the base of central cylinder 24. In the embodiment shown in FIGS. 3A-3C, tamper band 32 includes four wall sections 36. However, tamper band 32 may include any number of wall sections 36 that are connected to adjacent wall sections 36 by a pair of bridge sections 38. As shown in FIG. 6, in one embodiment tamper band 32 includes three wall sections 36. In another embodiment, illustrated in FIGS. 7A and 7B, tamper band 32 may include two wall sections 36.

In some embodiments, as illustrated for example in FIGS. 3A-3C, the number of hinge support walls 31 and the number of pairs of hinges 33 equals the number of pairs of bridge sections 38. In other embodiments, the number of hinge support walls 31 and the number of pairs of hinges 33 may be more or may be less than the number of pairs of bridge sections 38.

Figure 7A:
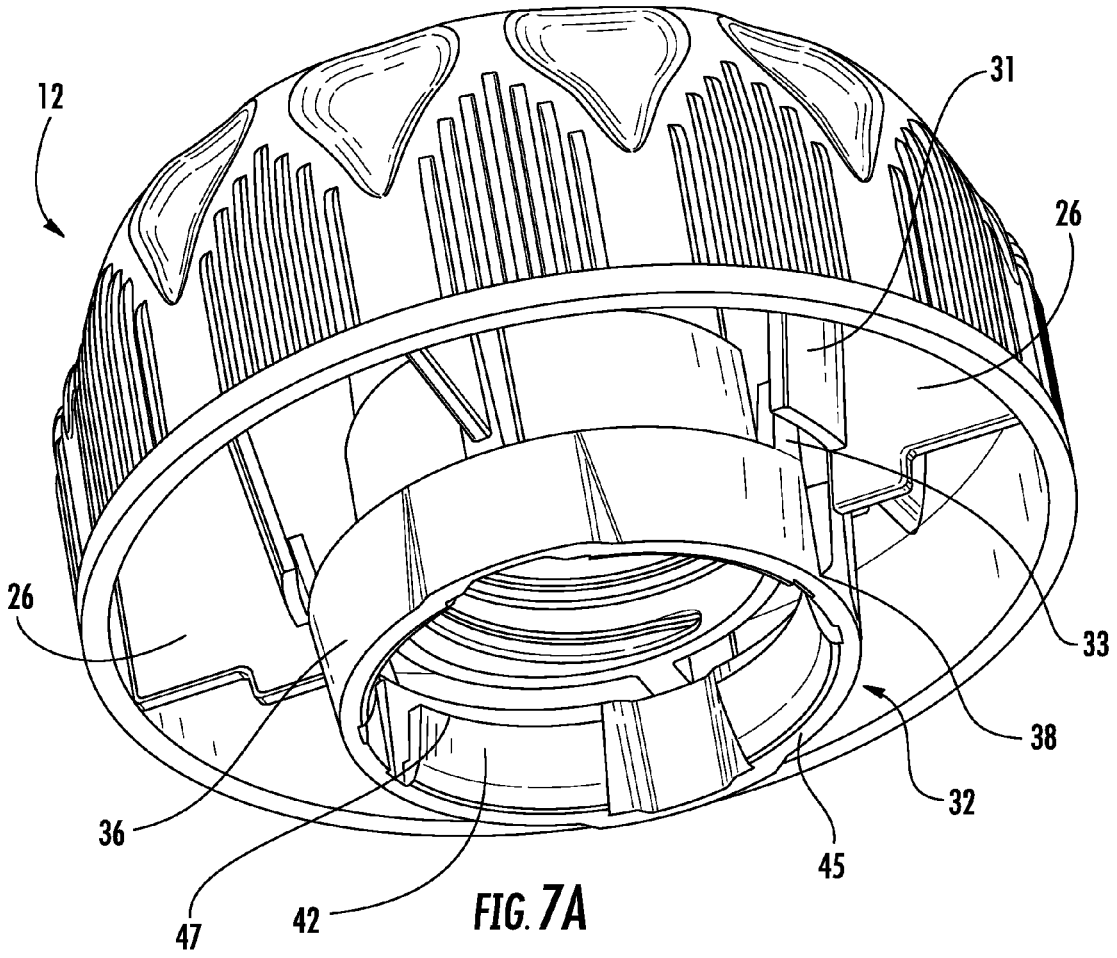
FIG. 7A is a perspective view of a closure according to an exemplary embodiment.
Figure 7B:
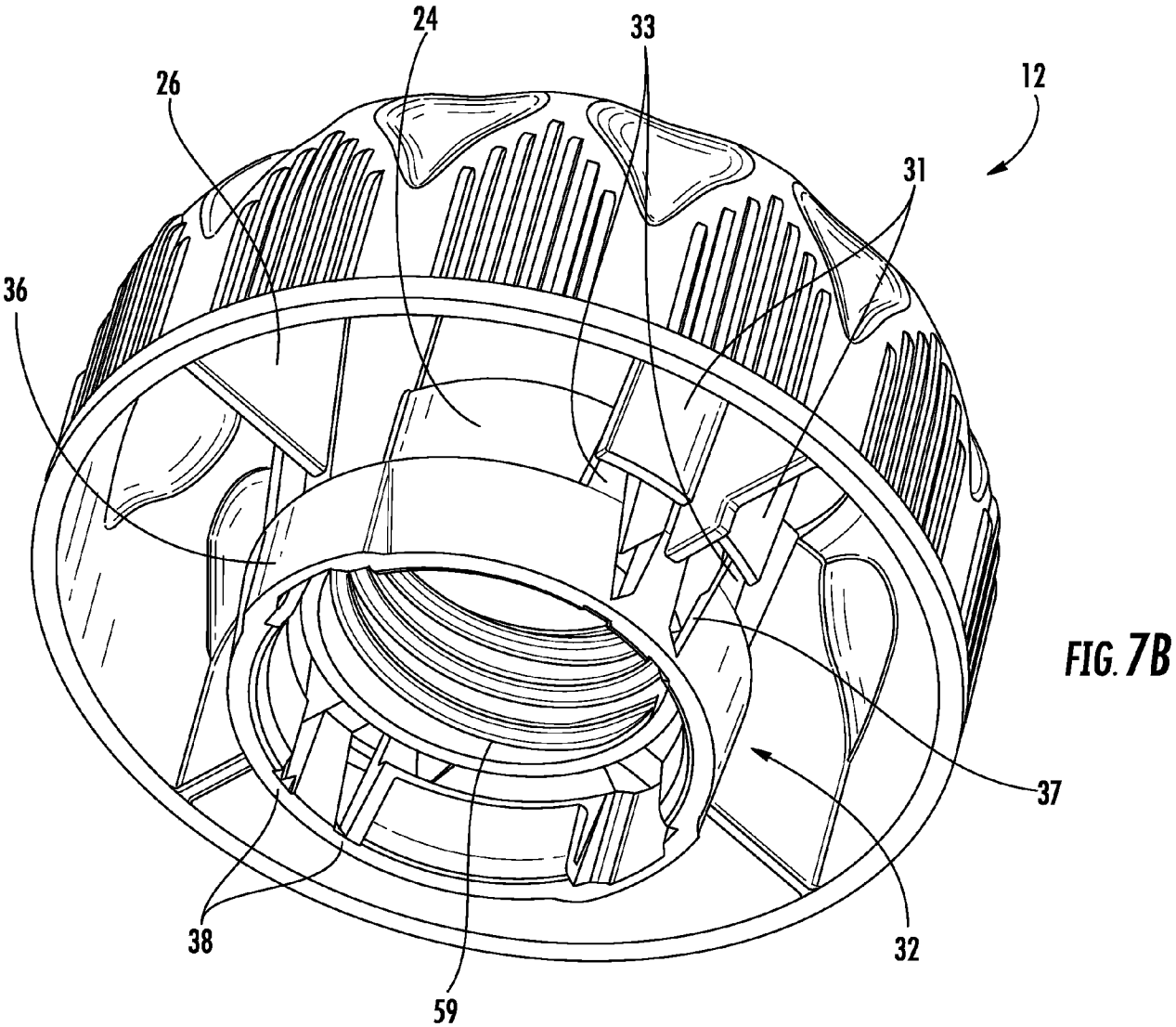
FIG. 7B is a bottom perspective view of the closure of FIG. 7A according to an exemplary embodiment.
Figure 8:
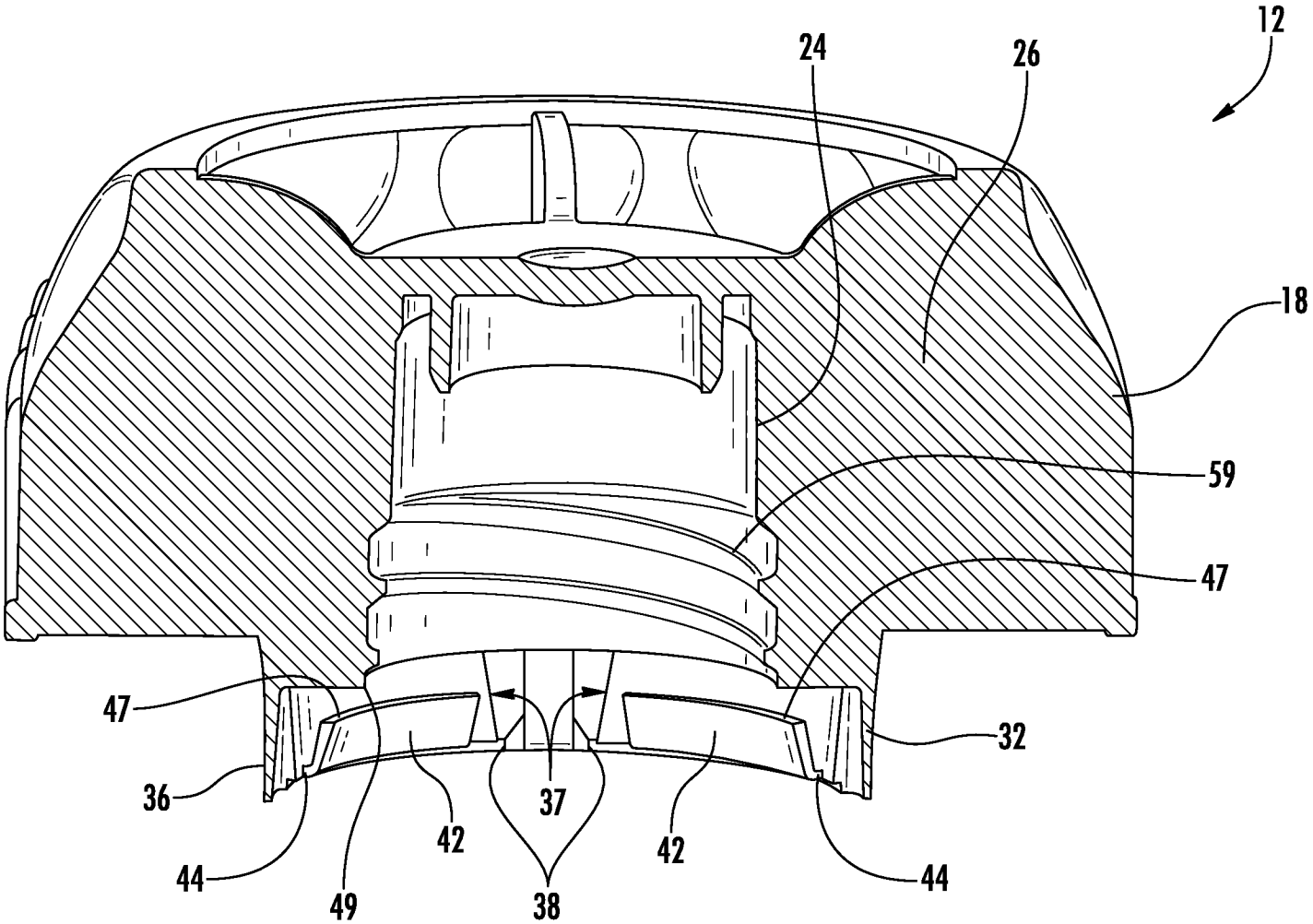
FIG. 8 is a perspective view of a section of the closure of FIG. 3A according to an exemplary embodiment.

FIG. 8 shows approximately one half of closure 12 of the embodiment illustrated FIGS. 3A-3C in cross-section. As shown in FIG. 8, each section of each of the tamper band wall sections 36 includes one J-band section 42. Thus, in the embodiment of closure 12 shown in FIGS. 3A-3C, tamper band 32 includes a total of four J-band sections 42 and a total of four wall sections 36. However, in other embodiments, wall sections 36 may include more than one J-band section 42 (for example as shown in the embodiment of FIGS. 7A and 7B). Alternatively, in other embodiments not every wall section 36 includes a J-band section 42. As such, the tamper band 32 may include various numbers of J-band sections 42, such as 2, 3, 5, 6, etc. J-band sections.

Figure 9:
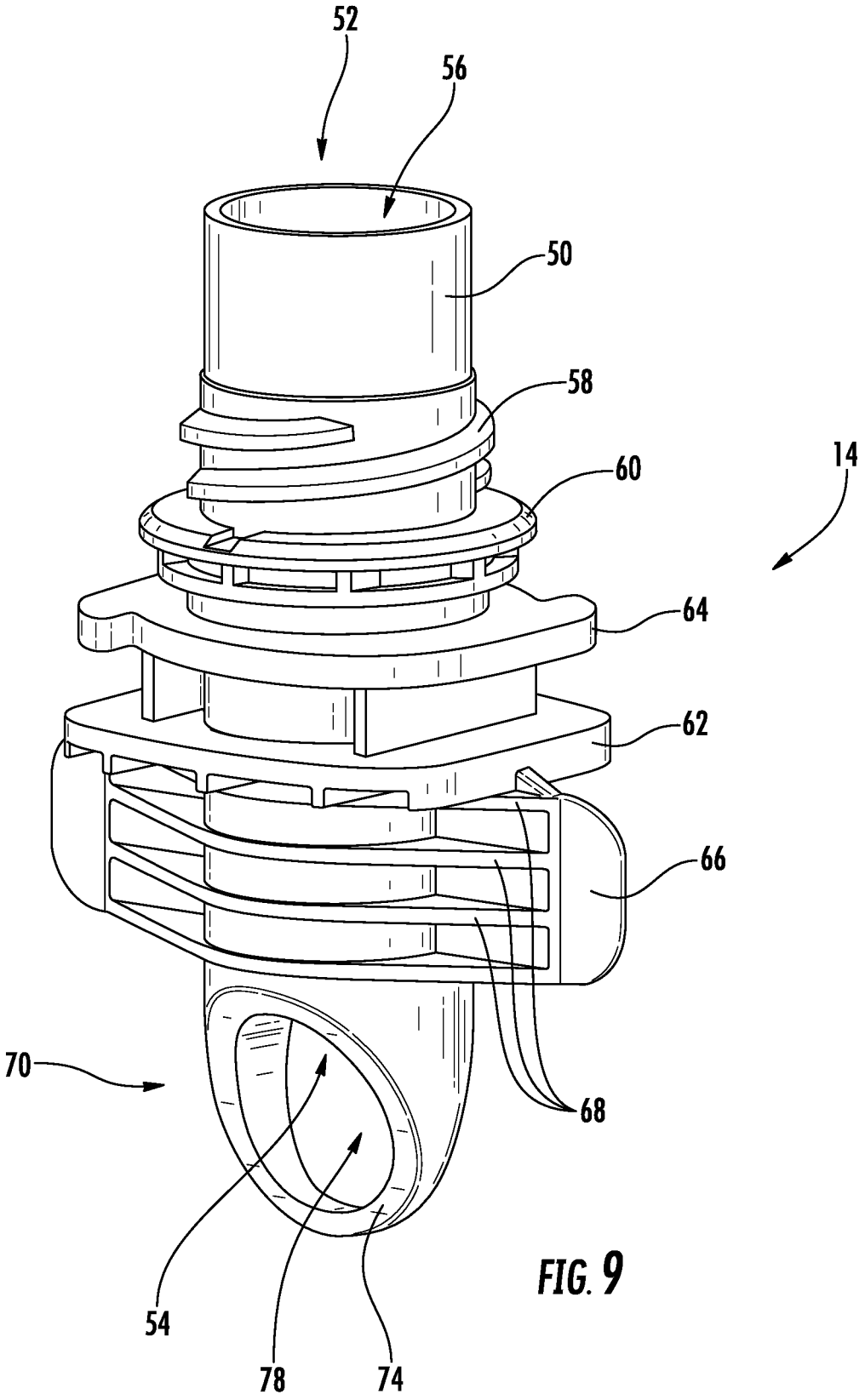
FIG. 9 is a perspective view from above of a spout of FIG. 2 according to an exemplary embodiment.

Referring to FIG. 9, a perspective view of spout 14 is shown according to an exemplary embodiment. Spout 14 includes an upper spout portion 50 that defines a central channel 52 that extends through spout 14 from an input or inlet opening 54 and an output or outlet opening 56. In general, central channel 52 provides a pathway from the interior of a container (such as pouch 16) to the exterior of the container through which container contents can be accessed and removed. Upper spout portion 50 includes a closure engagement structure, shown as threads 58, that engage cooperating threads 59 (shown in FIG. 3B) on the inner surface of central cylinder 24 of closure 12.

Spout 14 includes an upper flange 60 located below threads 58. Spout 14 includes a lower flange 62 and a central flange 64. Located below lower flange 62 is a generally trapezoidal shaped mounting area 66 that includes a plurality of horizontal ribs 68. Mounting area 66 and ribs 68 are bonded to the inner surface of the container sidewalls (e.g., sidewalls of pouch 16) such that spout 14 is supported from the container as shown in FIG. 1.

Figure 10:
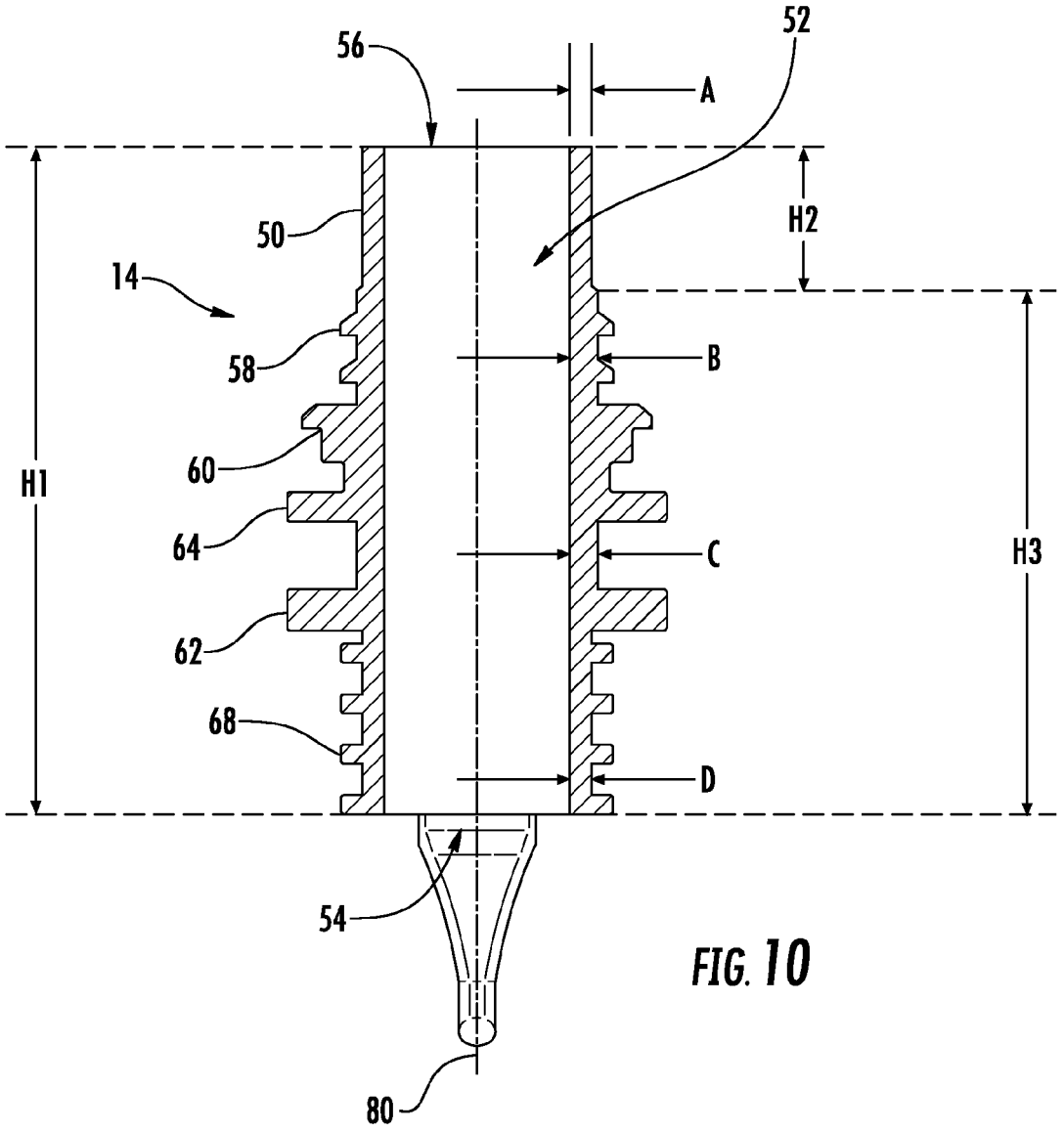
FIG. 10 is a cross-sectional view of the spout of FIG. 9 according to an exemplary embodiment.

Referring to FIG. 10, in various embodiments, spout 14 is molded from plastic and has thicknesses along the length of spout 14 that facilitates accurate molding of spout 14. As shown in FIG. 10, upper spout portion 50 has a thickness A and a height H2. In various embodiments, upper spout portion 50 has a thickness A between 0.025 inches and 0.040 inches, specifically between 0.028 inches and 0.032 inches, and more specifically about 0.030 inches (e.g., plus or minus 0.005 inches). In various embodiments, spout 14 has a total height H1, and H2 is less than 30% of H1 and more specifically is less than 25% of H1. In addition, spout 14 has a thickness B located between threads 58, and in various embodiments, thickness B is between 0.035 inches and 0.045 inches, specifically between 0.038 inches and 0.042 inches, and more specifically about 0.040 inches (e.g., plus or minus 0.005 inches). Spout 14 has a thickness C located between flanges 62 and 64, and in various embodiments, thickness C is between 0.038 inches and 0.048 inches, specifically between 0.041 inches and 0.045 inches, and more specifically about 0.043 inches (e.g., plus or minus 0.005 inches). Spout 14 has a thickness D located between ribs 68, and in various embodiments, thickness D is between 0.038 inches and 0.048 inches, specifically between 0.041 inches and 0.045 inches, and more specifically about 0.043 inches (e.g., plus or minus 0.005 inches). In various embodiments, the areas having thicknesses B, C and D have a height shown as H3, and in various embodiments, H3 is greater than 60% of H1, and more specifically greater than 70% of H1.

Figure 11:
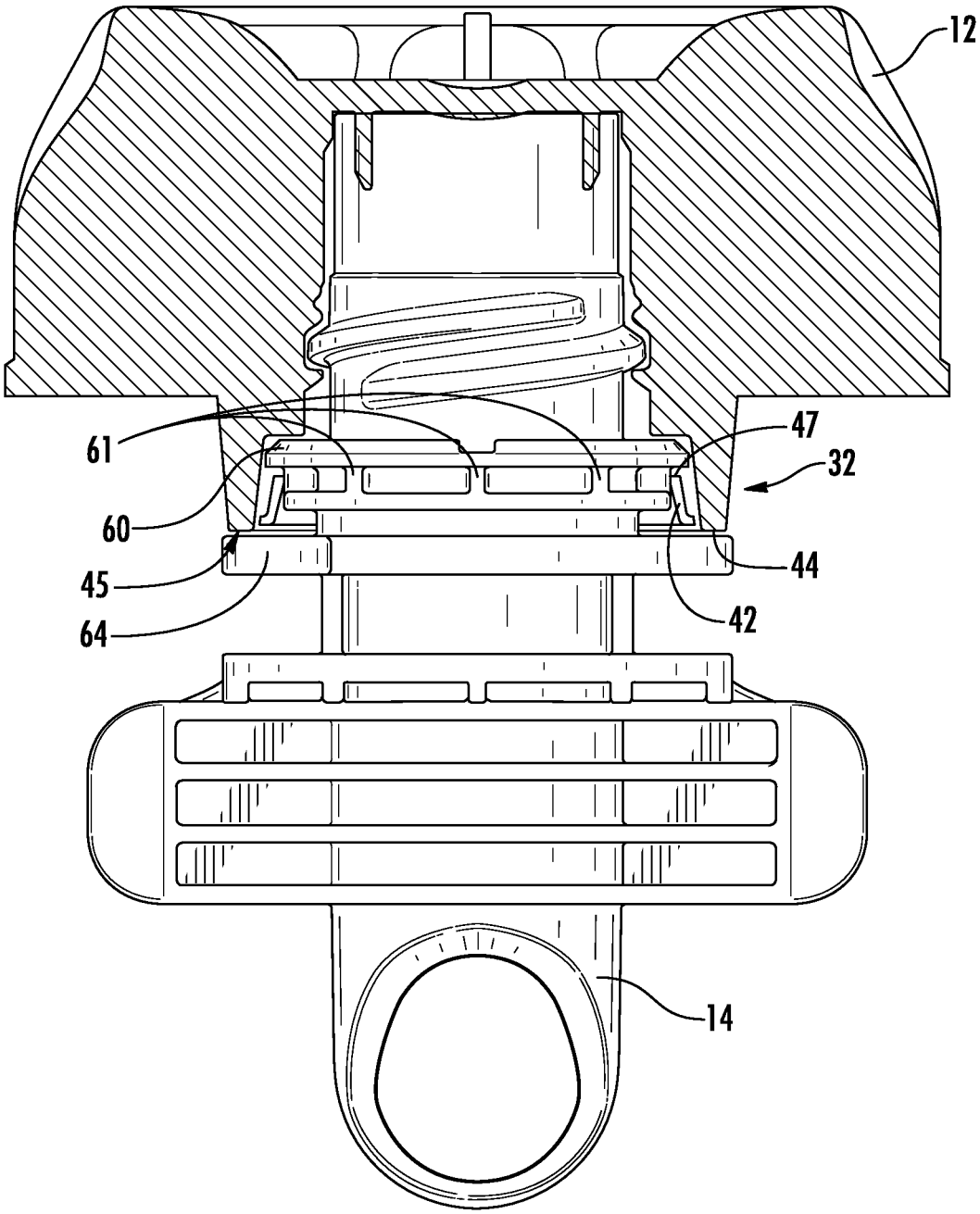
FIG. 11 is a cross-sectional view of the closure of FIG. 3A coupled to the spout of FIG. 9 according to an exemplary embodiment.

Referring to FIG. 11, a cross sectional view of closure 12 coupled to spout 14 is shown. As shown in FIG. 11, when closure 12 is fully engaged on spout 14, J-band sections 42 are engaged underneath flange 60. In this arrangement, lower end 45 of tamper band 32 is facing flange 64 and there is a small amount of clearance between the lower most surface of tamper band 32 and the upper surface of flange 64. Further, J-band sections 42 are positioned such that upper surfaces 47 of each J-band are facing and located beneath flange 60.

Figure 12:
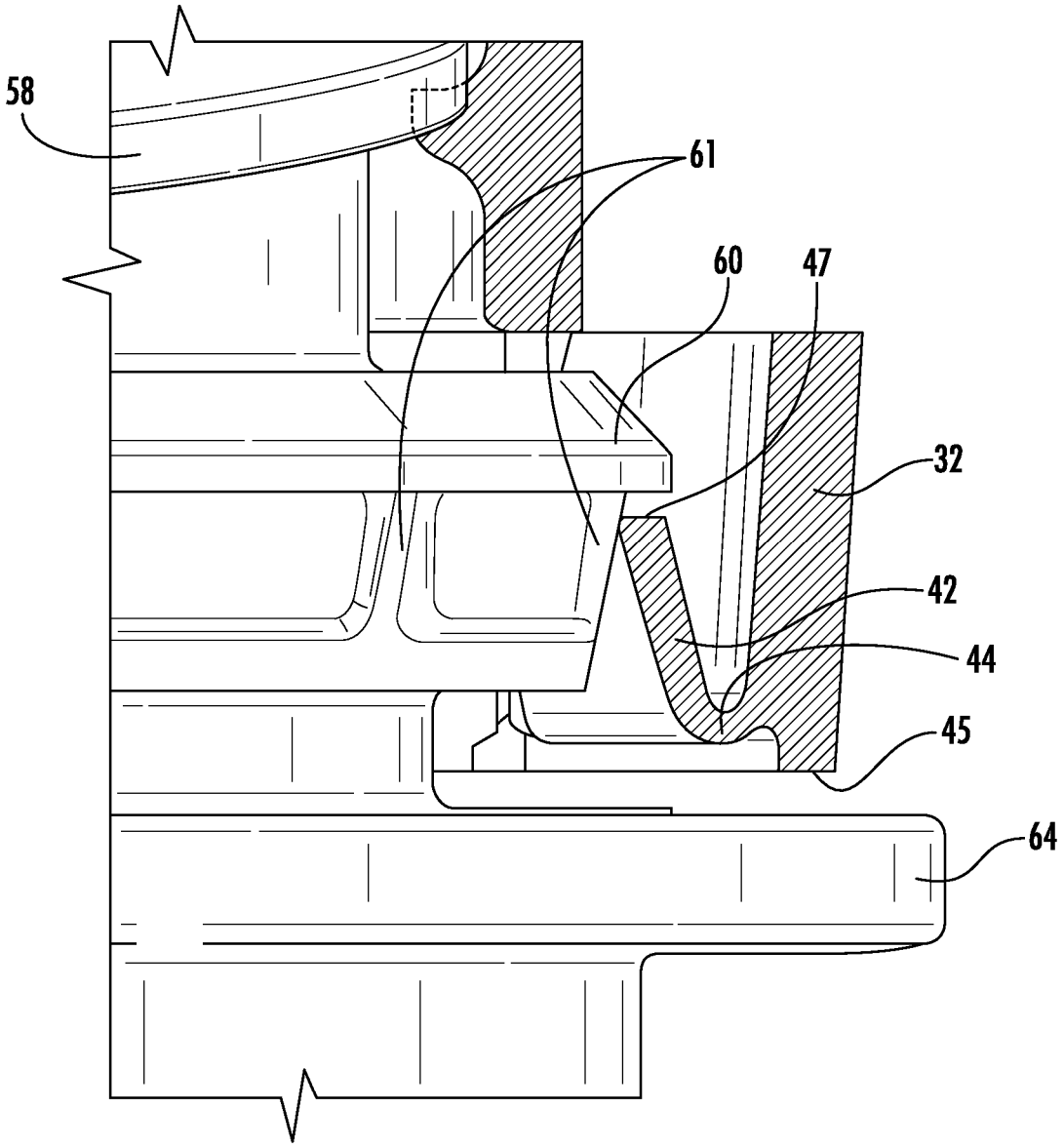
FIG. 12 is a detailed view showing the interaction between a spout and a tamper band according to an exemplary embodiment.
Figure 13:
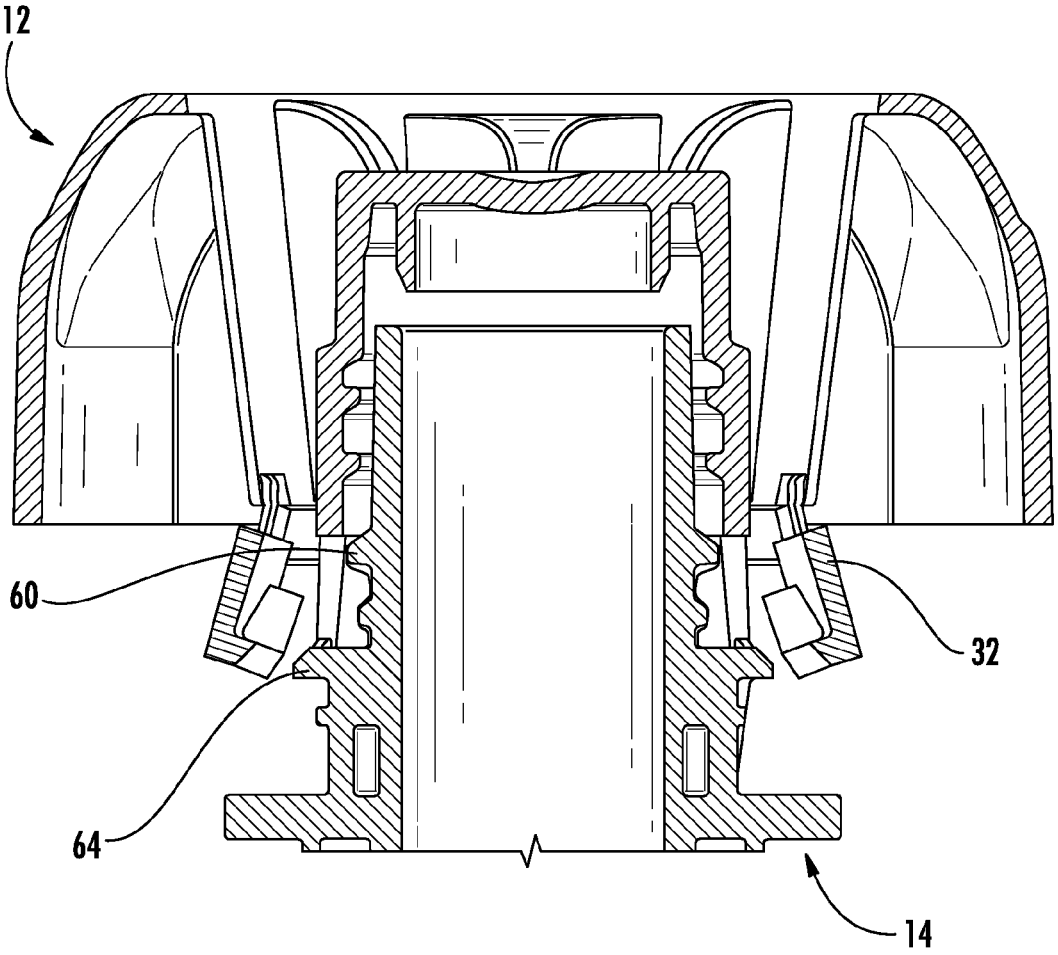
FIG. 13 is a cross-sectional view of a closure and spout assembly after the tamper band has been broken according to an exemplary embodiment.

Referring to FIG. 12, a detailed view of the interaction between J-bands 42 and spout 14 are shown. Spout 14 includes a plurality of generally vertically extending ribs 61 located below flange 60. Ribs 61 interact with the radially innermost section of J-band 42 during cap removal limiting the ability of J-bands 42 from tucking under flange 60. In this manner, ribs 61 provide a surface that allows J-bands 42 to transition over the outermost edge of flange 60 during cap removal.

Figure 14:
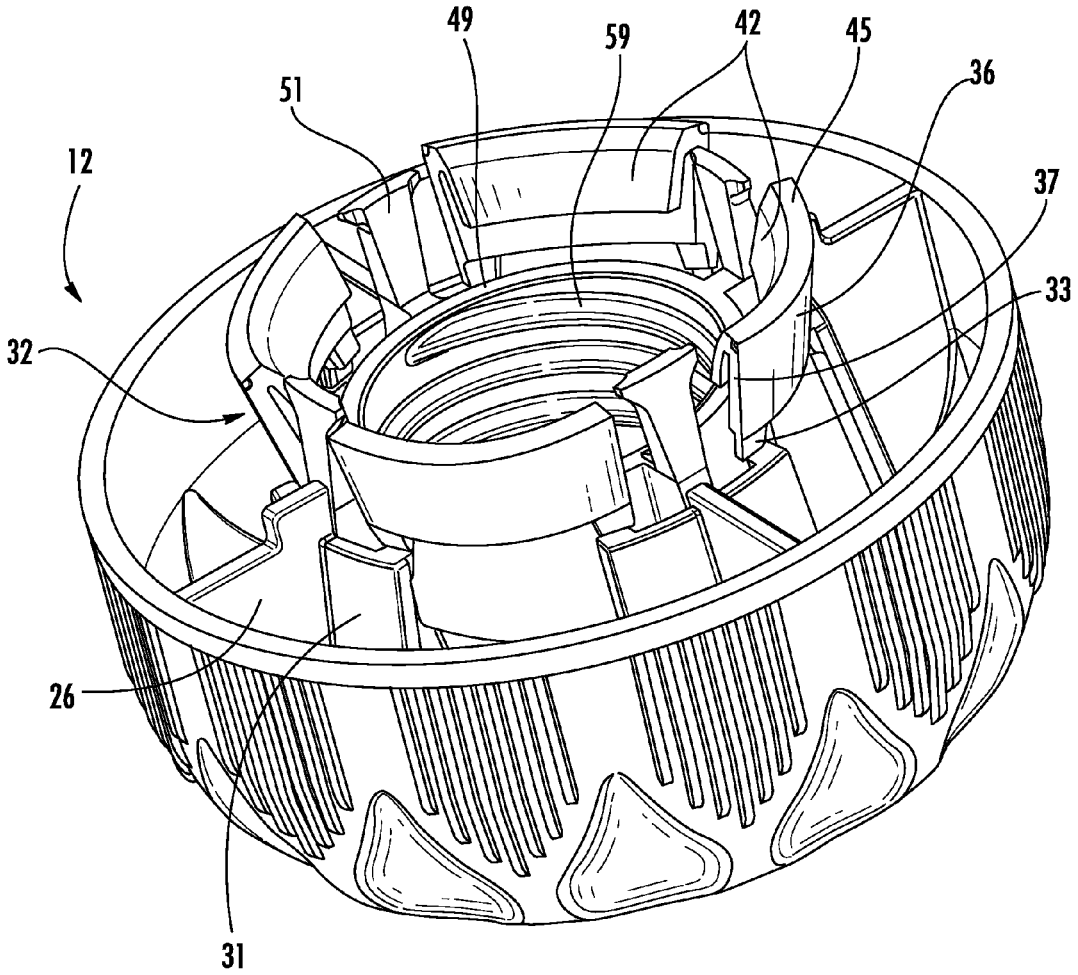
FIG. 14 is a bottom perspective view of the closure of FIG. 3A after the tamper band has been broken according to an exemplary embodiment.

During removal of closure 12 from spout 14, flange 60 includes an outer surface that acts as a catch ledge. As closure 12 is twisted-off and removed, closure 12 moves upwards relative to spout 14, causing J-band sections 42 to interact with flange 60. As J-band sections 42 interact with flange 60, tamper band 32 is forced outward. As the closure 12 continues to move upwards relative to the spout 14, the interaction of J-band sections 42 with flange 60 continues to force tamper band 32 further outwards. This distortion of the tamper band 32 results in the breaking of bridge pairs 38. Specifically, as tamper band 32 passes over flange 60 upon removal of closure 12, flange 60 acts to spread broken tamper band 32 and pushes broken tamper band 32 radially outward. The broken sections of tamper band 32 pivot radially outward about hinges 33 under the interaction with flange 60, as shown in FIG. 14.

Figure 15A:
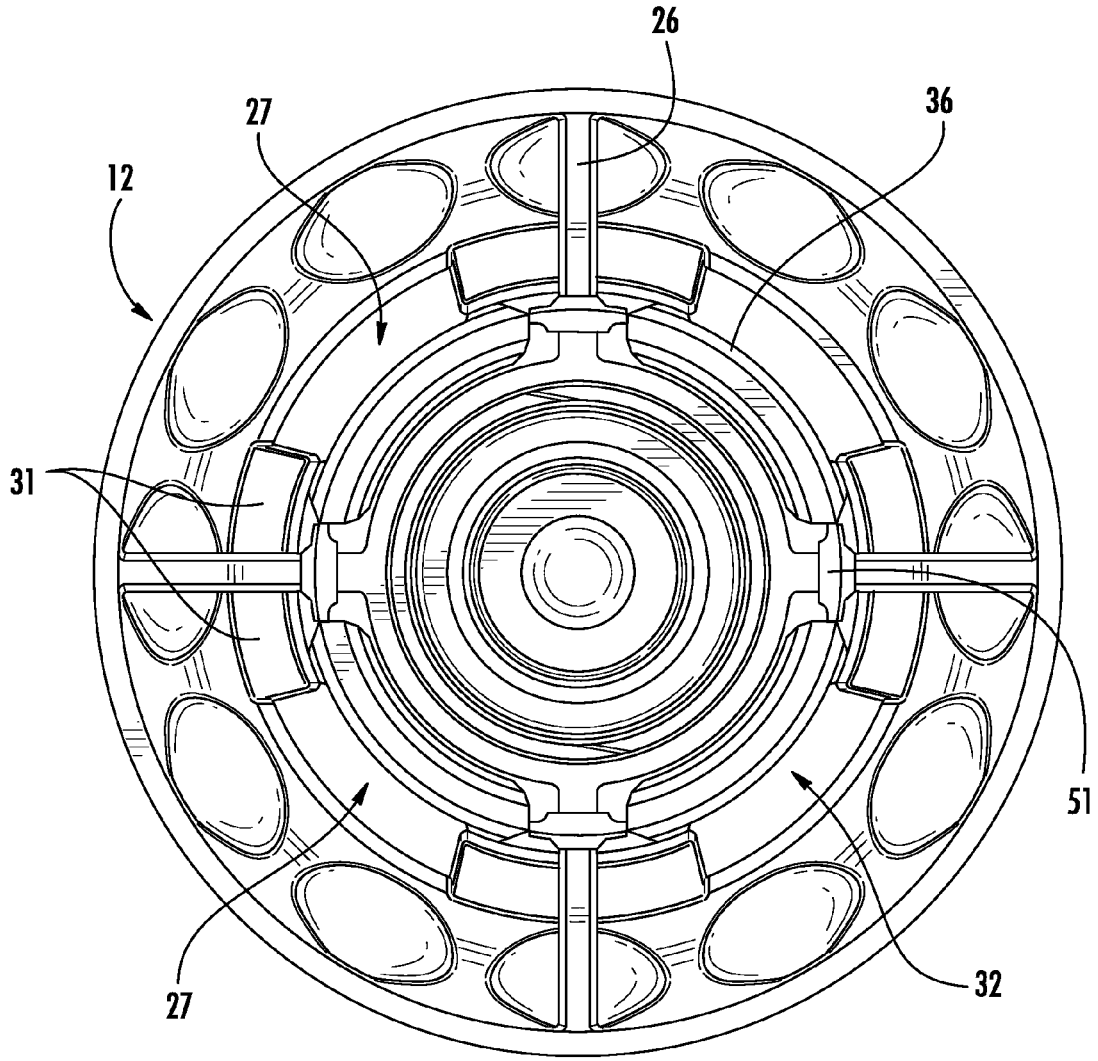
FIG. 15A is a bottom view of the closure of FIG. 3A with an intact tamper band according to an exemplary embodiment.
Figure 15B:
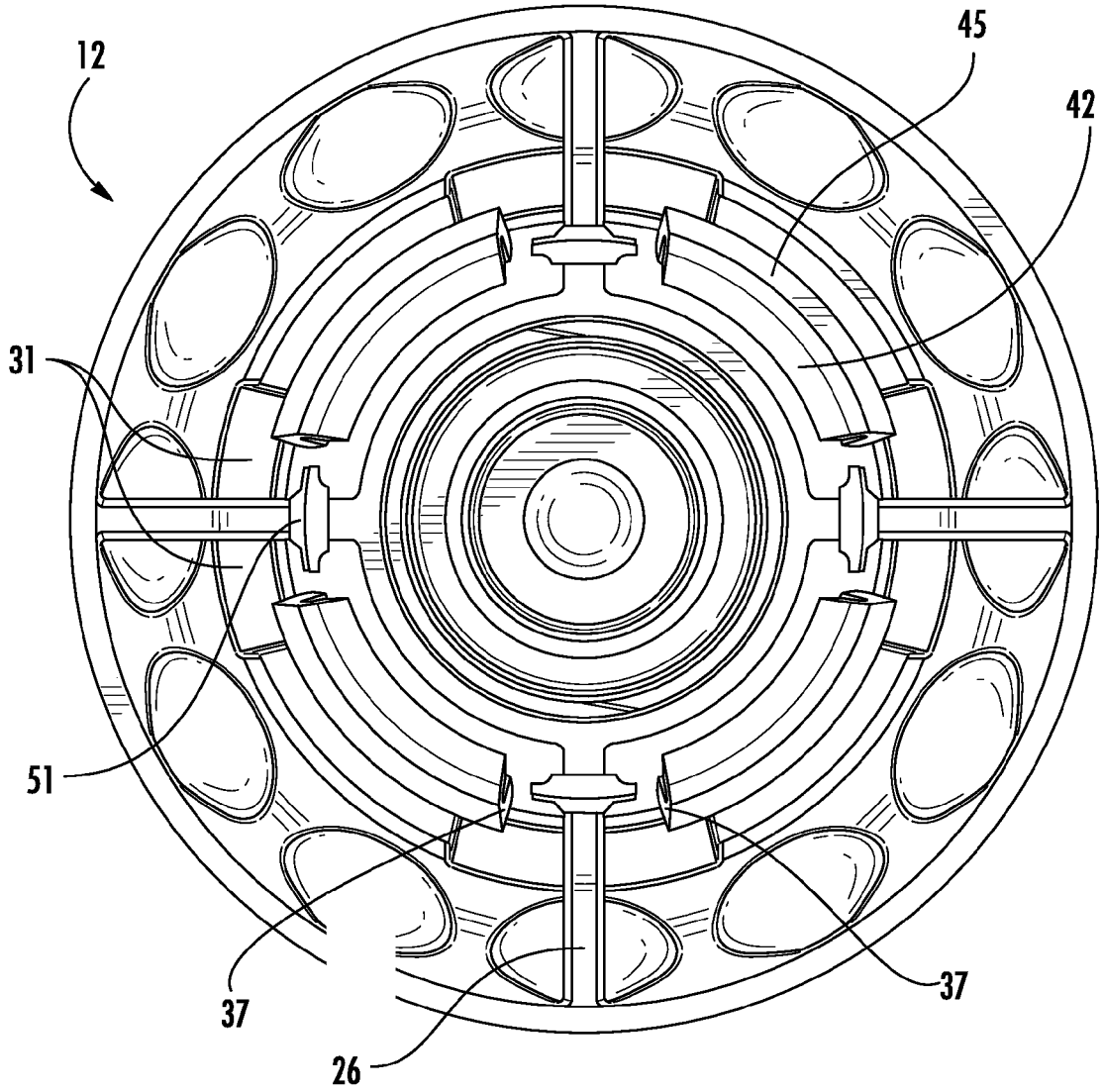
FIG. 15B is a bottom view of the closure of FIG. 3A with a broken tamper band according to an exemplary embodiment.

A shown by the comparison of closure 12 prior to removal (as shown in FIG. 15A) to the closure 12 after the tamper band 32 has been broken (as shown in FIG. 15B), the broken bridge sections 38 and the radially outwardly displaced tamper band 32 provides visual tamper indication to a user that the closure 12 has previously been opened. As shown in FIG. 15B, because the wall sections 36 are attached to the upper portion of closure 12 at each end by hinges 33, once the tamper band 32 has been broken, the wall sections 36 are constrained in the manner in which the wall section 36 outwardly deflect. Furthermore, because the wall sections 36 are attached at each end by hinges 33, the free ends of broken bridges are relatively radially constrained by the hinged attachment of wall sections 36. Because the hinged connection of wall section 36 is configured to prevent the free ends from significantly projecting radially outwards from closure 12, in the event that the closure 12 is accidently swallowed by a user, the damage to the user's airway caused by the free ends of the of the wall sections 36 may be minimized.

Figure 16:
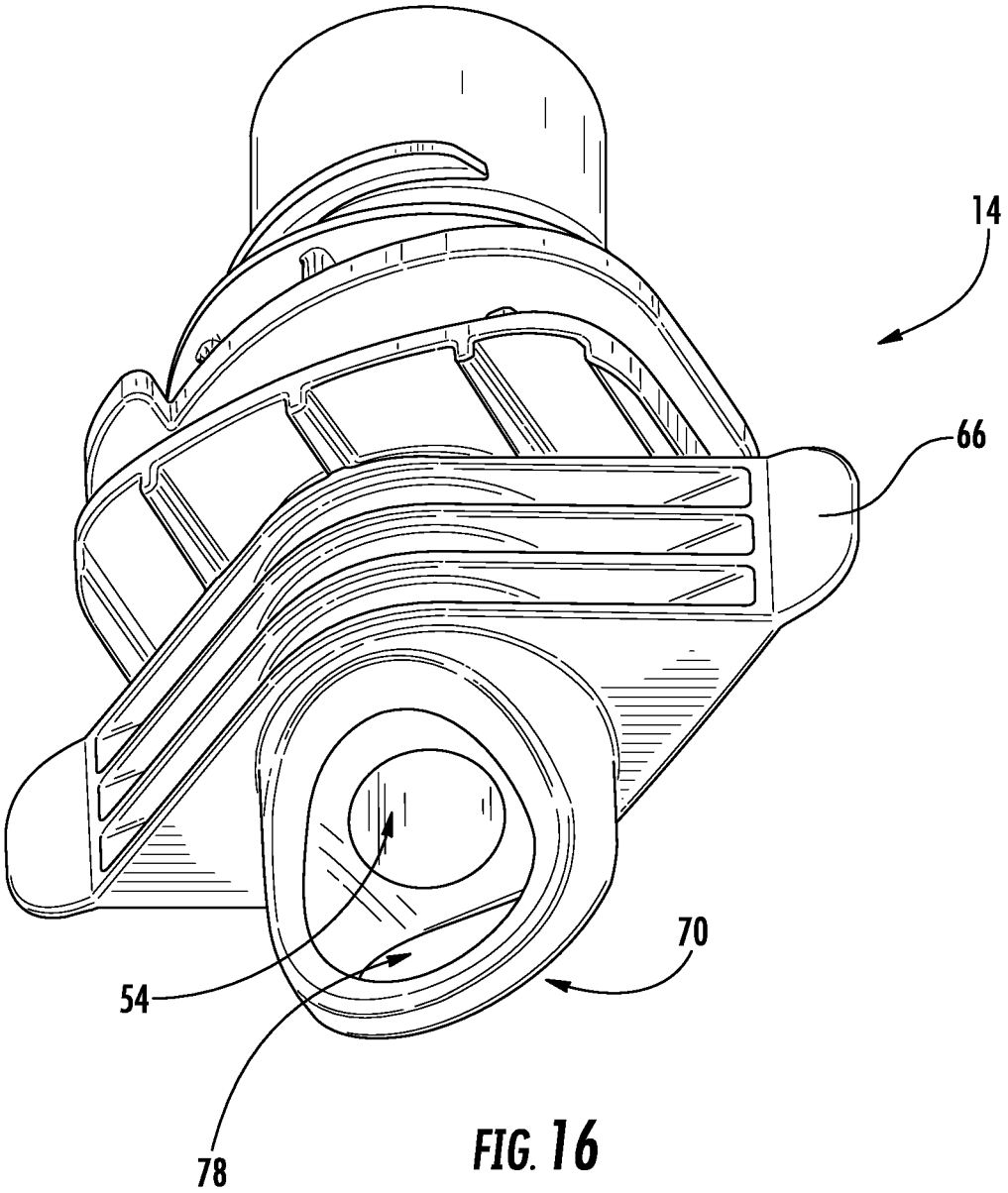
FIG. 16 is a perspective view from below of the spout of FIG. 2 according to an exemplary embodiment according to an exemplary embodiment.
Figure 17:
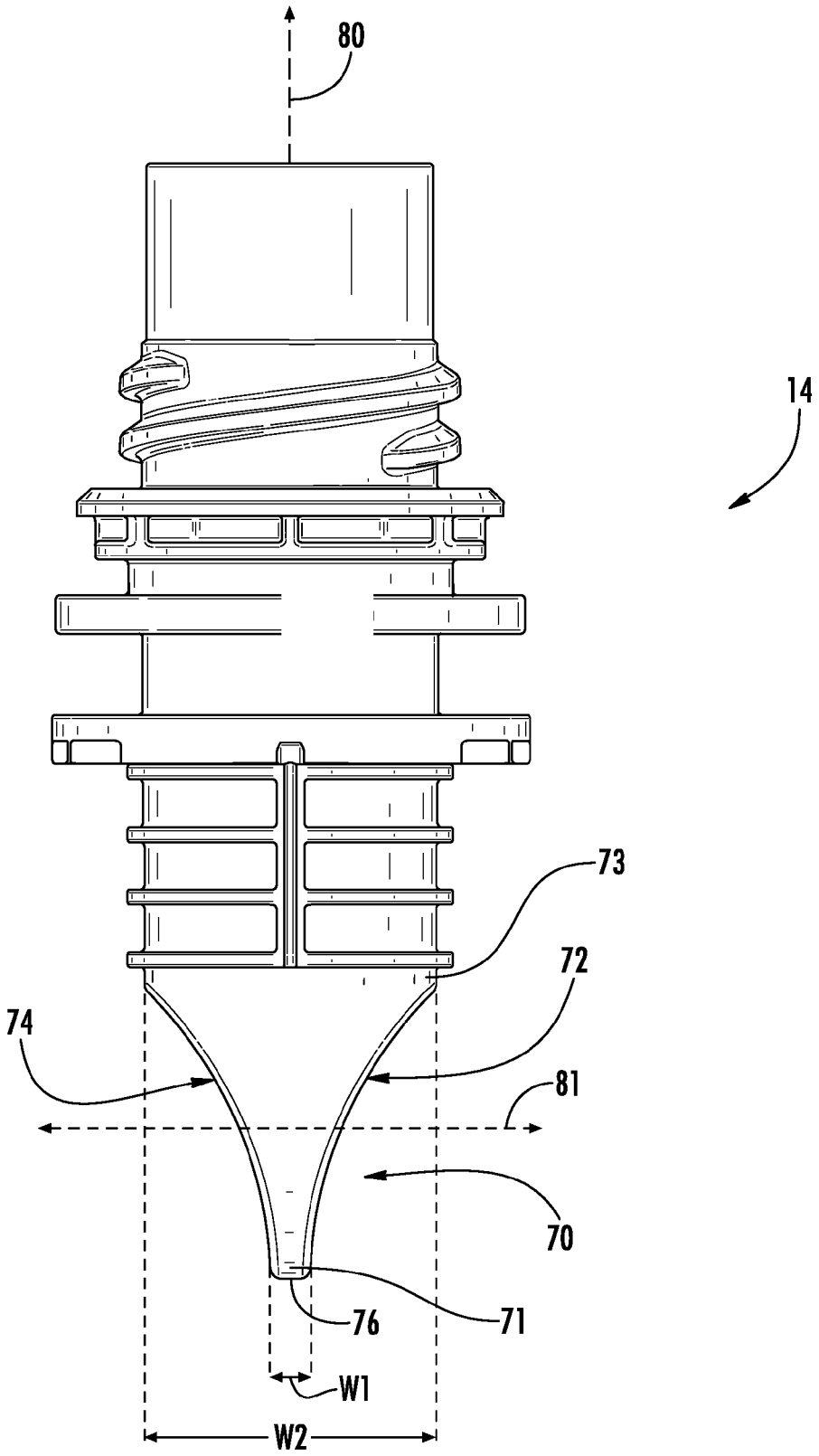
FIG. 17 is a side view of the spout of FIG. 2 according to an exemplary embodiment.

Referring to FIGS. 16 and 17, spout 14 includes a structure surrounding lower opening 54 that acts to limit occlusion of spout opening 54. In the specific embodiment shown, spout 14 includes a structure 70 extending from a lower surface of mounting area 66 that surrounds lower opening 54 of spout 14 and acts to limit or prevent opening 54 from being occluded by the sidewall of the container (e.g., pouch 16) to which spout 14 is attached. In general, structure 70 defines a lower channel, shown as ring shaped channel 78, and at least a portion of the entrances to channel 78 lie in a plane substantially parallel to the wings of mounting structure 66.

Referring to FIG. 17, structure 70 includes opposing surfaces 72 and 74 that taper inward toward central axis 80 and that extend downward to bottom surface 76. Channel 78 defines an axis 81 that is substantially perpendicular to both axis 80 and to a plane defined by mounting structure 66. In this arrangement, channel 78 extends between opposing surfaces 72 and 74, and opposing surfaces 72 and 74 are angled inward relative to a plane defined by mounting structure 66. Further, in various embodiments, surfaces 72 and 74 are angled inward toward axis 80.

In various embodiments as shown in FIG. 17, the width, W, of the tip 71 of structure 70 is relatively small compared to the width, W, of the upper end 73 of structure 70. In various embodiments, W is less than 50% of W, specifically is less than 30% of W, and more specifically is less than 20% of W. In this arrangement, surfaces 72 and 74 generally face the inner surfaces of container 16 and provide an elongate ring structure that limits the ability of inner surfaces of container 16 to occlude or block lower spout opening 54.

To further facilitate the occlusion limiting function of structure 70, surfaces 72 and 74 are curved surfaces that are concave relative to axis 80. In various embodiments, surfaces 72 and 74 are continuously curved surfaces that curve inward toward axis 80. Curved surfaces 72 and 74 may act to provide improved occlusion resistance relative to planar angled walls due to the changing degree of distance between the curved surface 72 and 74 and the inner wall of a container (such as pouch 16).

Figure 18:
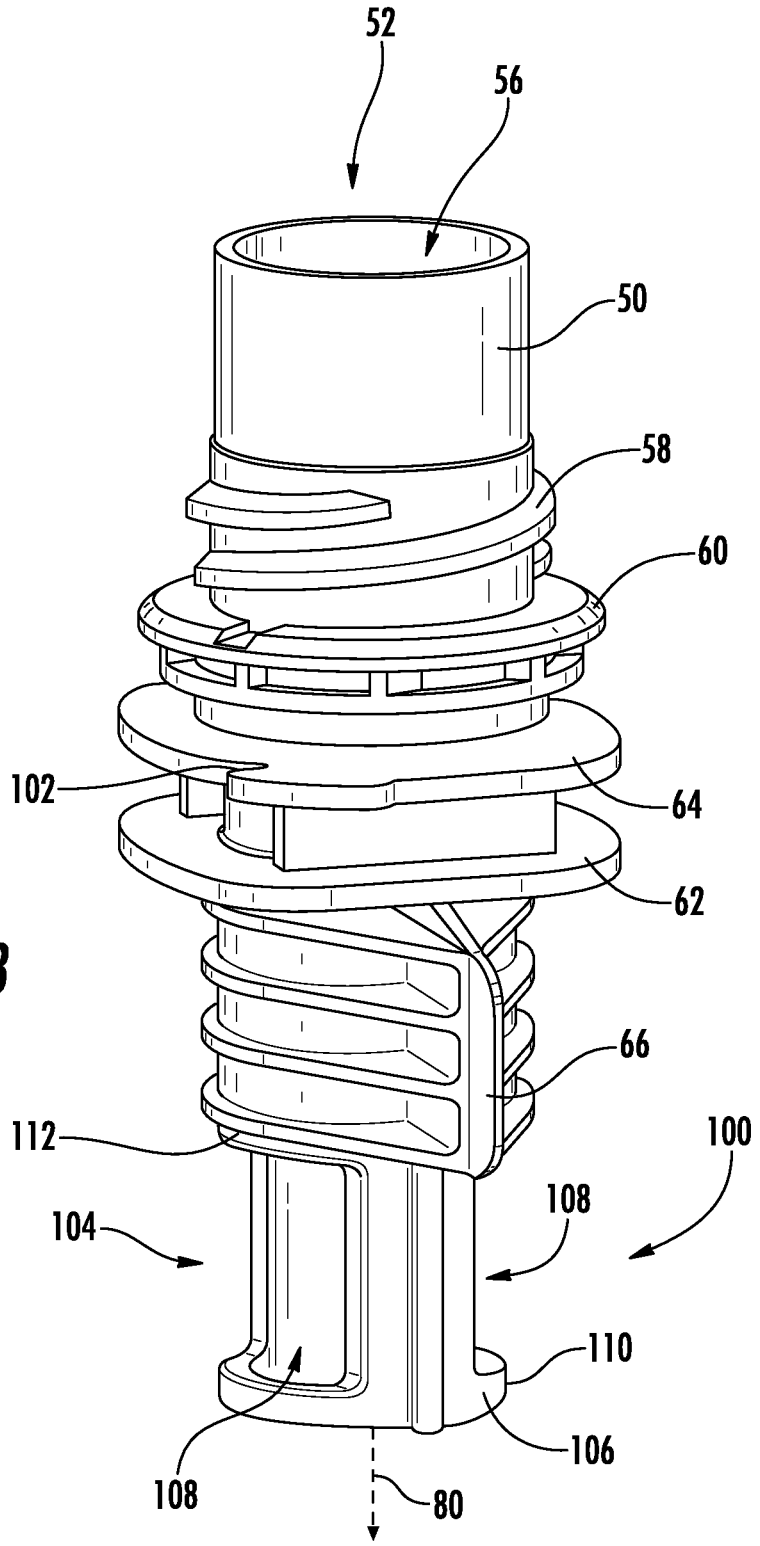
FIG. 18 is a perspective view of a spout according to another exemplary embodiment.

Referring to FIG. 18, a spout 100 according to another embodiment is shown. Spout 100 is substantially the same as spout 14 except as discussed herein. Spout 100 includes a structure 104 that surrounds lower spout opening 54 that acts to limit occlusion of spout opening 54. In general, structure 104 includes a lower end flange 106, and at least two generally rectangular, substantially vertical openings 108. Openings 108 are recessed in the direction of axis 80 relative to radial outermost surface 110 of flange 106 and radial surface 112 located below mounting structure 66. In this manner, surfaces 110 and 112 act to space the walls of the container (e.g., pouch 16) from opening 108 such that the walls do not occlude opening 108.

Although the closure 12 has been described as having a tamper band 32 comprising J-band sections 42 which are configured to interact with flange 60 of spout 14 during twist-off and removal of the closure to break the tamper band 32, in other embodiments the hinged tamper band 32 may comprise structures other than J-band sections 42 that interact or engage with spout 14 to break the hinged tamper band. For example, in one embodiment, tamper band may comprise one or more radially inwardly projecting flanges that extend from the inner wall sections 36. In such an embodiment, spout 14 may include one or more structures configured to interact with the flanges of tamper band during twist-off to break tamper band. In other embodiment, the hinged tamper band may comprise wall sections 36 that include gaps that are initially positioned about outwardly extending flanges formed on spout 14. In such an embodiment, during twist-off the flanges of spout interact with the gaps of wall sections to break the hinged tamper band.

When the pouch 16 and spout 14 are sealed together, cavities may be formed between the external surface of the spout 14 and the inner surfaces of the sidewalls of the pouch 16. As such, vent structures, such as e.g. those disclosed below, may be incorporated into a container assembly 10 including a closure 12 having a hinged tamper band 32 as discussed with regards to any of the previously described embodiments.

Figure 19:
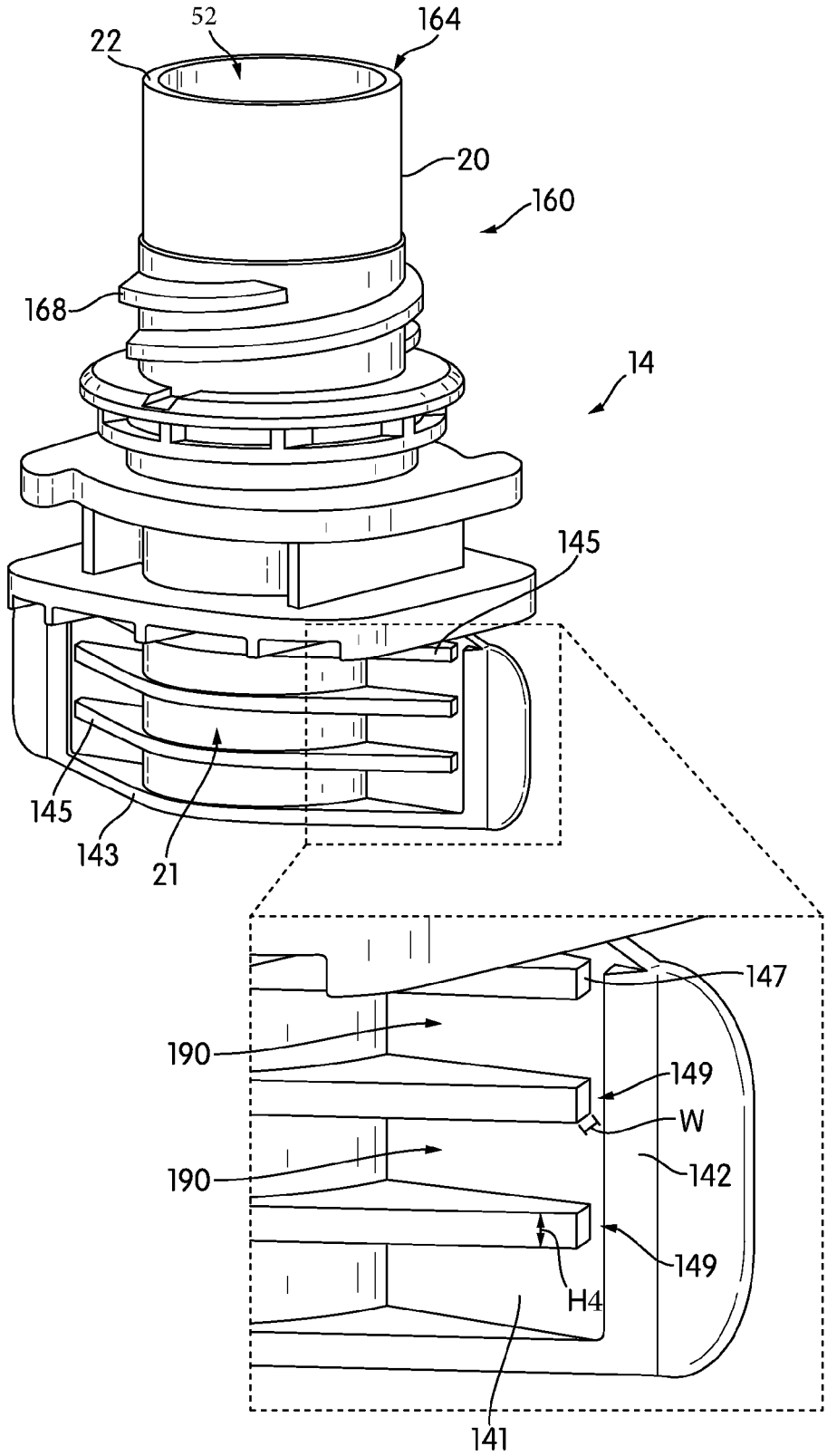
FIG. 19 is a perspective view of a spout including a mounting portion having a vent according to one embodiment.

Referring to FIG. 19, a mounting portion 140 according to one embodiment is shown. As seen in FIG. 19, mounting portion 140 surrounds a lower portion of tube 20. In some embodiments, mounting portion 140 may have a generally trapezoidal shape, e.g. a rhomboid shape, with rounded vertices. As shown in FIG. 19, the mounting portion 140 includes wings 28 having generally flat planar portions located at diametrically opposite ends of the mounting portion 140. The wings 28 are configured to form a fluid-tight interface with the pouch 16 when the pouch 16 is attached to the wings 28. In other embodiments, the mounting portion 140 may include other structures such as additional flanges, rings, etc., instead of wings 28 that allow for coupling to and support of the spout 14 to the pouch 16.

When the spout 14 is attached to the pouch 16, the wings 28 extend within the pouch 16 and are attached to the inner surfaces of the sidewalls of the pouch 16, such that spout 14 is supported from the pouch 16 as shown in FIG. 1. The fluid-tight attachment or bonding between the pouch 16 and the wings 28 may involve an adhesive, a melted thermoplastic, heat welding, ultrasonic welding, or other means for sealing the structures together.

Figure 20:
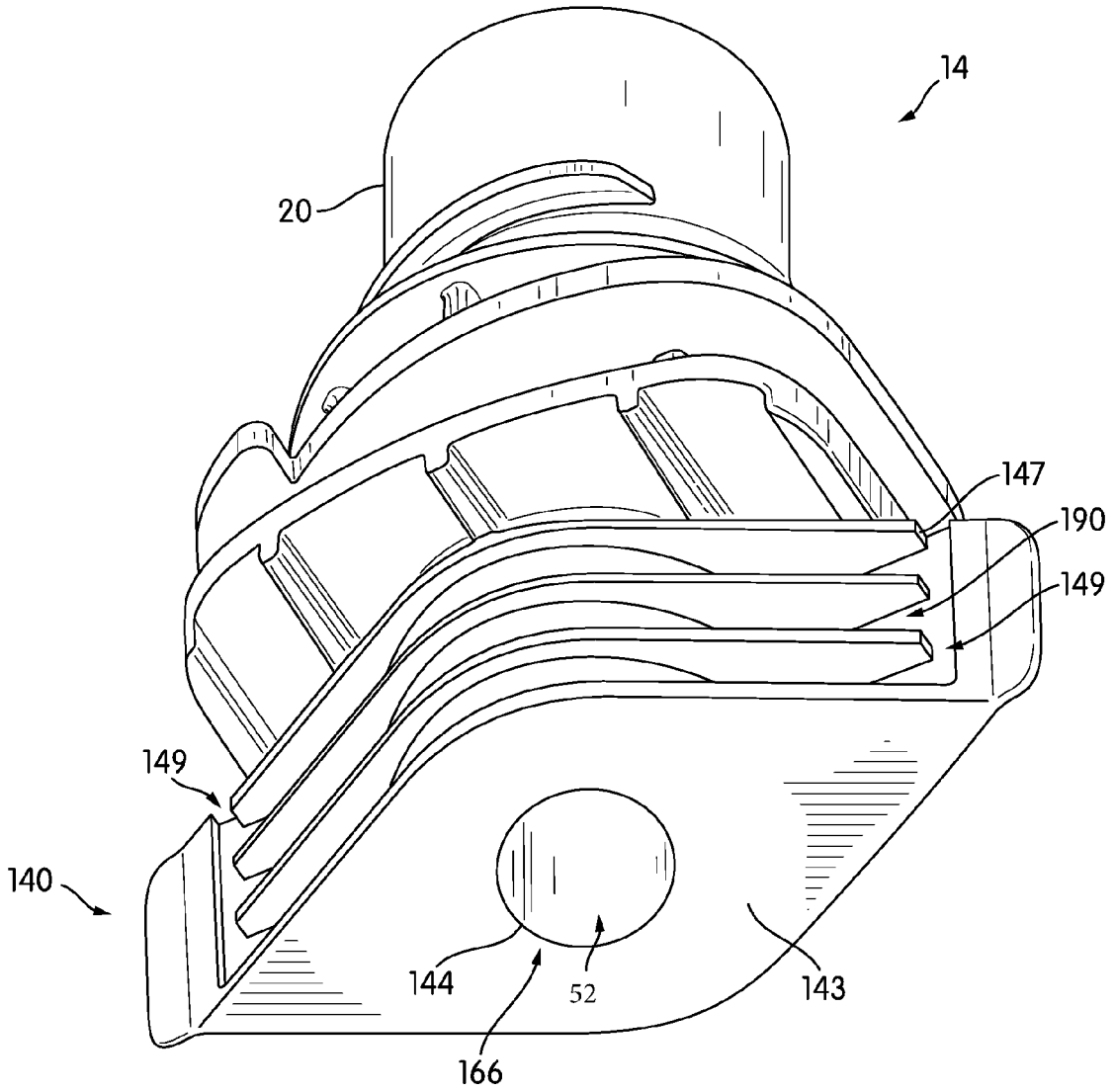
FIG. 20 is bottom perspective view of the spout of FIG. 19 according to one embodiment.

As shown in FIG. 20, mounting portion 140 includes a bottom sealing wall 143 including an opening 144. Opening 144 of the bottom sealing wall 143 provides for fluid communication between the contents stored in the cavity of pouch 16 and the central channel 52 of spout 14.

Figure 21:
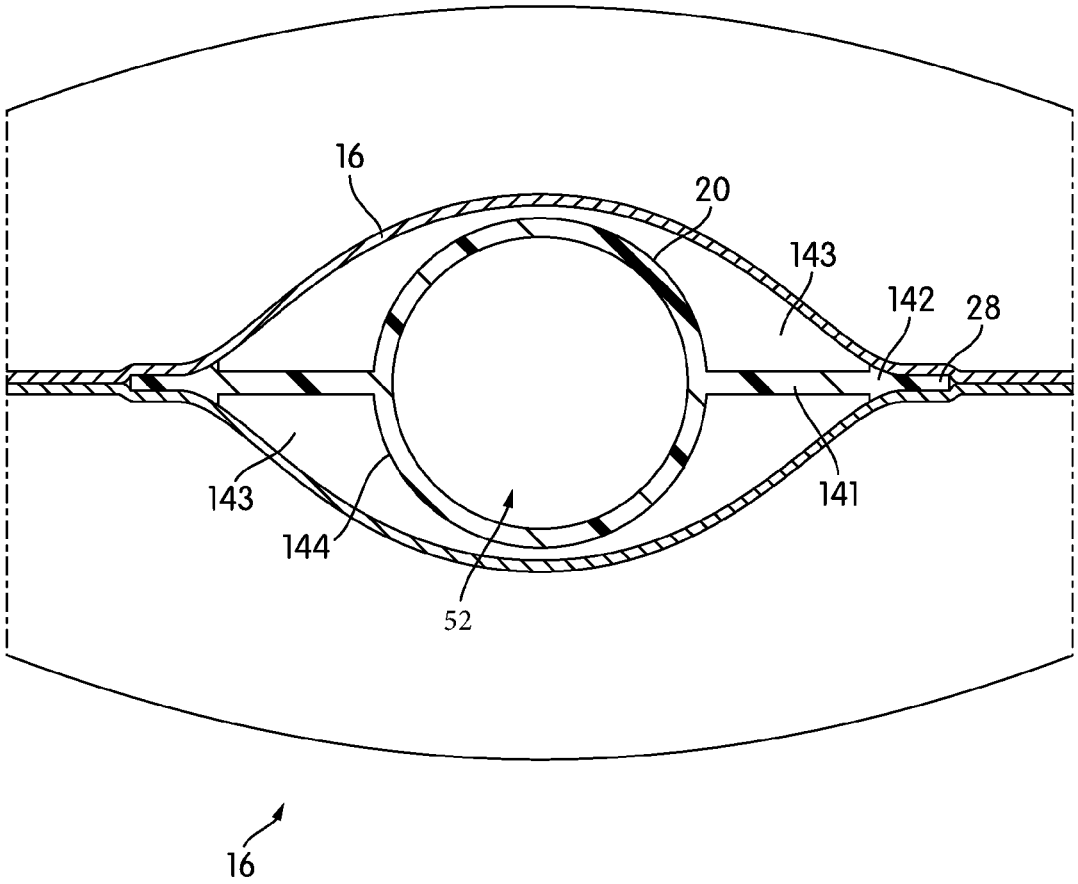
FIG. 21 is a bottom sectional view from above taken along line 21-21 of FIG. 1 according to one embodiment
Figure 22:
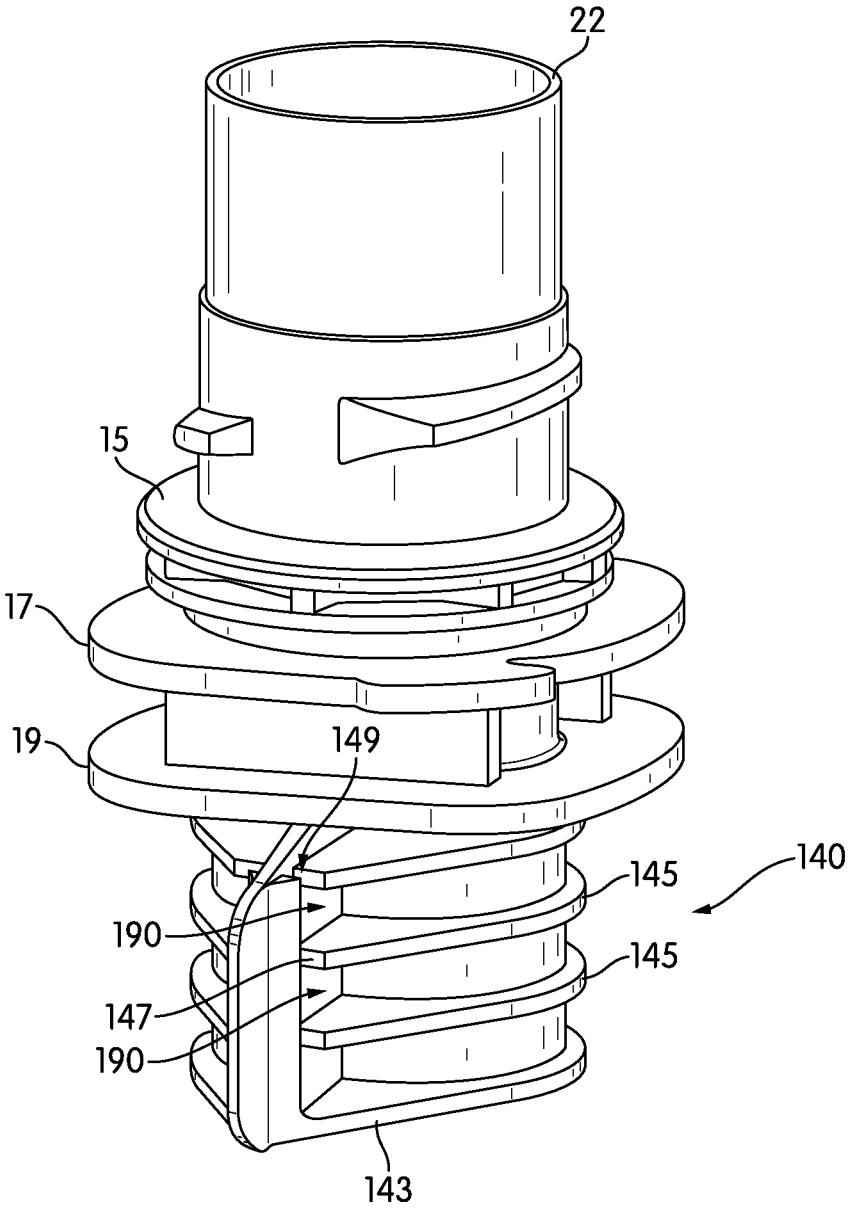
FIG. 22 is a perspective view of the spout of FIG. 19 according to one embodiment.
Figure 23:
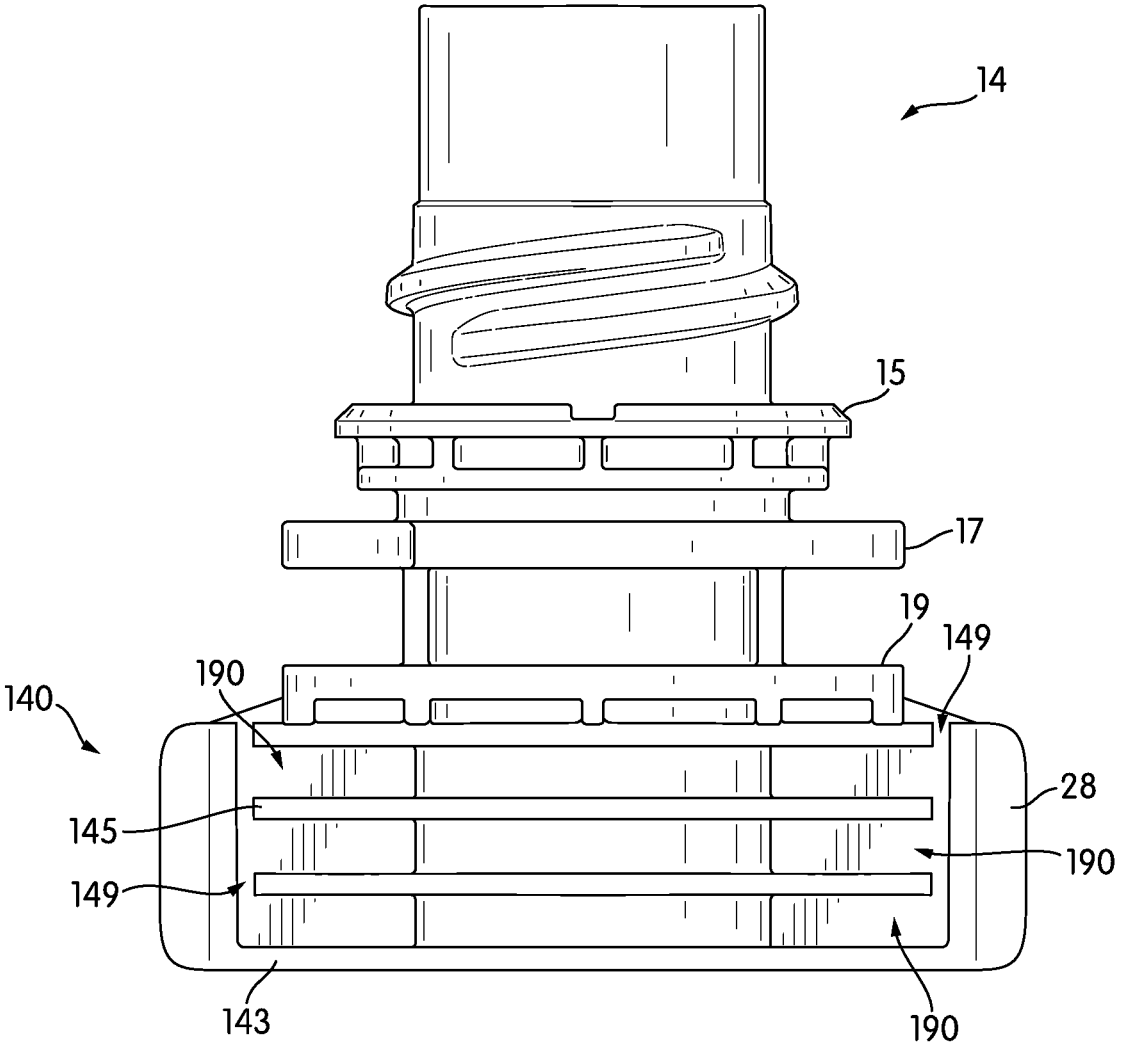
FIG. 23 is a front view of the spout of FIG. 19 according to one embodiment.

Referring to FIG. 21, a bottom sectional view taken along line 21-21 of FIG. 1 is shown. Line 21-21 of FIG. 1 extends along a plane located between and extending parallel to the upper surface of bottom sealing wall 143 and the bottom surface of the bottommost rib 145 located directly above bottom sealing wall 143. As shown in FIG. 21, the perimeter of bottom sealing wall 143 extends uninterruptedly between the diametrically opposed wings 28 such that when spout 14 is attached to pouch 16, the perimeter of bottom sealing wall 143 forms an uninterrupted fluid-tight interface with pouch 16. This fluid-tight attachment or bonding between the pouch 16 and the bottom sealing wall 143 may involve an adhesive, a melted thermoplastic, heat welding, ultrasonic welding, or other means for sealing the structures together.

As also shown in FIG. 21, with the exception of opening 144, the bottom sealing wall 143 forms a solid surface free of any gaps or holes extending from a top surface of bottom sealing wall 143 to a bottom surface of bottom sealing wall 143. The interface between the opening 144 and the tube 20 extending through the bottom sealing wall 143 is a fluid tight interface which may involve an adhesive, a melted thermoplastic, heat welding, ultrasonic welding, or other means for sealing the structures together. Alternatively, the tube 20 and bottom sealing wall 143 may be monolithically molded. As such, bottom sealing wall 143 is configured such that when the spout 14 is sealed to pouch 16, the only fluid communication between the contents in the cavity of pouch 16 and the external environment is through the central channel 52.

Referring to FIG. 19, mounting portion 140 further includes one or more ribs 145 circumferentially extending about lower portion of tube 20. In some embodiments, mounting portion 140 also includes a support wall 141 extending between wings 28. As shown in FIG. 19, ribs 145 extend perpendicularly outward from the front and back surfaces of support wall 141. In other embodiments, mounting portion 140 may be formed without a support wall 141, and each rib 145 may include a single flange circumferentially surrounding and extending radially from tube 20. In such embodiments of a mounting portion 140 formed without a support wall 141, wings 28 may be integrated into the structure of the mounting portion 140 by extending wings 28 from the ends of bottom sealing wall 143.

As shown in FIG. 19, ribs 145 have a maximum diameter (as measured between the rounded vertices of mounting portion 140) no greater than the maximum diameter (as also measured between the rounded vertices of mounting portion 140) of bottom sealing wall 143. The contour of the perimeter of ribs 145 generally mirrors the contour of the perimeter of bottom sealing wall 143. When the pouch 16 and spout 14 are attached, the outer perimeter of the ribs 145 is configured to form a fluid fluid-tight attachment or bonding with the inner sidewall of the pouch 16. This fluid tight attachment may involve an adhesive, a melted thermoplastic, heat welding, ultrasonic welding, or other means for sealing the structures together.

When the mounting portion 140, including ribs 145, is sealed, bonded, or otherwise attached to pouch 16, air may become trapped between the spaces 190 defined between adjacent ribs 145 and/or between the bottommost rib 145 and the bottom sealing wall 143. As the ambient temperature and/or pressure in which the assembled pouch 16 and spout 14 assembly are stored changes or fluctuates, the pressure within spaces 190 and/or the volume of the air trapped in spaces 190 may also change. These changes in ambient pressure and/or temperature may occur unintentionally, for example during storage or transport. In other embodiments, the changes in ambient pressure and/or temperature may be imparted intentionally, e.g. during preservation of sterilization procedures. For example, a container assembly 10 undergoing high pressure processing (HPP) or pascalization would undergo extreme changes in ambient pressure.

As a result of fluctuating or changing pressures and/or volumes occurring relative to spaces 190, forces may be imparted on the attachments between the spout 14 and pouch 16 formed at the interfaces between the mounting portion 140 and the inner surfaces of the sidewalls of the pouch 16 (e.g. between the interface of the wings 28 and pouch 16, between the interface of the bottom sealing wall 143 and pouch, between the interface of the ribs 145 and the pouch 16, etc.) In turn, these resultant forces may act to affect or impair the fluid-tight sealing engagement formed between the pouch 16 and the mounting portion 140 of spout 14.

Referring to FIGS. 19-38, various embodiments of a container assembly 10 incorporating one or more vents are shown. These vents, as shown in the illustrative embodiments, are configured to provide fluid communication between the outside of the cavities extending between and bounded by the inner surfaces of the sidewalls of pouch 16 and the external surfaces of the mounting portion 140, such as, e.g. spaces 190. By providing a path for air to travel between spaces 190 and the ambient environment, the internal pressure within spaces 190 may be equalized with the pressure external to the container assembly 10. By allowing for the pressure inside the spaces 190 to be substantially the same as the pressure external to the container assembly 10, forces may be prevented from acting upon and adversely affecting the fluid tight seal of the attachment between the pouch 16 and mounting portion 140.

Referring to FIGS. 19-26, one embodiment of a spout 14 incorporating a vent is shown. As shown in FIG. 19, the shape, size and configuration of ribs 145 generally mirrors the shape, size and configuration of bottom sealing wall 143. However, whereas the bottom sealing wall 143 extends from one wing 28 to opposite wing 28, the ends of ribs 145 are cut short, creating a gap 149 between end portions 147 of ribs 145 and the wings 28. Because the ribs 145 are cut short, end portions 147 are defined by a rectangular faces having a height H4 and width W.

Figure 24:
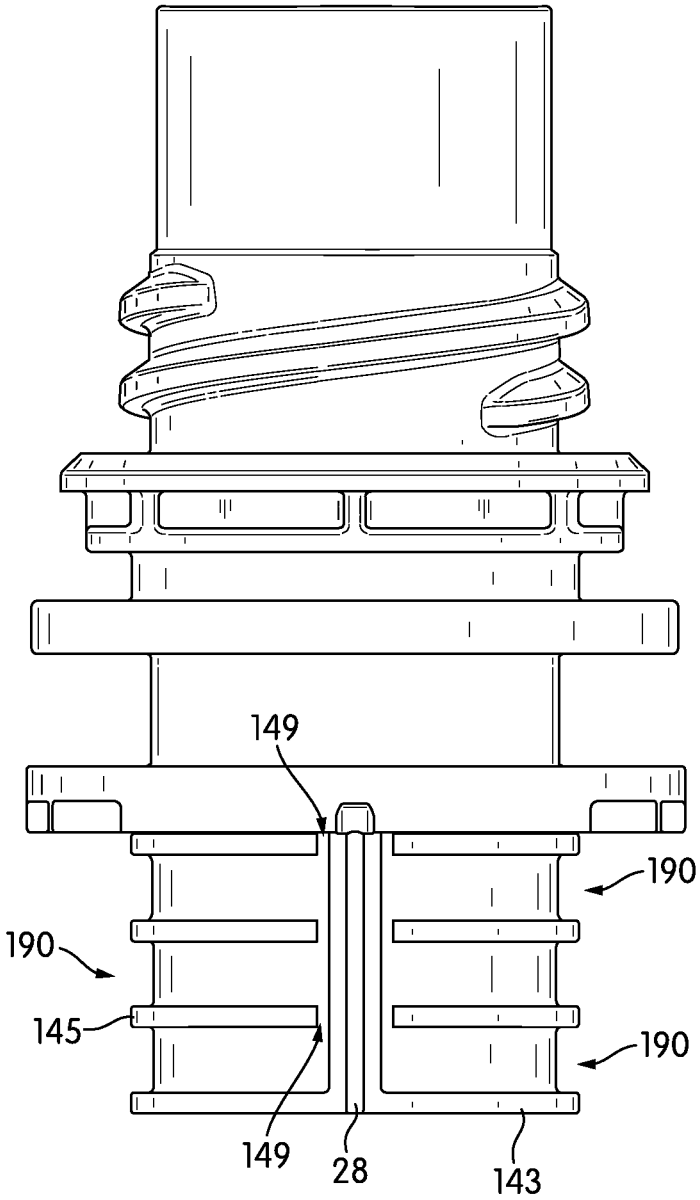
FIG. 24 is a side view of the spout of FIG. 19 according to one embodiment.
Figure 25:
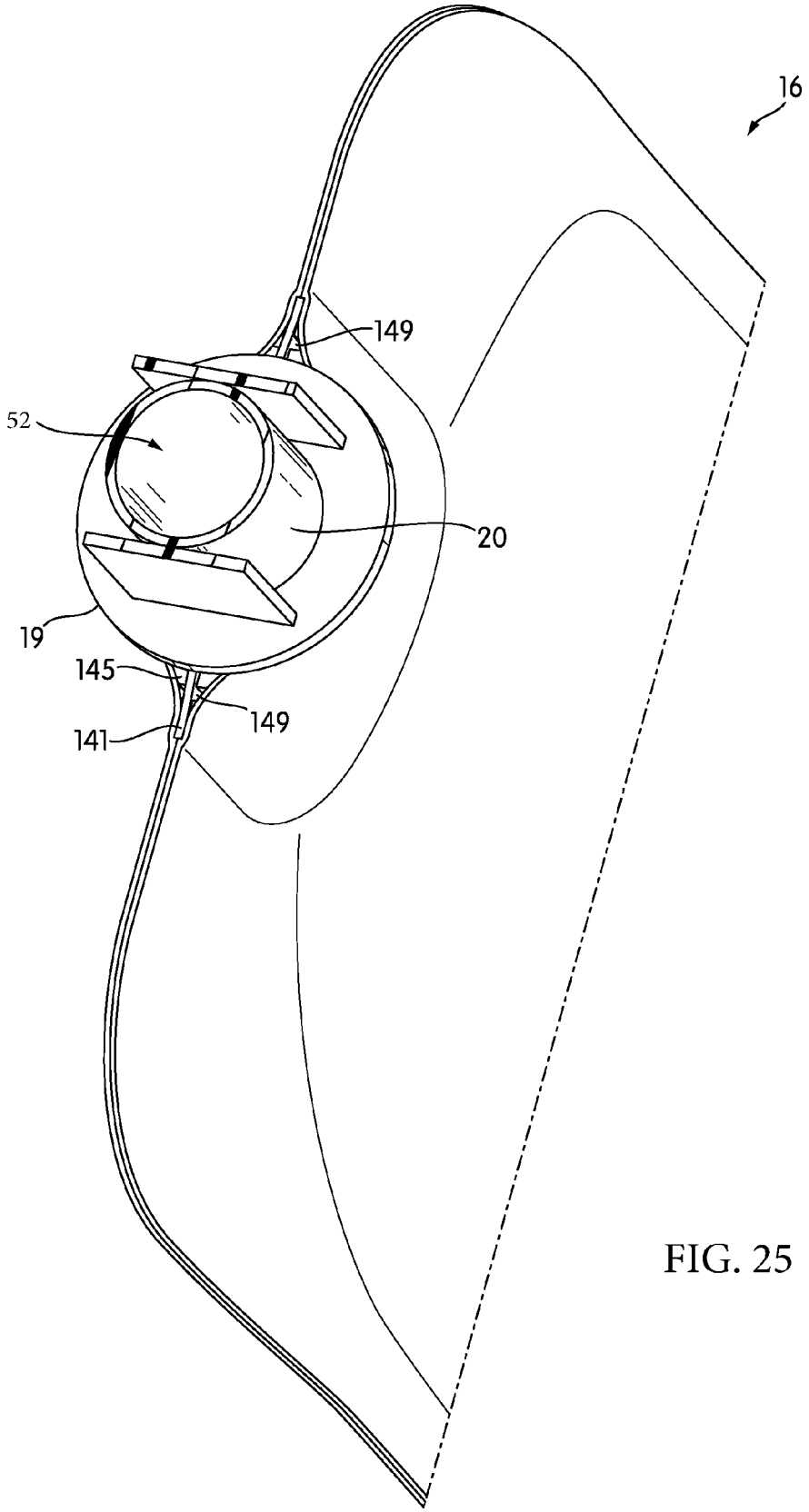
FIG. 25 is a perspective view from above of the spout of FIG. 19 sealed to the pouch-type container of FIG. 1 according to one embodiment.
Figure 26:
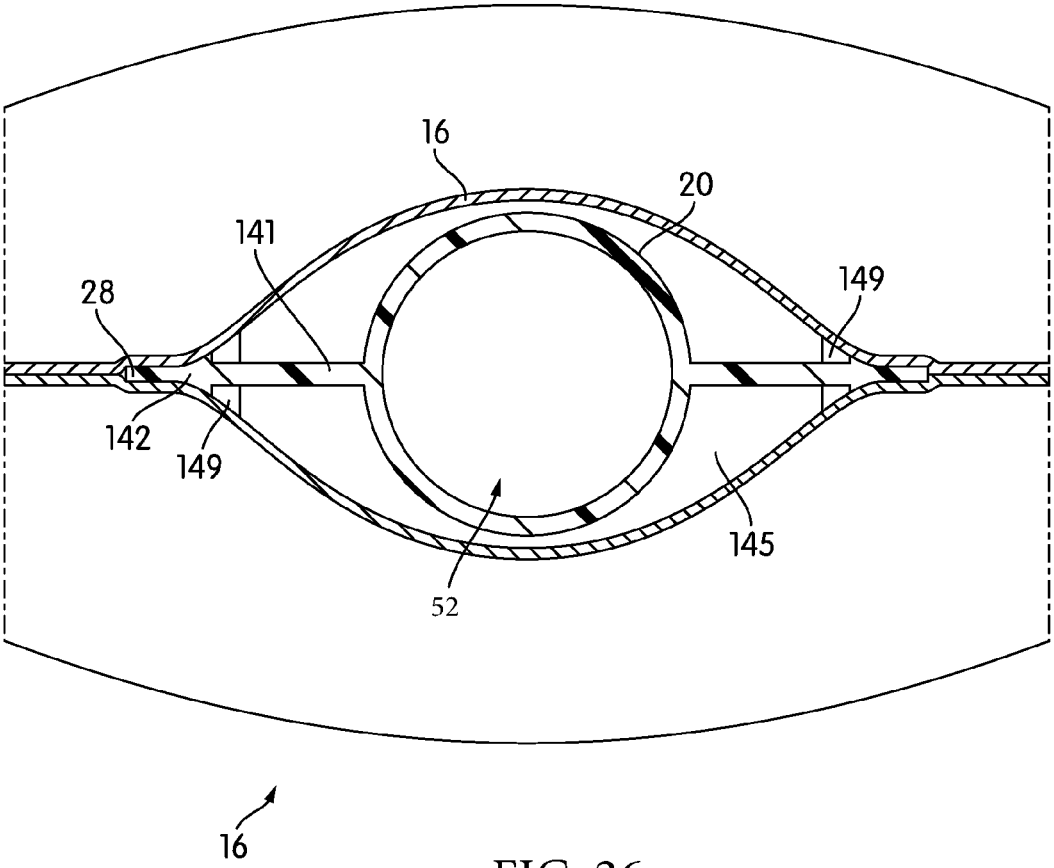
FIG. 26 is a top sectional view taken along line 26-26 of FIG. 1 according to one embodiment.

As shown in FIGS. 24-26, when the pouch 16 and spout 14 are attached, gaps 149 define vents through which the spaces 190 are in fluid communication with the outside environment. As shown in FIGS. 20, 21 and 26, wings 28 may optionally include a transition portion 142 that extends along a curve from the flat portion of wings 28. The outer perimeters of ribs 145 are configured to form a fluid-tight interface with the pouch 16 when the pouch 16 is attached to the ribs 145 of mounting portion 140. This fluid-tight attachment or bonding between the pouch 16 and the ribs 145 may involve an adhesive, a melted thermoplastic, heat welding, ultrasonic welding, or other means for sealing the structures together. As shown in FIG. 10, the outer perimeter of each rib 145 is configured to form an uninterrupted fluid-tight interface along the entire length of each rib 145 with the inner surfaces of the sidewalls of pouch 16 when the pouch 16 and spout 14 are attached. The structure of the end portions 147 and the curve of the transition portion 142 are configured such that when the pouch 16 and spout 14 are sealed together, the pouch 16 lays taut against the outer perimeter of the mounting portion 140 and the pouch is prevented from occluding gaps 149.

Figure 27:
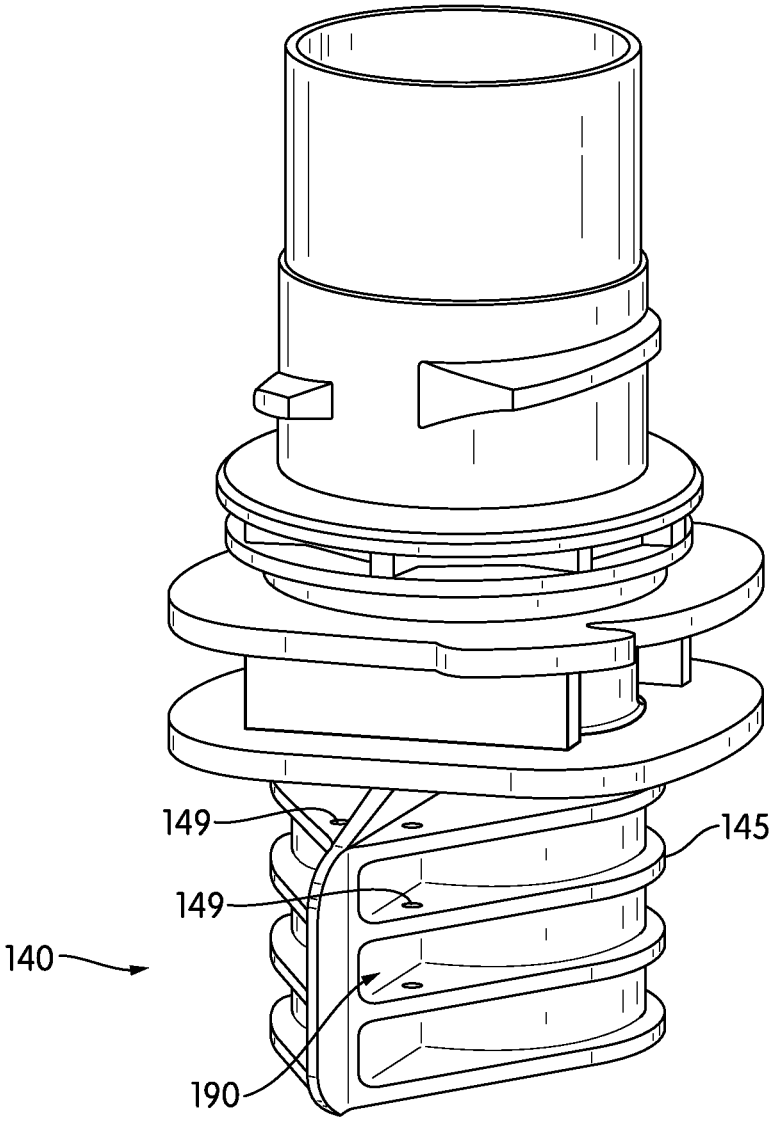
FIG. 27 is a perspective view of a spout including a mounting portion having a vent according to one embodiment.
Figure 30:
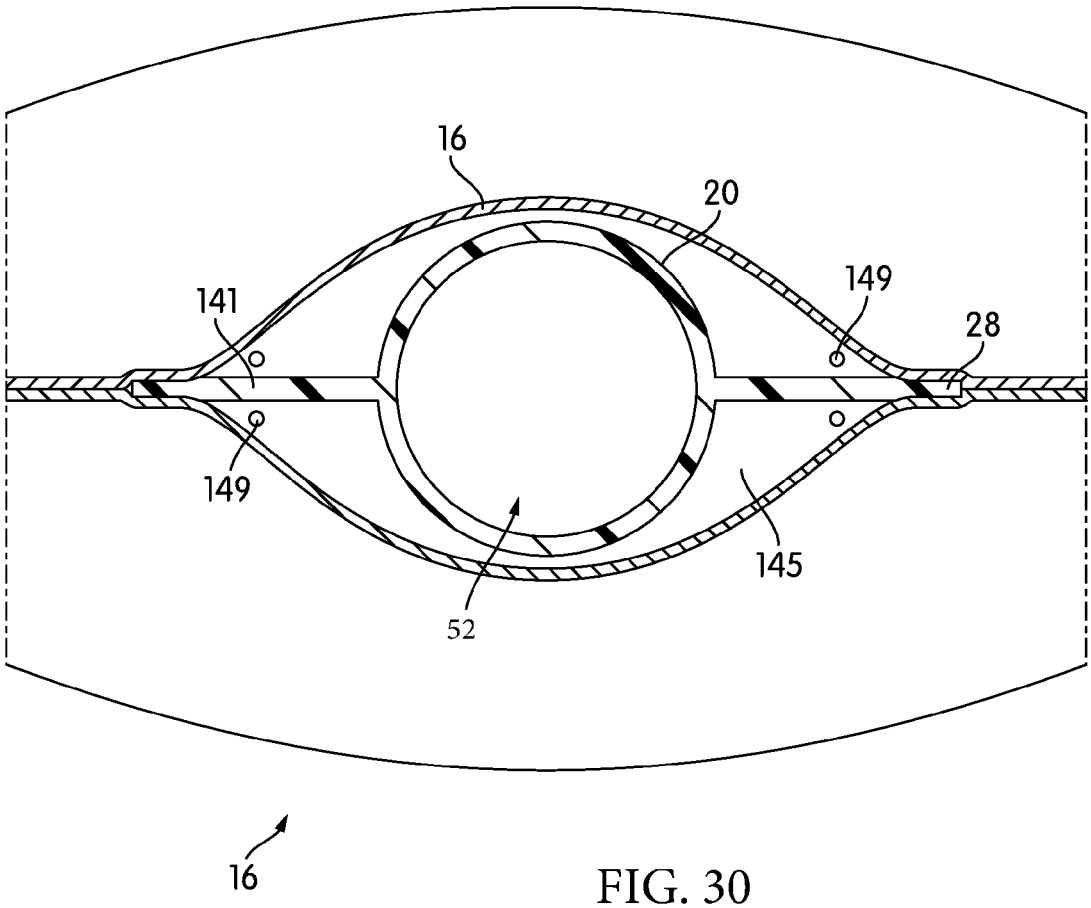
FIG. 30 is a top sectional view taken along line 30-30 of FIG. 1 according to one embodiment.

Referring to FIGS. 27-30, another embodiment of a spout incorporating a venting feature is shown. As shown in FIG. 27 the shape, size and configuration of ribs 145 generally mirrors the shape, size and configuration of bottom sealing wall 143. Also, as seen in FIG. 30 similar to the uninterrupted perimeter of the bottom sealing wall 143, the perimeter of the ribs 145 is uninterrupted, allowing the pouch 16 to form an uninterrupted fluid tight seal along the entirety of the perimeter of the ribs 145 from one wing 28 to opposite wing 28. This fluid-tight attachment or bonding between the pouch 16 and the ribs 145 may involve an adhesive, a melted thermoplastic, heat welding, ultrasonic welding, or other means for sealing the structures together.

Figure 28:
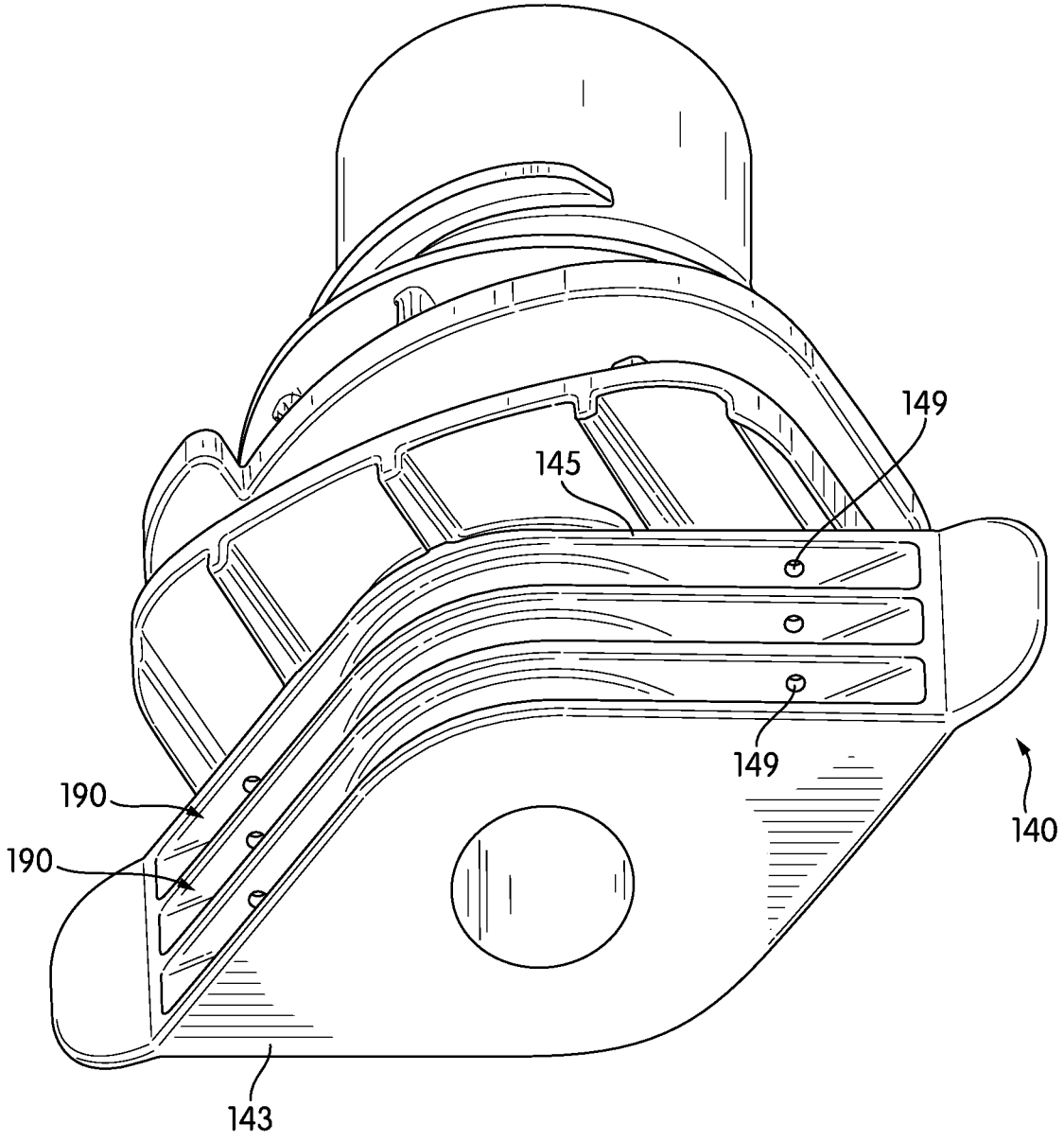
FIG. 28 is bottom perspective view of the spout of FIG. 27 according to one embodiment.
Figure 29:
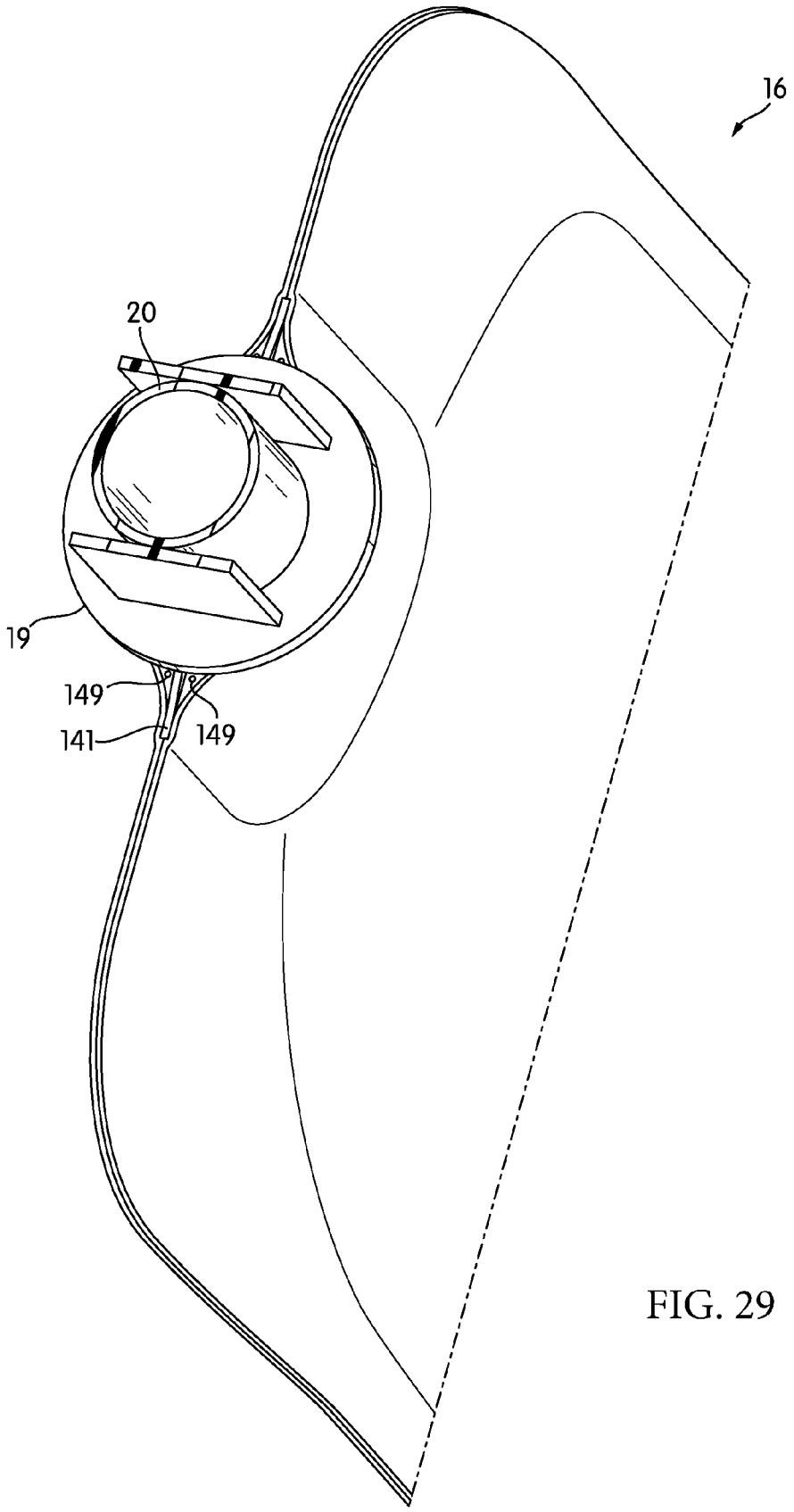
FIG. 29 is a perspective view from above of the spout of FIG. 27 sealed to the pouch-type container of FIG. 1 according to one embodiment.

As shown in FIG. 28, extending through each rib 145 from a top surface to a bottom surface of each rib 145 is a gap 149, formed as a hole or aperture extending from a top surface of each rib 145 to a bottom surface of each rib. As shown in FIG. 28, gaps 149 define vents which permit fluid communication between inner spaces 190 and the outside environment after the pouch and mounting portion 140 have been attached. The holes or apertures in ribs 145 forming gaps 149 can be formed in ribs 145 prior to attachment of spout 14 to pouch 16. In other embodiments, gaps 149 can be formed in ribs 145 after spout 14 and pouch 16 have been attached. Although in FIGS. 27-30 gaps 149 as illustrated as round holes, gaps 149 may have any shape or cross-section and the dimensions of gaps 149 may vary from those shown in the figures.

Figure 31:
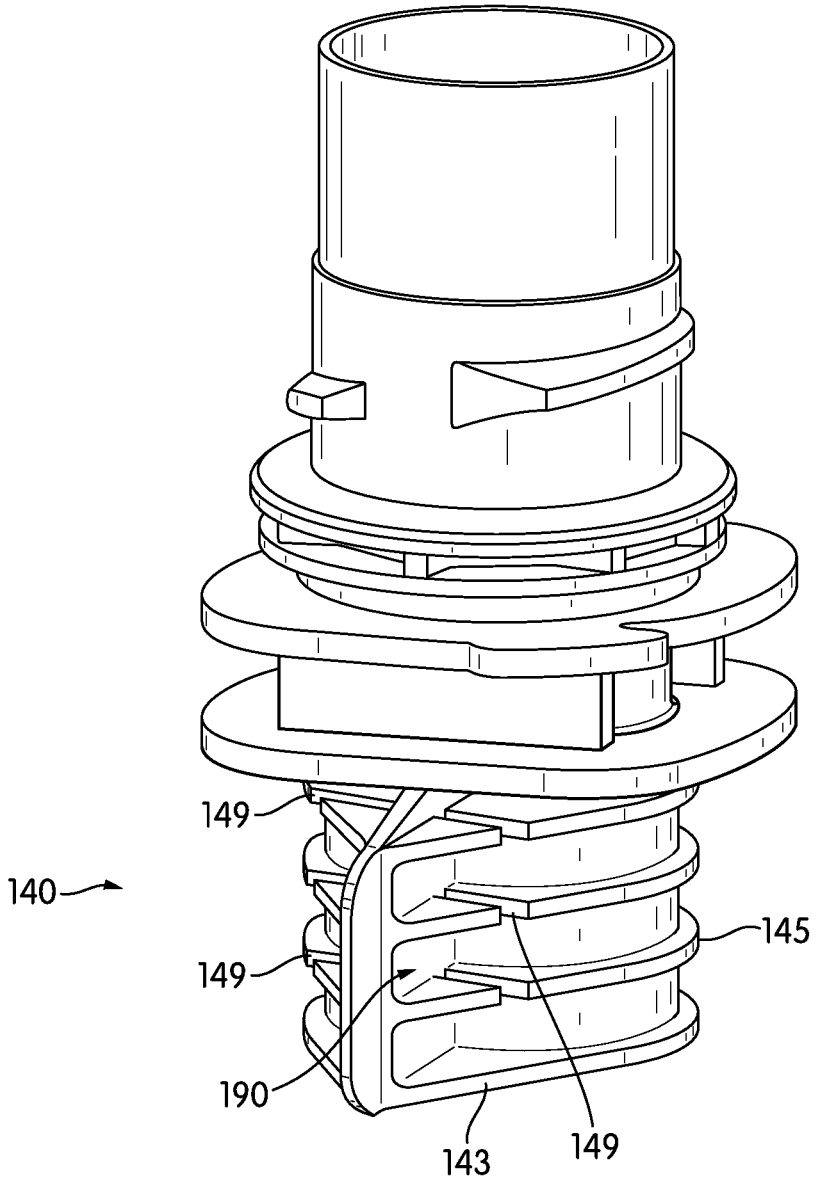
FIG. 31 is a perspective view of a spout including a mounting portion having a vent according to one embodiment.
Figure 32:
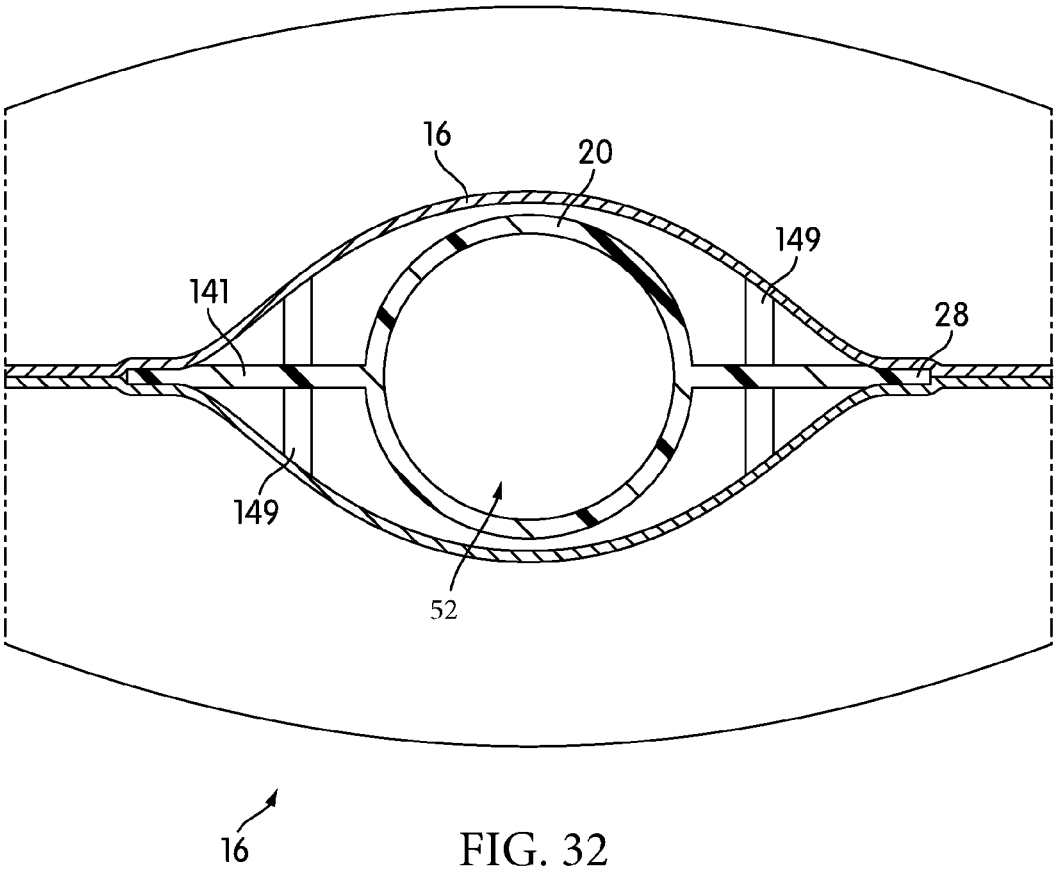
FIG. 32 is a top sectional view taken along line 32-32 of FIG. 1 according to one embodiment.

Referring to FIG. 31 and FIG. 32, another embodiment of a spout 14 incorporating a vent is shown. As shown in FIG. 31, the shape, size and configuration of ribs 145 generally mirrors the shape, size and configuration of bottom sealing wall 143. As illustrated by FIG. 31, in this embodiment, ribs 145 extend between wings 28, similar to bottom sealing wall 143. However, as shown in FIG. 32, unlike the bottom sealing wall 143 which has an uninterrupted outer perimeter (as shown in FIG. 21) the outer perimeter of ribs 145 is interrupted by gaps 149. The gaps 149 formed in the perimeter of ribs 145 extend from a bottom surface to a top surface of each rib 145. In FIG. 31 and FIG. 32 gaps 149 are shown as extending through the ribs 149 from the outer perimeter of ribs 145 to the support wall 141. However, in other embodiments gaps 149 may extend through the ribs 145 from the outer perimeter of ribs 145 to a depth that does not extend all the way to support wall 141. Gaps 149 may be formed along any portion of ribs 145 between first and second wings 28. Also, although in FIGS. 31 and 32 gaps 149 are illustrated as having a generally rectangular shape, gaps 149 may have any shape or cross-section and the dimensions of gaps 149 may vary from those shown in the figures.

As seen in FIG. 32, because gaps 149 are formed in the outer perimeter of ribs 145, the interface between the inner surfaces of the sidewalls of the pouch 16 and the ribs 145 is interrupted along those portions of the length of the ribs 145 at which gaps 149 are formed in the ribs 145. As also seen in FIG. 32, at those portion at which the outer perimeter of ribs 145 is in contact with the inner surfaces of sidewall of pouch 16, the outer perimeters of ribs 145 are configured to form a fluid-tight interface with the inner surfaces of the sidewalls of pouch 16. This fluid-tight attachment or bonding between the pouch 16 and the ribs 145 may involve an adhesive, a melted thermoplastic, heat welding, ultrasonic welding, or other means for sealing the structures together.

As seen in FIG. 32, at those portions along the length of ribs 145 at which gaps 149 are formed, the pouch 16 is attached to mounting portion 140 such that the pouch 16 lays taut against the outer perimeter of the mounting portion 140 so as to prevent the pouch from occluding gaps 149 and to allow for fluid communication between spaces 190 and the outside environment.

Figure 33:
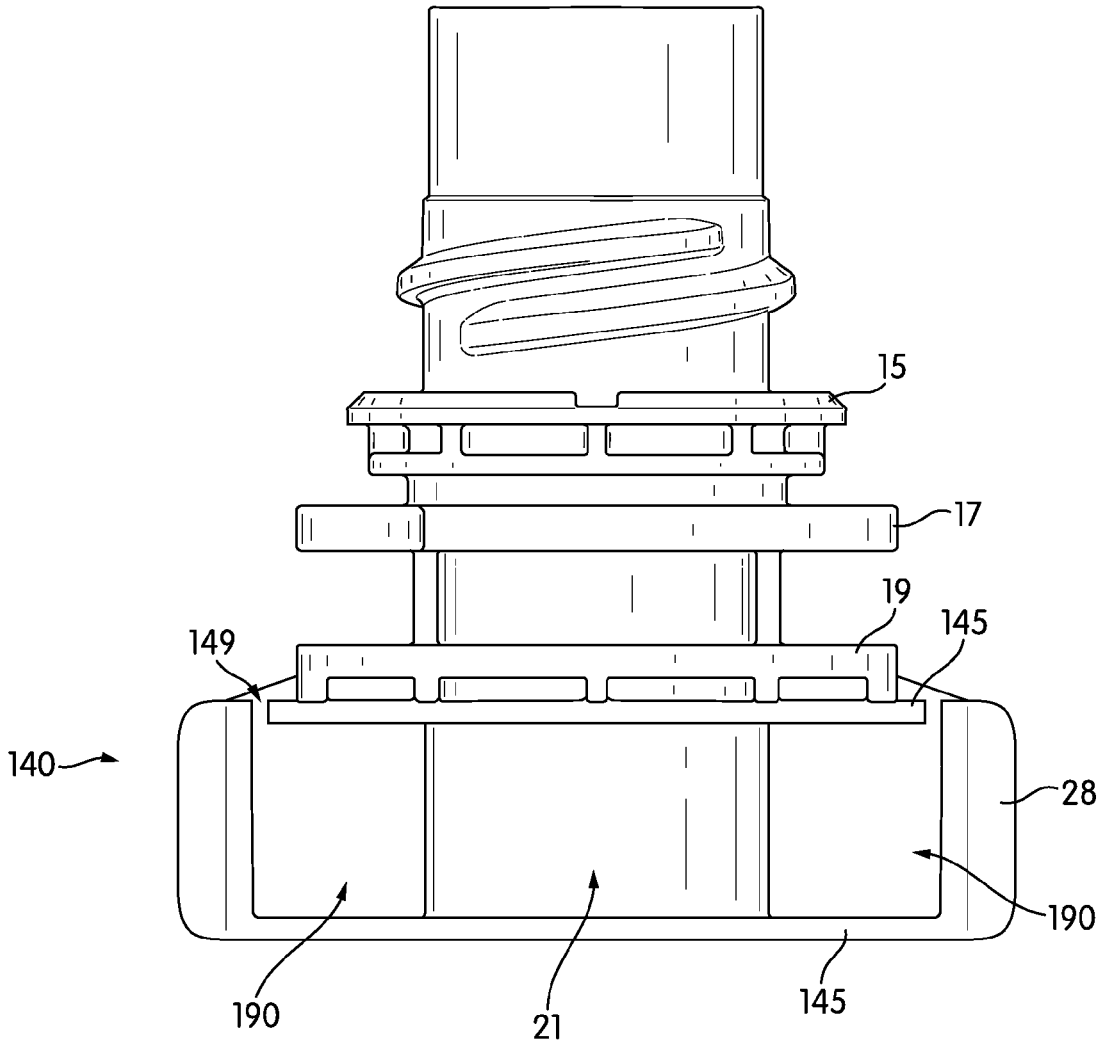
FIG. 33 is a front perspective view of one embodiment of a spout including a mounting portion having a vent according to one embodiment.

As illustrated by the various embodiments discussed above, spout 14 may include multiple ribs 145. Alternatively, in other embodiments, a spout 14 incorporating vents as shown in any of these embodiments may include only a single rib 145. Shown in FIG. 33 is one embodiment of a spout 14 including a single rib 145. The structure and configuration of the rib 145 and the corresponding vent formed by gaps 149 in the embodiment shown in FIG. 33 is similar to the structure and configuration of the ribs 145 and the corresponding vents formed by gaps 149 in the embodiment shown in FIG. 19. However, whereas in FIG. 19 the mounting portion 140 is illustrated as including three ribs, as seen in FIG. 33, the mounting portion includes a single rib 145. Although FIG. 33 illustrates an embodiment of a spout having only a single rib 145 and having a mounting portion 140 including a vent structure similar to the vent structure disclosed with reference to the embodiment of FIG. 19 discussed above, the use of a single rib 145 may be incorporated into any of the embodiments of the mounting portion 140 having a vent structure as discussed herein.

Figure 34:
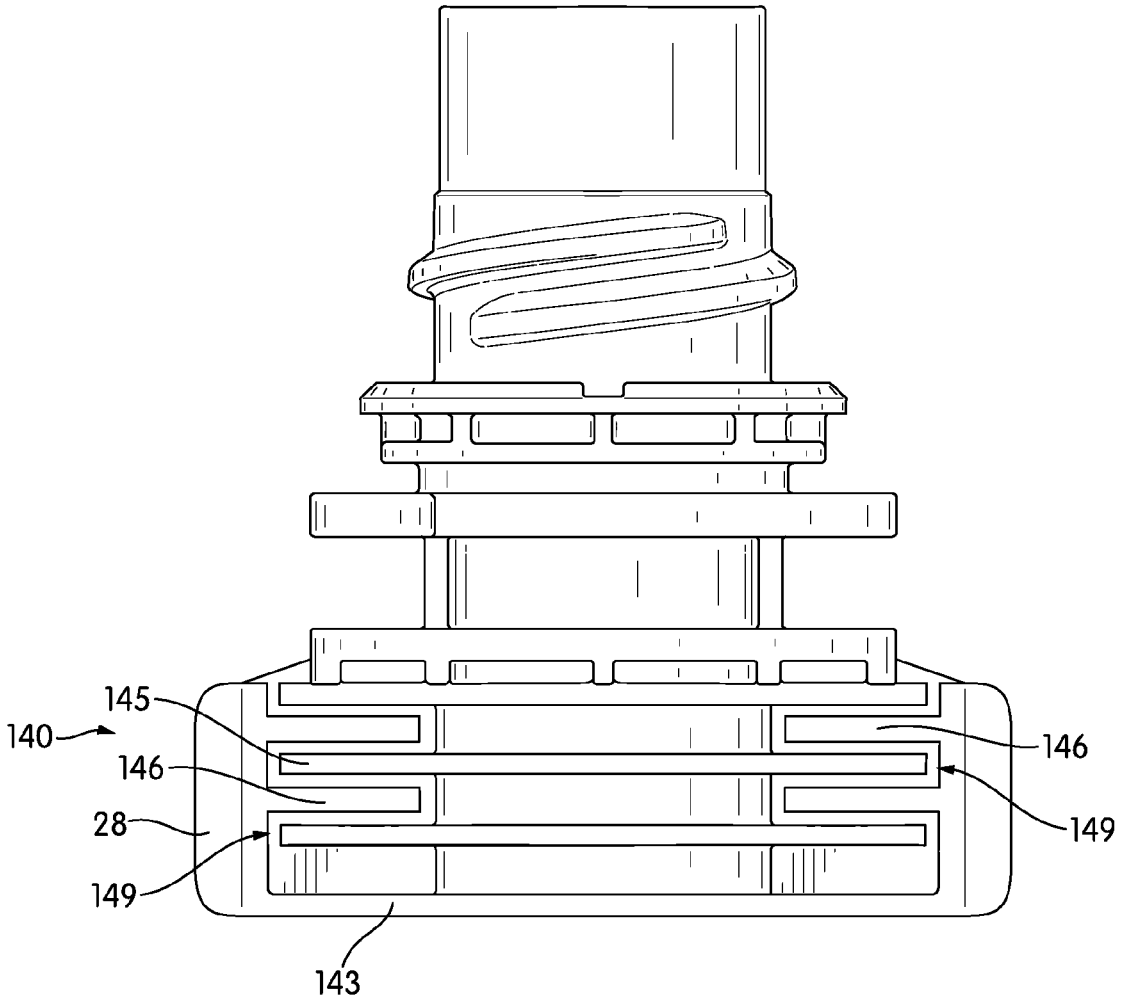
FIG. 34 is a front perspective view of another embodiment of a spout including a mounting portion having a vent according to one embodiment.

As shown in FIG. 34 spout 10 incorporating a venting feature as shown in any of the embodiments may also include one or more side projections 146. Although FIG. 34 illustrates an embodiment of a spout incorporating side projections 146 having a mounting portion 140 including a vent structure similar to the vent structure disclosed with reference to the embodiment of FIG. 19 discussed above, side projections 146 may be incorporated into any of the embodiments of the mounting portion 140 having a vent structure as discussed herein.

Referring to FIG. 34, side projections 146 may be configured to provide a greater surface area against which to seal the pouch 16 to allow for a more secure attachment of the spout 14 to the pouch 16. Also, side projections 146 may be configured to strengthen and prevent distortion or and damage to the spout 14 and to prevent damage to or accidental rupturing of the pouch 16 after the pouch 16 and spout 14 have been attached.

As shown in FIG. 34, in some embodiments side projections 146 project inwardly from wings 28. In other embodiments, side projections 146 extending perpendicularly outward from support wall 141 or radially outward from tube 20. Side projections 146 may be spaced in between adjacent ribs 145, and the outer perimeter of the side projections 146 may generally mirror the shape, size and configuration of the bottom sealing wall 143 and/or the ribs 145. Although in embodiment shown in FIG. 34 two side projections 146 are shown extending from each surface of on both wings 28, in other embodiments the number and positioning of side projections 146 may vary.

In one embodiment, not shown, side projection 146 may include a single side projection 146 having a height substantially similar to the height of wings 28 and extending from one wing 28 to the opposite wing 28 on both the front and rear sides of the mounting portion 140. In such an embodiment, the side projection 146 may form an annular wall which circumferentially surrounds the entire outer perimeter of ribs 145 around both the front and rear of the mounting portion 140. In such an embodiment, the side projection 146 may be configured so as to maximize the surface area of the mounting portion 140 to which the pouch 16 may be sealed. In some embodiments, the entirety of the bottom perimeter of the side projection may be attached to and circumferentially surround the upper surface of bottom sealing wall 143. In other embodiments, the side projection 146 may be attached to the mounting portion 140 only at wings 28. A mounting portion 140 having such a side projection 146 may be incorporated into the structure of any of the mounting portions 140 disclosed herein.

Figure 35:
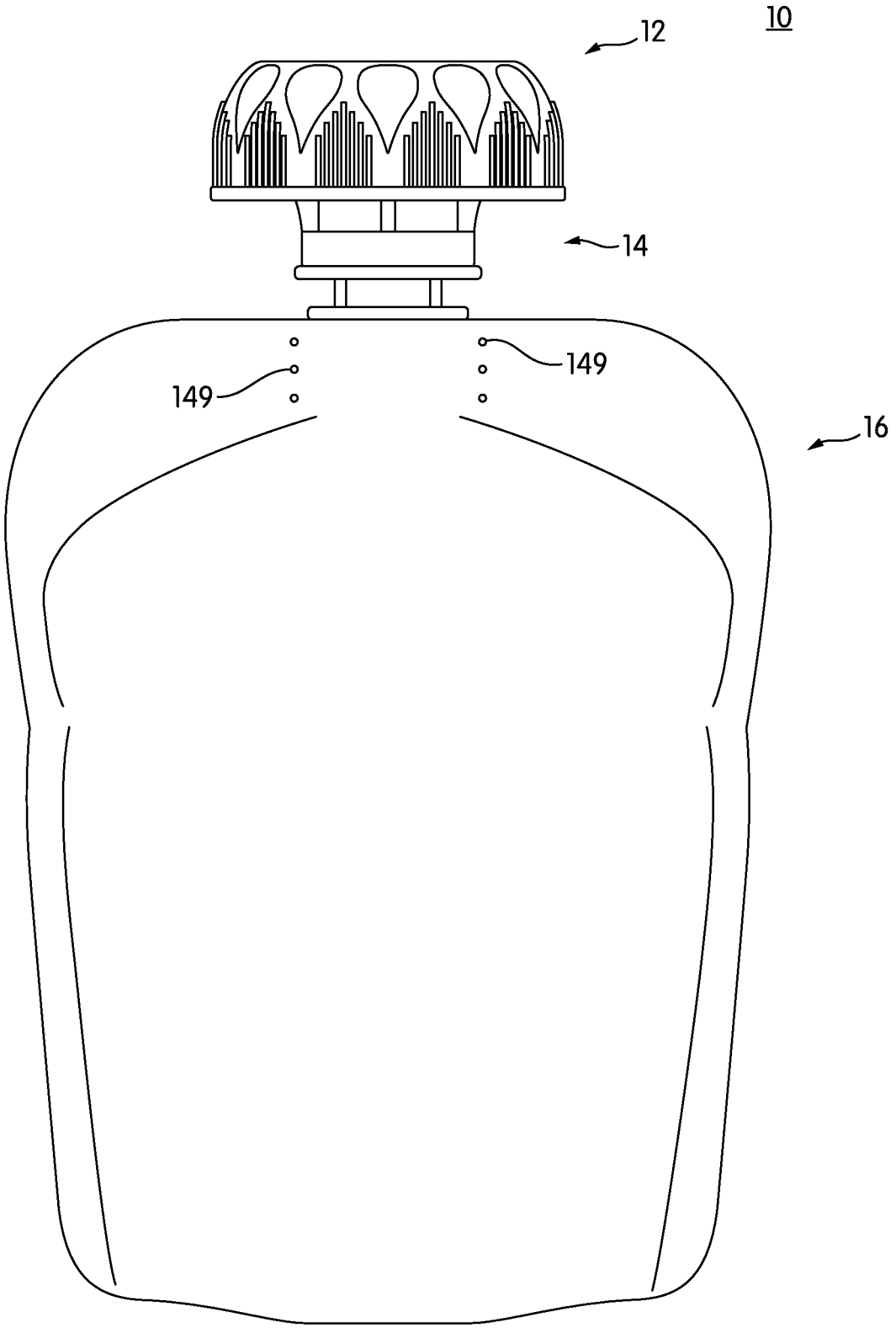
FIG. 35 shows a container assembly including a pouch having a vent feature according to one embodiment.
Figure 36:
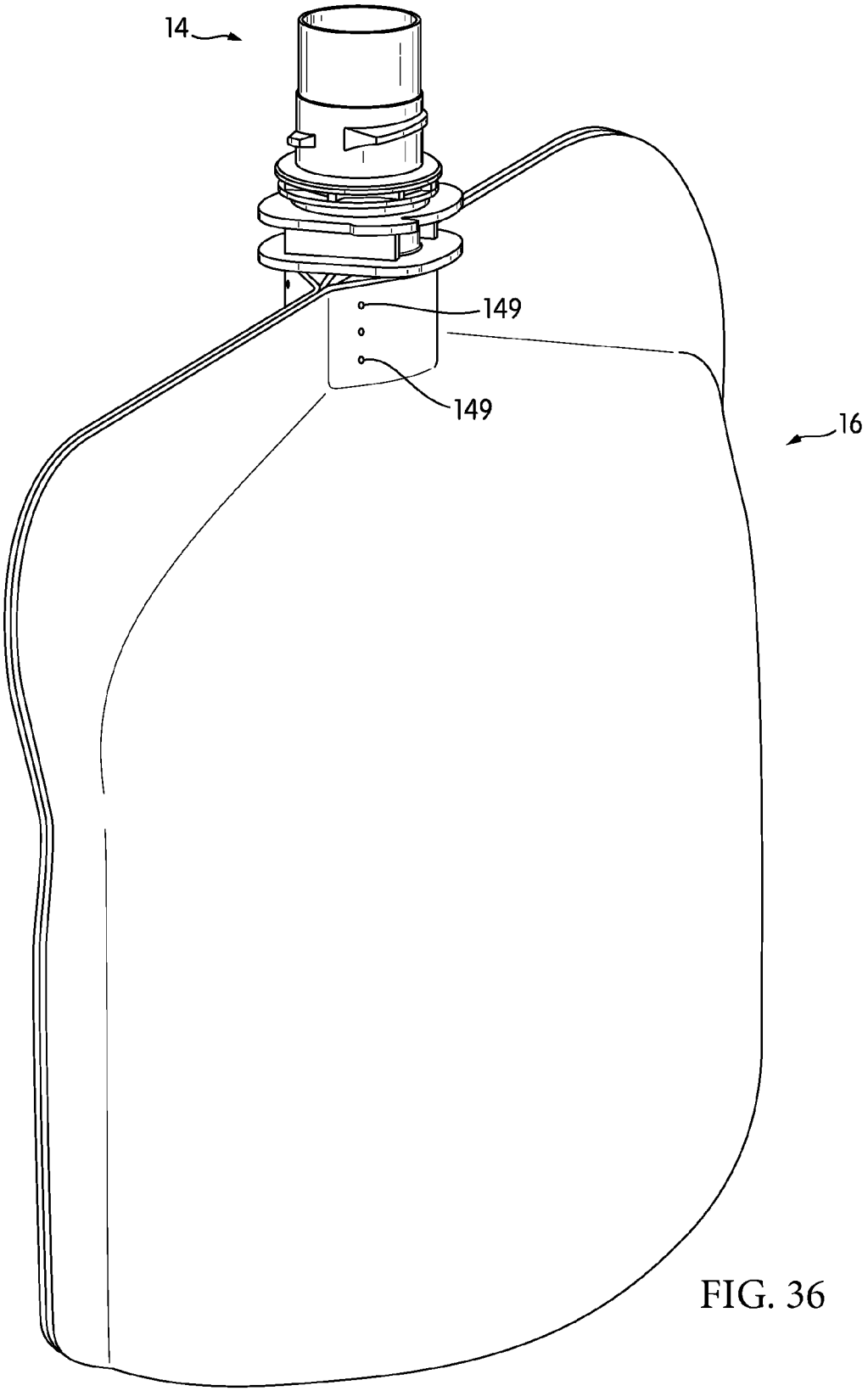
FIG. 36 is a perspective view of the container assembly of FIG. 35 according to one embodiment.

Referring to FIGS. 35-38, another embodiment of a container assembly 10 including vents that allow for fluid communication between the external environment and cavities (such as, e.g. spaces 190) formed between the inner surfaces of the sidewalls of pouch 16 and the external surfaces of mounting portion 140 when the mounting portion 140 and pouch are attached, is shown. As shown in FIGS. 35 and 36, gaps 149 are formed in the upper portion of pouch 16. Gaps 149 are formed as holes or apertures that extend from an outer surface of the sidewalls of pouch 16 to an inner surface of the sidewalls of pouch 16, creating a passageway through which fluid, such as, e.g., air, may pass. The holes or apertures in pouch 16 forming gaps 149 can be formed in pouch 16 prior to attachment of spout 14 to pouch 16. In other embodiments, gaps 149 can be formed in pouch 16 after spout 14 and pouch 16 have been attached. Although in FIGS. 35-38 gaps 149 as illustrated as round holes, gaps 149 may include any shape or cross-section and the dimensions of gaps 149 may vary from those shown in the figures.

Figure 38:
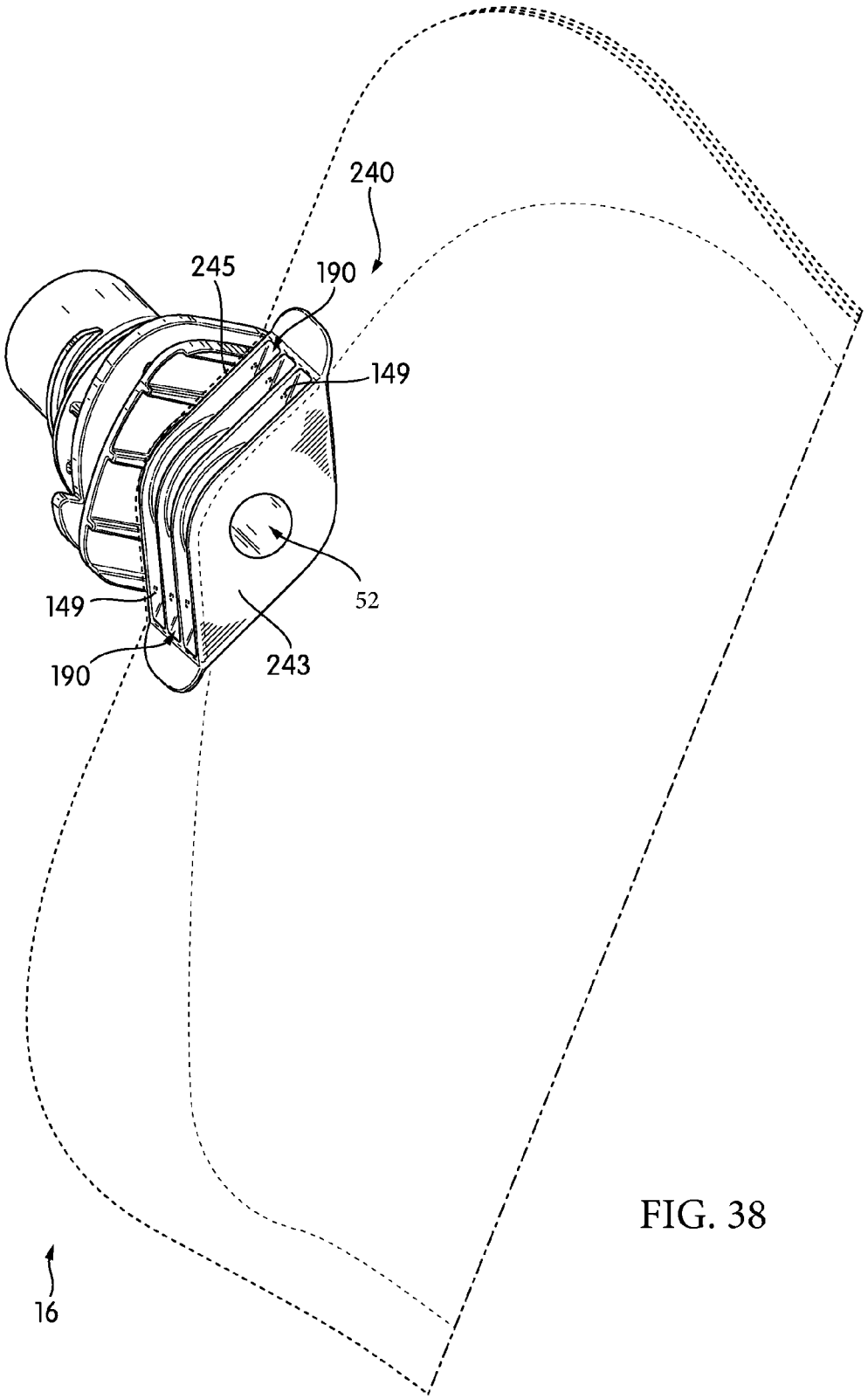
FIG. 38 is a bottom perspective view of the container assembly of FIG. 35 according to one embodiment.

As shown in FIGS. 36 and 38, in one embodiment, a pouch including gaps 149 is configured to be attached a mounting portion 240 which does not include any vent structure. As shown in FIGS. 36 and 38, the mounting portion 240 may include a bottom sealing wall 243 and ribs 245 whose outer perimeters are configured to form an uninterrupted, fluid-tight interface with the inner surfaces of the sidewalls of pouch 16 when the pouch 16 and spout 14 are attached. Additionally, the bottom sealing wall 243 and ribs 245 each include a solid structure that, with the exception of an opening through which tube 20 passes, includes no apertures or holes that pass from a bottom surface to a top surface. The openings in the bottom sealing wall 243 and ribs 245 through which tube 20 passes are attached to the exterior surface of tube 20 via a fluid-tight attachment.

Figure 37:
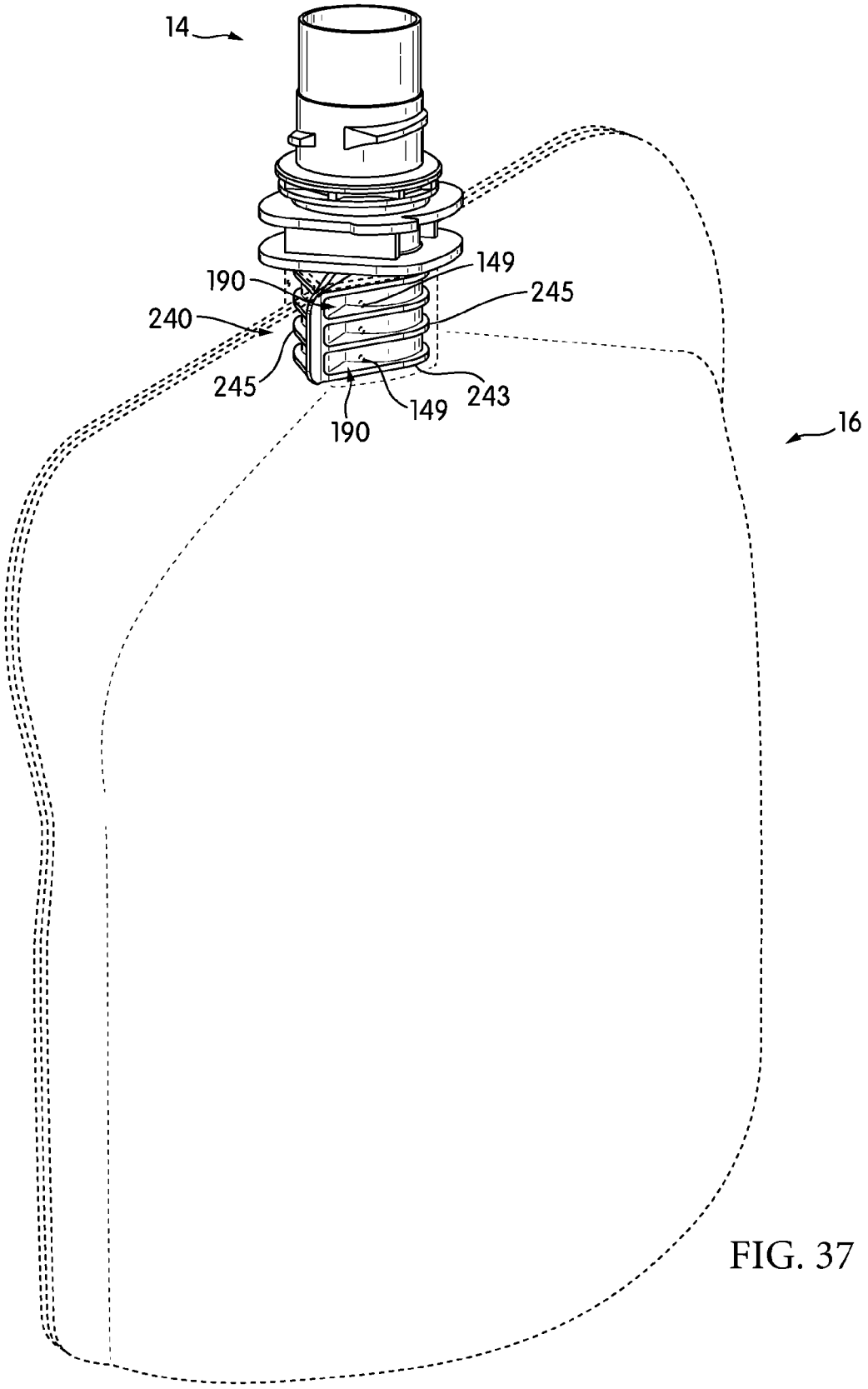
FIG. 37 is a perspective view of the container assembly of FIG. 35 according to one embodiment.

Referring to FIGS. 37 and 38, gaps 149 are arranged on the pouch 16 such that when pouch 16 and spout 14 are attached, the gaps 149 are aligned in between adjacent ribs 245 such that gaps 149 provide a vent that allows for fluid communication between spaces 190 formed between adjacent ribs 245 and between bottommost rib 245 and bottom sealing wall 243 and the outside of the pouch 16.

Although in the embodiment of FIGS. 36-38 pouch 16 including gaps 149 is shown attached to a mounting portion 240 that does not include a vent structure, the pouch 16 shown in the embodiment of FIGS. 36-38 may be used with and attached to a mounting portion 140 including vents according to any of the embodiments disclose herein. Similar to the embodiment shown in FIGS. 35-38, in such embodiments in which a mounting portion 140 including vents is attached to a pouch 16 also having gaps 149, pouch 16 is attached to spout 14 such that the gaps 149 of pouch 149 are aligned and positioned in between ribs 145 of the mounting portion 140, as similarly shown in FIGS. 37 and 38.

Referring more specifically to the function of the various embodiments of the vents discussed in detail above, the vents are configured to prevent or limit damage to or degradation of the bonding between the spout 14 and associated pouch 16 during high pressure processing ("HPP") of foods. During an HPP process, such as provided by Avure Technologies, filled containers are placed under pressures of over 80,000 psi using a fluid, such as water. By processing foods at extremely high water pressure (up to 6,000 bar/87,000 psi—more than the deepest ocean), Avure represents that its HPP machines neutralize listeria, salmonella, *E. coli* and other deadly bacteria that may be present in the contents of the containers prior to the HPP process. Unlike thermal, chemical and other high-heat treatments, HPP runs at cold temperatures to reduce altering food taste, texture or quality, or the requirement of adding of chemicals to maintain freshness or to exceed shelf-life.

One challenge with HPP is the development of containers that can be subjected to the pressures that are used during HPP. In the embodiments of the container assembly 10 having a vent as discussed in detail above, the vent allows for high pressures, (such as those used during the HPP process) to be applied to the container assembly without rupturing, degrading, or otherwise damaging the container assembly 10 during the HPP process.

Figure 39:
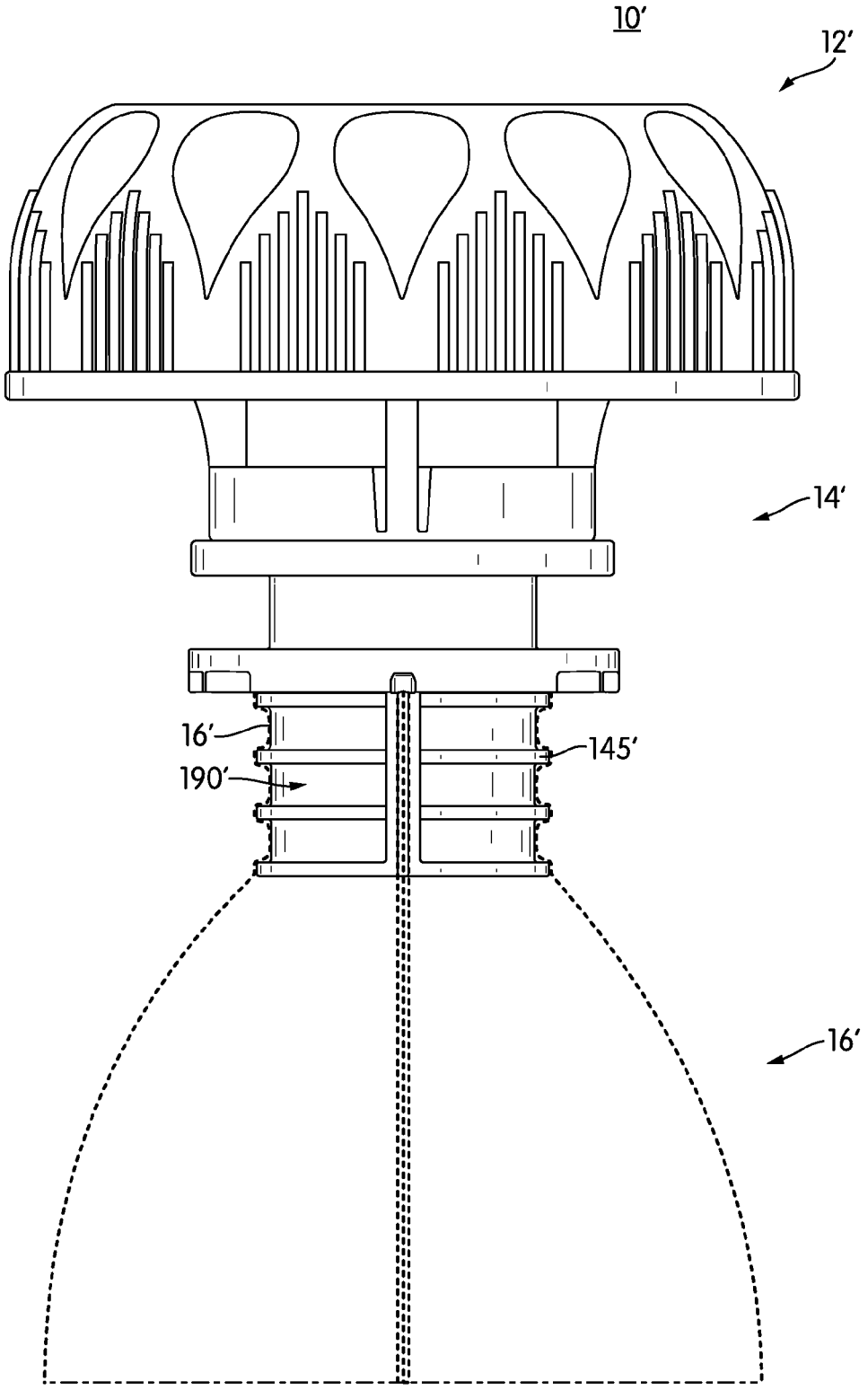
FIG. 39 illustrates a container assembly that does not include a vent structure undergoing high pressure processing.

Referring to FIG. 39, a container assembly 10' which does not include a vent is shown as the container assembly 10' undergoes HPP. During the HPP process, the ambient pressure surrounding the container assembly 10' is increased. However, because the container assembly 10' shown in FIG. 39 is formed without vents, the pressure within any cavities (e.g. spaces 190') formed between the inner surfaces of the sidewalls of the pouch 16' and the exterior surfaces of the mounting portion 140' remains unchanged. As the ambient pressure surrounding the container 10' increases, increasing forces are exerted on the outer surface of the sidewalls of pouch 16'. Because the container 10' does not include any vents that allow for fluid communication between the spaces 190' and the outside of the container 10', the pressure inside of spaces 190' and the forces exerted on the inner surfaces of the sidewall of pouch 16' remain unchanged during HPP. Without vents allowing for the pressure within the spaces 190' to equalize to the increasing ambient pressure, as the forces exerted on the outer surface of the pouch 16' continue to increase and the forces acting on the external surfaces of the sidewalls of the pouch 16' become greater than the forces acting on the inner surfaces of the sidewall of the pouch 16', the pouch 16' begins to collapse into and occlude spaces 190', as illustrated in FIG. 39.

As the pouch 16' begins to collapse into and occlude spaces 190' the pouch 16' increasingly impinges on the outer perimeter of ribs 145' and bottom sealing wall 143', resulting in increased stresses on the connection between the pouch 16' and the ribs 145' and causing the original attachment formed between pouch 16' and ribs 145' to deteriorate or otherwise be adversely affected. Also, as the pouch 16' begins to collapse into and occlude spaces 190', the material forming the pouch 190' may begin to deform, also resulting in the deterioration of the original attachment between the pouch 16' and ribs 145'. In some circumstances, as the pouch 16' increasingly is forced into spaces 190', the stress on the pouch material and/or the stress of the increased forces exerted at the attachment between the pouch 16' and ribs 145' may result in the pouch 16' tearing or otherwise rupturing around the interface between the pouch 16' and mounting portion 140'.

Figure 40:
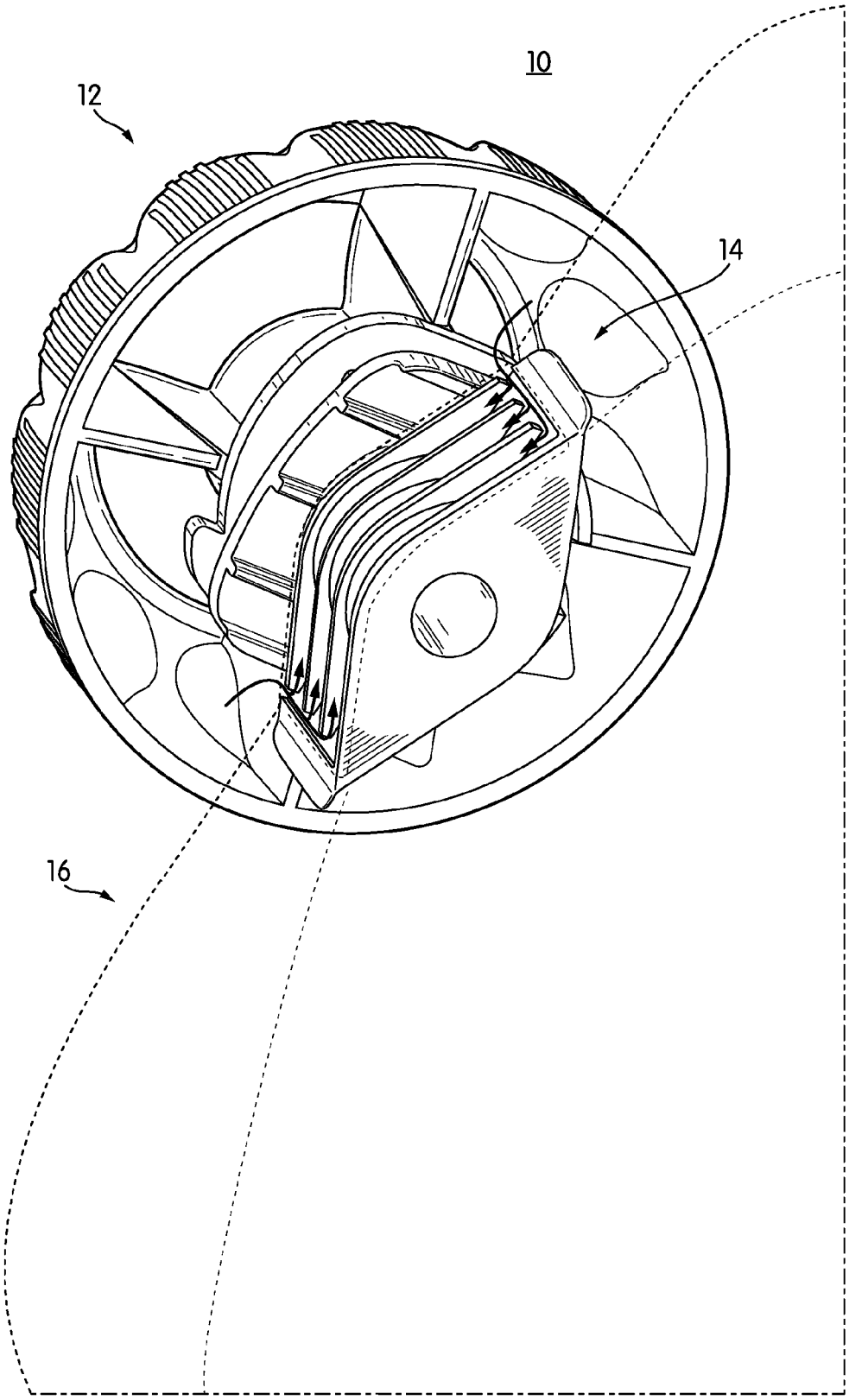
FIG. 40 illustrates a container assembly including a vent structure according to one embodiment undergoing high pressure processing.

Referring to FIG. 40, a container assembly 10 including a vent as discussed in detail above is shown as the container assembly 10 undergoes HPP. As shown by the arrows in FIG. 40, as the ambient pressure surrounding the container assembly 10 increases, vents in the container assembly allows for fluid communication between the outside the container assembly 10 gaps 149 and into spaces 190. By providing for fluid communication between the spaces 190 and the environment surrounding the outside of the container assembly 10, the pressure inside spaces 190 is able to equalize relative to the ambient pressure. Therefore, as the ambient pressure increases during HPP, the pressure inside spaces 190 is also able to correspondingly increase. As a result, the increasing forces acting on the external surface of the sidewalls of the pouch 16 resulting from the increased ambient pressure are counteracted by equal, but opposite forces acting on the internal surface of the sidewalls of the pouch 16 resulting from the corresponding increased pressure inside spaces 190. Because the forces acting on the external surface of the sidewalls of the pouch 16 are counteracted by the forces acting on the internal surfaces of the sidewall of the pouch 16, the changing pressure occurring during HPP prevents the deterioration, deformation, or other impairment of the attachment between the pouch 16 and mounting portion 140.

Although FIG. 40 illustrates a container assembly 10 including a vent structure similar to the vent structure disclosed with reference to the embodiment of FIG. 19 discussed above undergoing HPP, a container assembly 10 including a vent structure according to any of the embodiments discussed above would allow for a similar equalization of internal and ambient pressures during HPP.

In various embodiments, the closure 12 and/or spout 14 may be formed from a molded plastic material. In various embodiments, closure 12 and/or spout 14 may be polyethylene, polypropylene, polyethylene terephthalate, or any other suitable plastic material. In various embodiments, the closure 12 and/or spout 14 may be formed through any suitable molding method including, injection molding, compression molding, etc.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. Other substitutions, modifications, changes and omissions may also be made in the design, operating conditions and arrangement of the various exemplary embodiments without departing from the scope of the present invention.

For purposes of this disclosure, the term "coupled" or "attached to" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description. It should also be understood that the terminology is for the purpose of description only and should not be regarded as limiting.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above in the implementation of the teachings of the present disclosure.

I claim:

1. A tamper evident container closure assembly comprising:

an outer wall having an inner surface and an outer surface;

a central wall supported from and surrounded by the outer wall, the central wall having an inner surface, an outer surface, and a spout engagement structure located on the central wall inner surface;

a tamper-indicating band extending downwardly from the central wall, the tamper-indicating band comprising:

first and second wall sections, each of the first and second wall sections having a first end and a second end;

a frangible connector having clockwise and counterclockwise ends, the clockwise end of the connector being connected to the first end of the first wall section and the counterclockwise end being connected to the second end of the second wall section; and at least one engagement element extending inwardly from an inner surface of at least one of the first and second wall sections, the at least one engagement element configured to interact with a spout to break the tamper-indicating band;

first and second supports supported between the outer and central walls that each terminate at respective first and second ends proximate an upper portion of the tamper-indicating band;

a first hinge which joins the first end of the first support to the first end of the first wall section; and a second hinge which joins the second end of the second support to one of the first end of the second wall section and the second end of the first wall section.

2. The closure assembly of claim 1, further comprising a third hinge which joins the first end of the first support to the second end of the second wall section.

3. The closure assembly of claim 2, further comprising a second frangible connector attached to the second end of the first wall section, the second hinge joining the second end of the second support to the second end of the first wall section.

4. The closure assembly of claim 1, wherein the spout engagement structure comprises threads.

5. A tamper evident container closure assembly comprising:

an outer wall having an inner surface and an outer surface;

a central wall supported from and surrounded by the outer wall, the central wall having an inner surface, an outer surface, and a spout engagement structure located on the central wall inner surface;

a spout engaged to the spout engagement structure;

a tamper-indicating band extending downwardly from the central wall, the tamper-indicating band comprising:

first and second wall sections, each of the first and second wall sections having a first end and a second end;

a frangible connector having clockwise and counterclockwise ends, the clockwise end of the connector being connected to the first end of the first wall section and the counterclockwise end being connected to the second end of the second wall section; and at least one engagement element extending inwardly from an inner surface of at least one of the first and second wall sections, the at least one engagement element configured to interact with the spout to break the tamper-indicating band;

first and second supports supported between the outer and central walls that each terminate at respective first and second ends proximate an upper portion of the tamper-indicating band;

a first hinge which joins the first end of the first support to the first end of the first wall section; and a second hinge which joins the second end of the second support to one of the first end of the second wall section and the second end of the first wall section.

6. The closure assembly of claim 5, further comprising a container having an interior cavity containing contents, wherein the spout is hermetically sealed to the container.

7. A tamper evident container closure assembly comprising:

an outer wall having an inner surface and an outer surface;

a central wall supported from and surrounded by the outer wall, the central wall having an inner surface, an outer surface, and a spout engagement structure located on the central wall inner surface;

a tamper-indicating band extending downwardly from the central wall, the tamper-indicating band comprising:

first and second wall sections, each of the first and second wall sections having a first end and a second end;

a frangible connector having a clockwise facing end and a counterclockwise facing end, the clockwise facing end of the connector attached to the first end of the first wall section and the counterclockwise facing end of the connector attached to the second end of the second wall section;

at least one engagement element extending inwardly from an inner surface of at least one of the first and second wall sections, the at least one engagement element configured to interact with a spout to break the tamper-indicating band;

a support supported between the outer and central walls, the support having a lower end terminating proximate an upper portion of the tamper-indicating band;

a first hinge joining the support lower end to the first end of the first wall; and a second hinge joining the support lower end to the second end of the second wall.

8. The closure of claim 7, further comprising a second support supported between the outer and central walls and having a lower end terminating proximate an upper portion of the tamper-indicating band, and a third hinge joining the second support lower end to one of the second end of the first wall section and the first end of the second wall section.

9. The closure of claim 8, further comprising a third wall section having a first end and a second end.

10. The closure of claim 9, wherein the third hinge joins the second support lower end to the second end of the first wall, the closure further comprising a fourth hinge joining the second support lower end to the first end of the third wall section.

11. The closure assembly of claim 7, wherein the spout engagement structure comprises threads.

12. A tamper evident container closure assembly comprising:

an outer wall having an inner surface and an outer surface;

a central wall supported from and surrounded by the outer wall, the central wall having an inner surface, an outer surface, and a spout engagement structure located on the central wall inner surface;

a spout engaged to the spout engagement structure;

a tamper-indicating band extending downwardly from the central wall, the tamper-indicating band comprising:

first and second wall sections, each of the first and second wall sections having a first end and a second end;

a frangible connector having a clockwise facing end and a counterclockwise facing end, the clockwise facing end of the connector attached to the first end of the first wall section and the counterclockwise facing end of the connector attached to the second end of the second wall section;

at least one engagement element extending inwardly from an inner surface of at least one of the first and second wall sections, the at least one engagement element configured to interact with the spout to break the tamper-indicating band;

a support supported between the outer and central walls, the support having a lower end terminating proximate an upper portion of the tamper-indicating band;

a first hinge joining the support lower end to the first end of the first wall; and a second hinge joining the support lower end to the second end of the second wall.

13. The closure assembly of claim 12, further comprising a container having an interior cavity containing contents, wherein the spout is hermetically sealed to the container.

14. A tamper evident container closure assembly comprising:

an outer wall having an inner surface and an outer surface;

one or more radial walls extending inwardly from the inner surface of the outer wall;

a central wall supported by the one or more radial walls and surrounded by the outer wall, the central wall having an inner surface, an outer surface, and a spout engagement structure located on the central wall inner surface;

a passageway defined between the inner surface of the outer wall and outer surface of the central wall;

a tamper-indicating band extending downwardly from the central wall, the tamper-indicating band comprising: first, second, and third wall sections, a first breakable connector located between the first and second wall sections;

a second breakable connector located between the second and third wall sections; and a third breakable connector located between the third and first wall sections;

first, second, and third supports, each support supported between the outer and central walls and terminating proximate an upper portion of the tamper band;

a first and second hinge attached to the first support, the first hinge joining the first support to the first wall section and the second hinge joining the first support to the second wall section;

a third and fourth hinge attached to the second support, the third hinge joining the second support to the second wall section and the fourth hinge joining the second support to the third wall section; and a fifth hinge attached to the third support, the fifth hinge joining the third support to the third wall section.

15. The closure assembly of claim 14, further comprising:

a fourth wall section located between the third wall section and the first wall section;

a fourth breakable connector located between the fourth wall section and the first wall section;

a sixth hinge attached to the third support, the sixth hinge joining the third support to the fourth wall section;

a fourth support; and a seventh hinge attached to the fourth support, the seventh hinge joining the fourth support to the fourth wall section.

16. The closure assembly of claim 15, further comprising an eighth hinge, the eighth hinge attaching the fourth support to the first wall section.

17. The closure assembly of claim 14, wherein the spout engagement structure comprises threads.

18. The closure assembly of claim 14, further comprising a spout engaged to the spout engagement structure.

19. The closure assembly of claim 18, further comprising a container having an interior cavity containing contents, wherein the spout is hermetically sealed to the container.

20. The closure assembly of claim 19, further comprising a vent formed in at least one of the spout and container, the vent configured to provide fluid communication between a cavity formed between an inner surface of the container an exterior surface of the spout.

* * * * *